US006937835B2

(12) United States Patent
Okamoto

(10) Patent No.: US 6,937,835 B2
(45) Date of Patent: Aug. 30, 2005

(54) DEVELOPER CHARGING UNIT, DEVELOPING DEVICE, IMAGE-FORMING APPARATUS, AND COMPUTER SYSTEM

(75) Inventor: Katsumi Okamoto, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 44 days.

(21) Appl. No.: 10/648,833

(22) Filed: Aug. 27, 2003

(65) Prior Publication Data

US 2004/0120734 A1 Jun. 24, 2004

(30) Foreign Application Priority Data

Aug. 28, 2002 (JP) ..... 2002-249524
Aug. 28, 2002 (JP) ..... 2002-249525
Aug. 28, 2002 (JP) ..... 2002-249526
Aug. 28, 2002 (JP) ..... 2002-249527

(51) Int. Cl.[7] ..... G03G 15/08
(52) U.S. Cl. ..... 399/284
(58) Field of Search ..... 399/102, 103, 399/105, 111, 119, 126, 274, 284

(56) References Cited

U.S. PATENT DOCUMENTS 4,586,460 A 5/1986 Shimazaki et al.
4,920,916 A 5/1990 Mizuno et al.
6,078,771 A * 6/2000 Buchanan et al. ..... 399/284
2001/0048828 A1 12/2001 Ishii et al.

FOREIGN PATENT DOCUMENTS

EP 0 345 023 A1 12/1989
EP 0 841 599 A2 5/1998

* cited by examiner

*Primary Examiner*—Hoang Ngo
(74) *Attorney, Agent, or Firm*—Sughrue Mion, PLLC

(57) ABSTRACT

A developer charging unit comprises a developer charging member for charging developer bore by a developer bearing member by abutting against the developer bearing member; a supporting member for supporting the developer charging member; and a plurality of fixing portions for fixing the developer charging member and the supporting member together, the fixing portions being lined up according to a predetermined arrangement. A spacing between two of the fixing portions located in a central section in a longitudinal direction of the developer charging member is shorter than a spacing between two of the fixing portions located at an end section in the longitudinal direction of the developer charging member.

53 Claims, 26 Drawing Sheets

DEVELOPER CHARGING UNIT, DEVELOPING DEVICE, IMAGE-FORMING APPARATUS, AND COMPUTER SYSTEM

CROSS-REFERENCE TO RELATED APPLICATIONS

The present application claims priority upon Japanese Patent Application No. 2002-249524 filed Aug. 28, 2002, Japanese Patent Application No. 2002-249525 filed Aug. 28, 2002, Japanese Patent Application No. 2002-249526 filed Aug. 28, 2002, and Japanese Patent Application No. 2002-249527 filed Aug. 28, 2002, the contents of which are herein incorporated by reference.

BACKGROUND OF THE INVENTION

1. Field of the Invention

The present invention relates to a developer charging unit, a developing device, an image-forming apparatus, and a computer system.

2. Description of the Related Art

As one type of an image-forming apparatus, there is known, for example, an apparatus comprising a rotary-type developing unit. This rotary-type developing unit has a plurality of developing devices arranged radially about its axis of rotation. The developing devices are capable of developing a latent image formed on a photoconductor using developer, such as toner. When an image signal is sent from an external device such as a host computer, the image-forming apparatus makes the developing unit rotate about its axis of rotation in order to locate one of the plurality of developing devices in a developing position opposing the photoconductor. The apparatus forms a toner image by developing the latent image formed on the photoconductor, and then transfers the image onto an intermediate medium. A color image is formed by superimposing a plurality of toner images by sequentially changing the plurality of developing devices and repeating the above-mentioned developing and transferring processes.

In order to realize such functions as to develop a latent image formed on a photoconductor as mentioned above, a developing device has, for example: a developing roller, which serves as a developer bearing member for bearing toner; a toner reservoir; a toner supplying roller; and a restriction blade, which serves as a developer charging member and/or a thickness restricting member. The restriction blade is attached to the developing device through a support member for supporting the restriction blade and is capable of charging the toner bore by the developing roller. The restriction blade also abuts against the developing roller to restrict the thickness of the toner bore by the developing roller.

(1) In the developing device configured as above, since the restriction blade abuts against the developing roller, there is a possibility that the restriction blade will bend due to the load applied from the developing roller. Particularly, in case the developing roller and the restriction blade (or the support member for supporting the restriction blade) are supported at their end sections in the longitudinal direction, the degree of bending will become larger in the central section in the longitudinal direction of the restriction blade.

If such bending occurs in the restriction blade, there is a possibility that the pressing force of the restriction blade against the developing roller becomes uneven. Particularly, in the above-mentioned case, the pressing force will become weak at the central section in the longitudinal direction of the restriction blade.

Such an uneven pressing of the restriction blade may cause the toner charge to be uneven. Such unevenness in toner charge may cause problems such as deterioration in image, toner spill, and toner scatter.

Therefore, in order to make the toner charge even, a technique for reducing the unevenness in the pressing force of the restriction blade against the developing roller has been desired.

(2) Further, in some developing devices, end seals may be provided at each end section in the longitudinal direction of the restriction blade. These end seals function to prevent the toner from spilling out from between the frame and the circumferential surface of the developing roller.

The restriction blade and the end seals abut against the surface of the developing roller in order to achieve their functions described above. However, the characteristics of the end seals (for example, thickness, the properties of the material, etc.) is different from those of the restriction blade. Therefore, the end seals may have an influence on the pressing force of the restriction blade against the developing roller, and in some cases, the pressing force of the restriction blade against the developing roller becomes stronger at the end sections in the longitudinal direction of the restriction blade.

Such an uneven pressing of the restriction blade may cause the toner charge to be uneven. Such unevenness in toner charge may cause problems such as deterioration in image, toner spill, and toner scatter.

Therefore, in order to make the toner charge even, a technique for reducing the unevenness in the pressing force of the restriction blade against the developing roller has been desired.

(3) Further, as mentioned above, some developing devices have end seals provided in line with the restriction blade at each end section in the longitudinal direction of the restriction blade. These end seals function to prevent the toner from spilling out from between the housing and the circumferential surface of the developing roller.

The restriction blade and the end seals abut against the surface of the developing roller in order to achieve their functions described above. In order to make the end seals appropriately achieve their functions to prevent spilling of toner, it is necessary to press the end seals against the developing roller with a sufficiently large pressing force. On the other hand, if the pressing force of the restriction blade against the developing roller at the end sections, in the axial direction of the developing roller, of the restriction blade is equal to or larger than the strength of the pressing force of the end seals against the developing roller, then there is a possibility that the pressing force at the end sections of the restriction blade will become significantly greater than the other sections of the restriction blade.

Such an uneven pressing of the restriction blade may cause the toner charge to be uneven. Such unevenness in toner charge may cause problems such as deterioration in image, toner spill, and toner scatter.

Therefore, in order to make the toner charge even, a technique for reducing the unevenness in the pressing force of the restriction blade against the developing roller has been desired.

(4) Further, in some developing devices, it is necessary to keep the relative position of the restriction blade with respect to the developing roller constant. If there is a misalignment in the relative position, the thickness of the toner may become uneven. Such unevenness in thickness may bring about a problem that the degree of toner charge becomes uneven.

Therefore, in order to prevent such a problem from arising, a technique for preventing the misalignment in the relative position of the restriction blade with respect to the developing roller from occurring has been desired.

SUMMARY OF THE INVENTION

The present invention has been made in view of the circumstances mentioned above, and an object thereof is to provide a developer charging unit, a developing device, an image-forming apparatus, and a computer system, which are capable of making the charge of developer even and preventing a misalignment in a relative position of a thickness restricting member with respect to a developer bearing member from occurring.

A first aspect of the present invention is a developer charging unit comprising: a developer charging member for charging developer bore by a developer bearing member by abutting against the developer bearing member; a supporting member for supporting the developer charging member; and a plurality of fixing portions for fixing the developer charging member and the supporting member together, the fixing portions being lined up according to a predetermined arrangement, wherein a spacing between two of the fixing portions located in a central section in a longitudinal direction of the developer charging member is shorter than a spacing between two of the fixing portions located at an end section in the longitudinal direction of the developer charging member.

A second aspect of the present invention is a developer charging unit comprising: a developer charging member for charging developer bore by a developer bearing member; a supporting member for supporting the developer charging member; and a plurality of fixing portions for fixing the developer charging member and the supporting member together, the fixing portions being lined up according to a predetermined arrangement, wherein a distance between a free end of the developer charging member and one of the fixing portions located at an end section in a longitudinal direction of the developer charging member is longer than a distance between the free end of the developer charging member and one of the fixing portions located in a central section in the longitudinal direction of the developer charging member.

A third aspect of the present invention is a developing device comprising: a housing that has an opening and that is capable of containing developer; a developer bearing member for bearing the developer, the developer bearing member being arranged to front on the opening; a developer charging member for charging the developer bore by the developer bearing member; and a sealing member for preventing the developer from spilling out from between the housing and a circumferential surface of the developer bearing member at an end section in an axial direction of the developer bearing member, the housing further including a pressing portion for pressing the developer charging member towards the developer bearing member, wherein a pressing force caused by the pressing portion and exerted on an end section, in the axial direction of the developer bearing member, of the developer charging member becomes smaller from an end in the axial direction towards a center of the developer bearing member.

A fourth aspect of the present invention is a de eloping device comprising: a developer bearing member for bearing developer, the developer bearing member having a rotation shaft and being capable of rotating about the rotatio shaft; a shaft bearing member for receiving the rotation shaft of the developer bearing member and a thickness restricting unit having a thickness restricting member for restricting a thickness of a layer of the developer borne by the developer bearing member wherein the position of the thickness restricting unit is determined by the shaft bearing member.

Features and objects of the present invention other than the above will become clear by reading the description of the present specification with reference to the accompanying drawings.

BRIEF DESCRIPTION OF THE DRAWINGS

In order to facilitate further understanding of the present invention and the advantages thereof, reference is now made to the following description taken in conjunction with the accompanying drawings wherein.

DETAILED DESCRIPTION OF THE INVENTION

Figure 1:
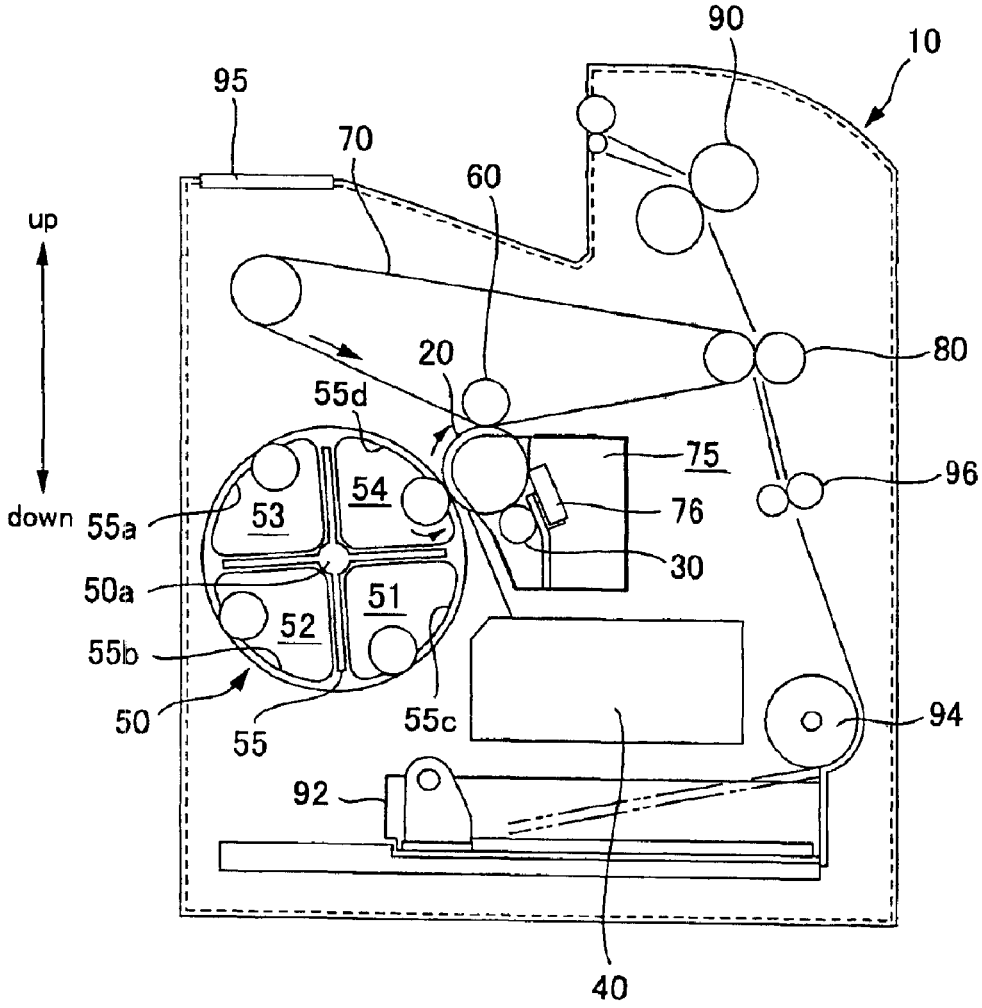
FIG. 1 is a diagram showing some main structural components constructing an image-forming apparatus according to an embodiment.

At least the following matters will be made clear by the explanation in the present specification and the description of the accompanying drawings.

(1) An aspect of the present invention is developer charging unit comprising: a developer charging member for charging developer bore by a developer bearing member by abutting against the developer bearing member; a supporting member for supporting the developer charging member; and a plurality of fixing portions for fixing the developer charging member and the supporting member together, the fixing portions being lined up according to a predetermined arrangement, wherein a spacing between two of the fixing portions located in a central section in a longitudinal direction of the developer charging member is shorter than a spacing between two of the fixing portions located at an end section in the longitudinal direction of the developer charging member.

Since the spacing between two of the fixing portions located in a central section in a longitudinal direction of the developer charging member is shorter than the spacing between two of the fixing portions located at an end section in the longitudinal direction of the developer charging member, it becomes possible to make the charge of developer even.

Further, it is preferable that the closer the fixing portions are located to a center in the longitudinal direction of the developer charging member, the shorter the spacing between two of the fixing portions becomes.

In this way, it becomes possible to make the charge of developer even more effectively.

Another aspect of the present invention is a developer charging unit comprising: a developer charging member for charging developer bore by a developer bearing member by abutting against the developer bearing member; a supporting member for supporting the developer charging member; and a plurality of fixing portions for fixing the developer charging member and the supporting member together, the fixing portions being lined up according to a predetermined arrangement, wherein a distance between a free end of the developer charging member and one of the fixing portions located in a central section in a longitudinal direction of the developer charging member is shorter than a distance between the free end of the developer charging member and one of the fixing portions located at an end section in the longitudinal direction of the developer charging member.

Since the distance between a free end of the developer charging member and one of the fixing portions located in a central section in a longitudinal direction of the developer charging member is shorter than the distance between the free end of the developer charging member and one of the fixing portions located at an end section in the longitudinal direction of the developer charging member, it becomes possible to make the charge of developer even.

Further, it is preferable that the closer a fixing portion is located to a center in the longitudinal direction of the developer charging member, the shorter the distance between the free end of the developer charging member and that fixing portion becomes.

In this way, it becomes possible to make the charge of developer even more effectively.

Another aspect of the present invention is a developer charging unit comprising: a developer charging member for charging developer bore by a developer bearing member by abutting against the developer bearing member; a supporting member for supporting the developer charging member; and a plurality of fixing portions for fixing the developer charging member and the supporting member together, the fixing portions being lined up according to a predetermined arrangement, wherein a number of the fixing portions located in a central section in a longitudinal direction of the developer charging member is larger than a number of the fixing portions located at an end section in the longitudinal direction of the developer charging member.

Since the number of the fixing portions located in a central section in a longitudinal direction of the developer charging member is larger than the number of the fixing portions located at an end section in the longitudinal direction of the developer charging member, it becomes possible to make the charge of developer even.

Further, it is preferable that the closer the fixing portions are located to a center in the longitudinal direction of the developer charging member, the larger the number of the fixing portions becomes.

In this way, it becomes possible to make the charge of developer even more effectively.

Further, it is preferable that the developer charging member and the supporting member are fixed together by welding.

In this way, it becomes possible to efficiently perform fixing at many points.

Further, it is preferable that the welding is laser welding.

By using laser welding, accurate and precise control can be achieved and it will become possible to overcome the difficulty in welding metal plates that differ in material and that also differ greatly in thickness.

Further, it is preferable that the developer charging member includes an elastic body that is capable of abutting against a surface of the developer bearing member, and an elastic-body-supporting member for supporting the elastic body; and the elastic-body-supporting member and the supporting member are fixed together.

In this way, it becomes possible to easily fix the developer charging member and the supporting member together.

Further, it is preferable that a screw hole for fixing the supporting member to a developing device is provided at each end section of the supporting member in the longitudinal direction thereof.

In such a situation, the supporting member is securely supported at both end sections thereof, and the bending in the central section in the longitudinal direction of the developer charging member becomes larger, and therefore, the pressing force of the developer charging member against the developer bearing member at the central section becomes weak. Therefore, the effect that the unevenness in pressing force can be reduced and the toner charge can be made even will be exerted more effectively in such a situation.

Further, it is possible to realize a developer charging unit comprising: a developer charging member for charging developer bore by a developer bearing member by abutting against the developer bearing member; a supporting member for supporting the developer charging member; and a plurality of fixing portions for fixing the developer charging member and the supporting member together, the fixing portions being lined up according to a predetermined arrangement, wherein: a spacing between two of the fixing portions located in a central section in a longitudinal direction of the developer charging member is shorter than a spacing between two of the fixing portions located at an end section in the longitudinal direction of the developer charging member; the closer the fixing portions are located to a center in the longitudinal direction of the developer charging member, the shorter the spacing between two of the fixing portions becomes; the developer charging member and the supporting member are fixed together by laser welding; the developer charging member includes an elastic body that is capable of abutting against a surface of the developer bearing member, and an elastic-body-supporting member for supporting the elastic body; the elastic-body-supporting member and the supporting member are fixed together; and a screw hole for fixing the supporting member to a developing device is provided at each end section of the supporting member in the longitudinal direction thereof.

Further, it is possible to realize a developer charging unit comprising: a developer charging member for charging developer bore by a developer bearing member by abutting against the developer bearing member; a supporting member for supporting the developer charging member; and a plurality of fixing portions for fixing the developer charging member and the supporting member together, the fixing portions being lined up according to a predetermined arrangement, wherein: a distance between a free end of the developer charging member and one of the fixing portions located in a central section in a longitudinal direction of the developer charging member is shorter than a distance between the free end of the developer charging member and one of the fixing portions located at an end section in the longitudinal direction of the developer charging member; the closer a fixing portion is located to a center in the longitudinal direction of the developer charging member, the shorter the distance between the free end of the developer charging member and that fixing portion becomes; the developer charging member and the supporting member are fixed together by laser welding; the developer charging member includes an elastic body that is capable of abutting against a surface of the developer bearing member, and an elastic-body-supporting member for supporting the elastic body; the elastic-body-supporting member and the supporting member are fixed together; and a screw hole for fixing the supporting member to a developing device is provided at each end section of the supporting member in the longitudinal direction thereof.

Further, it is possible to realize a developer charging unit comprising: a developer charging member for charging developer bore by a developer bearing member by abutting against the developer bearing member; a supporting member for supporting the developer charging member; and a plurality of fixing portions for fixing the developer charging member and the supporting member together, the fixing portions being lined up according to a predetermined arrangement, wherein: a number of the fixing portions located in a central section in a longitudinal direction of the developer charging member is larger than a number of the fixing portions located at an end section in the longitudinal direction of the developer charging member; the closer the fixing portions are located to a center in the longitudinal direction of the developer charging member, the larger the number of the fixing portions becomes; the developer charging member and the supporting member are fixed together by laser welding; the developer charging member includes an elastic body that is capable of abutting against a surface of the developer bearing member, and an elastic-body-supporting member for supporting the elastic body; the elastic-body-supporting member and the supporting member are fixed together; and a screw hole for fixing the supporting member to a developing device is provided at each end section of the supporting member in the longitudinal direction thereof.

Further, it is possible to realize a developing device comprising: a developer bearing member for bearing developer; and the developer charging unit described above, wherein a latent image bore by an image bearing member is developed using the developer bore by the developer bearing member and charged by the developer charging member provided in the developer charging unit.

In this way, it becomes possible to provide a developing device that achieves the effects mentioned above.

Further, it is possible to realize an image-forming apparatus comprising: an image bearing member for bearing a latent image; a developer bearing member for bearing developer; and the developer charging unit described above, wherein a latent image bore by the image bearing member is developed using the developer bore by the developer bearing member and charged by the developer charging member provided in the developer charging unit.

In this way, it becomes possible to provide an image-forming apparatus that achieves the effects mentioned above.

Further, it is possible to realize a computer system comprising: a computer unit; a display device that can be connected to the computer unit; and an image-forming apparatus that can be connected to the computer unit and that includes: an image bearing member for bearing a latent image; a developer bearing member for bearing developer; and the developer charging unit described above, wherein a latent image bore by the image bearing member is developed using the developer bore by the developer bearing member and charged by the developer charging member provided in the developer charging unit.

A computer system configured as above will be superior to existing computer systems as a whole.

(2) Another aspect of the present invention is a developer charging unit comprising: a developer charging member for charging developer bore by a developer bearing member; a supporting member for supporting the developer charging member; and a plurality of fixing portions for fixing the developer charging member and the supporting member together, the fixing portions being lined up according to a predetermined arrangement, wherein a distance between a free end of the developer charging member and one of the fixing portions located at an end section in a longitudinal direction of the developer charging member is longer than a distance between the free end of the developer charging member and one of the fixing portions located in a central section in the longitudinal direction of the developer charging member.

Since the distance between a free end of the developer charging member and one of the fixing portions located at an end section in a longitudinal direction of the developer charging member is longer than the distance between the free end of the developer charging member and one of the fixing portions located in a central section in the longitudinal direction of the developer charging member, it becomes possible to make the charge of developer even.

Further, it is preferable that a spacing between two of the fixing portions located at the end section in the longitudinal direction of the developer charging member is wider than a spacing between two of the fixing portions located in the central section in the longitudinal direction of the developer charging member.

In this way, it becomes possible to make the charge of developer even more effectively.

Further, it is preferable that the developer charging member and the supporting member are fixed together by welding.

In this way, it becomes possible to efficiently perform fixing at many points.

Further, it is preferable that the welding is laser welding.

By using laser welding, accurate and precise control can be achieved and it will become possible to overcome the difficulty in welding metal plates that differ in material and that also differ greatly in thickness.

Another aspect of the present invention is a developing device comprising: a developer bearing member for bearing developer; a developer charging unit including a developer charging member for charging the developer bore by the developer bearing member; a supporting member for supporting the developer charging member; and a plurality of fixing portions for fixing the developer charging member and the supporting member together, the fixing portions being lined up according to a predetermined arrangement, wherein a latent image bore by an image bearing member is developed using the developer bore by the developer bearing member, and wherein a distance between a free end of the developer charging member and one of the fixing portions located at an end section in a longitudinal direction of the developer charging member is longer than a distance between the free end of the developer charging member and one of the fixing portions located in a central section in the longitudinal direction of the developer charging member.

Since the distance between a free end of the developer charging member and one of the fixing portions located at an end section in a longitudinal direction of the developer charging member is longer than the distance between the free end of the developer charging member and one of the fixing portions located in a central section in the longitudinal direction of the developer charging member, it becomes possible to make the charge of developer even.

Further, it is preferable that a spacing between two of the fixing portions located at the end section in the longitudinal direction of the developer charging member is wider than a spacing between two of the fixing portions located in the central section in the longitudinal direction of the developer charging member.

In this way, it becomes possible to make the charge of developer even more effectively.

Further, it is preferable that the developer charging member and the supporting member are fixed together by welding.

In this way, it becomes possible to efficiently perform fixing at many points.

Further, it is preferable that the welding is laser welding.

By using laser welding, accurate and precise control can be achieved and it will become possible to overcome the difficulty in welding metal plates that differ in material and that also differ greatly in thickness.

Further, it is preferable that a sealing member for preventing the developer from spilling is provided at the end section in the longitudinal direction of the developer charging member.

In this way, the effect of reducing the problem that the sealing member has an influence on the pressing force of the developer charging member against the developer bearing member due to the difference in the characteristics of the sealing member from those of the developer charging member and that the pressing force of the developer charging member against the developer bearing member becomes stronger at the end sections in the longitudinal direction of the developer charging member is exerted more effectively.

Further, it is preferable that the developer charging member includes an elastic body that is capable of abutting against a surface of the developer bearing member, and an elastic-body-supporting member for supporting the elastic body; and the sealing member is fixed to the elastic-body-supporting member.

In such a situation, the sealing member may have a greater influence on the pressing force of the developer charging member against the developer bearing member due to the difference in characteristics of the sealing member and the developer charging member because the sealing member is attached directly to the developer charging member. Therefore, the above-mentioned effect, i.e., the effect that the developer charge can be made even by reducing the unevenness in pressing force will be exerted more effectively in such a situation.

Further, it is preferable that a thickness of the sealing member is thicker than a thickness of the elastic body.

In such a situation, the pressing force of the developer charging member against the developer bearing member at the end sections in the longitudinal direction of the developer charging member tends to become larger because the thickness of the sealing member is thicker than the developer charging member. Therefore, the above-mentioned effect, i.e., the effect that the intensity of the pressing force of the developer charging member against the developer bearing member at the end sections in the longitudinal direction can be reduced compared to the intensity of the pressing force of the developer charging member in the central section and the unevenness in pressing force can be reduced, and as a result, the developer charge can be made even will be exerted more effectively in such a situation.

Further, it is preferable that the elastic body and the sealing member are fixed to the elastic-body-supporting member next to each other; and the elastic body and the sealing member abut against the surface of the developer bearing member.

In such a situation, the sealing member may have a greater influence on the pressing force of the developer charging member against the developer bearing member due to the difference in characteristics of the sealing member and the developer charging member. Therefore, the above-mentioned effect, i.e., the effect that the developer charge can be made even by reducing the unevenness in pressing force will be exerted more effectively in such a situation.

Further, it is possible to realize a developing device comprising: a developer bearing member for bearing developer; a developer charging unit including a developer charging member for charging the developer bore by the developer bearing member; a supporting member for supporting the developer charging member; and a plurality of fixing portions for fixing the developer charging member and the supporting member together, the fixing portions being lined up according to a predetermined arrangement, wherein: a latent image bore by an image bearing member is developed using the developer bore by the developer bearing member; a distance between a free end of the developer charging member and one of the fixing portions located at an end section in a longitudinal direction of the developer charging member is longer than a distance between the free end of the developer charging member and one of the fixing portions located in a central section in the longitudinal direction of the developer charging member; a spacing between two of the fixing portions located at the end section in the longitudinal direction of the developer charging member is wider than a spacing between two of the fixing portions located in the central section in the longitudinal direction of the developer charging member; the developer charging member and the supporting member are fixed together by laser welding; a sealing member for preventing the developer from spilling is provided at the end section in the longitudinal direction of the developer charging member; the developer charging member includes an elastic body that is capable of abutting against a surface of the developer bearing member, and an elastic-body-supporting member for supporting the elastic body; a thickness of the sealing member is thicker than a thickness of the elastic body; the elastic body and the sealing member are fixed to the elastic-body-supporting member next to each other; and the elastic body and the sealing member abut against the surface of the developer bearing member.

Another aspect of the present invention is an image-forming apparatus comprising: an image bearing member for bearing a latent image; a developer bearing member for bearing developer; and a developer charging unit including a developer charging member for charging developer bore by the developer bearing member; a supporting member for supporting the developer charging member; and a plurality of fixing portions for fixing the developer charging member and the supporting member together, the fixing portions being lined up according to a predetermined arrangement, wherein: a latent image bore by the image bearing member is developed using the developer bore by the developer bearing member; and a distance between a free end of the developer charging member and one of the fixing portions located at an end section in a longitudinal direction of the developer charging member is longer than a distance between the free end of the developer charging member and one of the fixing portions located in a central section in the longitudinal direction of the developer charging member.

In this way, it becomes possible to provide an image-forming apparatus that achieves the effects mentioned above.

Further, it is possible to realize a computer system comprising: a computer unit; a display device that can be connected to the computer unit; and an image-forming apparatus that can be connected to the computer unit and that includes: an image bearing member for bearing a latent image; a developer bearing member for bearing developer; and a developer charging unit including a developer charging member for charging developer bore by the developer bearing member; a supporting member for supporting the developer charging member; and a plurality of fixing portions for fixing the developer charging member and the supporting member together, the fixing portions being lined up according to a predetermined arrangement, wherein: a latent image bore by the image bearing member is developed using the developer bore by the developer bearing member; and a distance between a free end of the developer charging member and one of the fixing portions located at an end section in a longitudinal direction of the developer charging member is longer than a distance between the free end of the developer charging member and one of the fixing portions located in a central section in the longitudinal direction of the developer charging member.

A computer system configured as above will be superior to existing computer systems as a whole.

(3) Another aspect of the present invention is a developing device comprising: a housing that has an opening and that is capable of containing developer; a developer bearing member for bearing the developer, the developer bearing member being arranged to front on the opening; a developer charging member for charging the developer bore by the developer bearing member; and a sealing member for preventing the developer from spilling out from between the housing and a circumferential surface of the developer bearing member at an end section in an axial direction of the developer bearing member, the housing further including a pressing portion for pressing the developer charging member towards the developer bearing member, wherein a pressing force caused by the pressing portion and exerted on an end section, in the axial direction of the developer bearing member, of the developer charging member becomes smaller from an end in the axial direction towards a center of the developer bearing member.

Since the pressing force caused by the pressing portion and exerted on an end section, in the axial direction of the developer bearing member, of the developer charging member becomes smaller from an end in the axial direction towards a center of the developer bearing member, it becomes possible to make the charge of developer even.

Further, it is preferable that a second sealing member is provided between the pressing portion and the developer charging member, the second sealing member being provided for preventing the developer from spilling out from between the pressing portion and the developer charging member.

In this way, effects such as to prevent the developer from spilling out from between the pressing portion and the developer charging member can be achieved.

Further, it is preferable that a spacing between the pressing portion and the developer charging member becomes wider from the end towards the center in the axial direction of the developer bearing member.

In this way, it is possible to make the pressing force caused by the pressing portion and exerted on the end sections, in the axial direction of the developer bearing member, of the developer charging member become smaller from the end in the axial direction towards the center according to a simple method.

Further, it is preferable that the pressing portion has a protruding portion protruding towards the developer charging member at an end, in the axial direction of the developer bearing member, of the pressing portion.

In this way, it is possible to make the pressing force caused by the pressing portion and exerted on the end sections, in the axial direction of the developer bearing member, of the developer charging member become smaller from the end in the axial direction towards the center according to a simple method.

Further, it is preferable that the protruding portion presses the sealing member through the second sealing member.

In this way, it becomes possible to press the sealing member against the developer bearing member with a sufficiently large pressing force and make the sealing member appropriately achieve its function of preventing the developer from spilling.

Further, it is preferable that the pressing portion has an inclined surface between the protruding portion and a non-protruding portion of the pressing portion.

In this way, it becomes possible for the second sealing member to be arranged smoothly along the pressing portion.

Further, it is preferable that the developer charging member includes an abutting member that is made to abut against the developer bearing member, and an impelling member for impelling the abutting member; the abutting member and the sealing member are fixed to the impelling member next to each other; and the abutting member and the sealing member abut against a surface of the developer bearing member.

In such a situation, the pressing force of the sealing member against the developer bearing member tends to have a greater influence on the pressing force of the developer charging member against the developer bearing member. Therefore, the above-mentioned effect, i.e., the effect that the developer charge can be made even by reducing the unevenness in pressing force will be exerted more effectively in such a situation.

Further, it is possible to realize a developing device comprising: a housing that has an opening and that is capable of containing developer; a developer bearing member for bearing the developer, the developer bearing member being arranged to front on the opening; a developer charging member for charging the developer bore by the developer bearing member; and a sealing member for preventing the developer from spilling out from between the housing and a circumferential surface of the developer bearing member at an end section in an axial direction of the developer bearing member, the housing further including a pressing portion for pressing the developer charging member towards the developer bearing member, wherein: a pressing force caused by the pressing portion and exerted on an end section, in the axial direction of the developer bearing member, of the developer charging member becomes smaller from an end in the axial direction towards a center of the developer bearing member; a second sealing member is provided between the pressing portion and the developer charging member, the second sealing member being provided for preventing the developer from spilling out from between the pressing portion and the developer charging member; a spacing between the pressing portion and the developer charging member becomes wider from the end towards the center in the axial direction of the developer bearing member; the pressing portion has a protruding portion protruding towards the developer charging member at an end, in the axial direction of the developer bearing member, of the pressing portion; the protruding portion presses the sealing member through the second sealing member; the pressing portion has an inclined surface between the protruding portion and a non-protruding portion of the pressing portion; the developer charging member includes an abutting member that is made to abut against the developer bearing member, and an impelling member for impelling the abutting member; the abutting member and the sealing member are fixed to the impelling member next to each other; and the abutting member and the sealing member abut against a surface of the developer bearing member.

Another aspect of the present invention is an image-forming apparatus comprising: a developing device including: a housing that has an opening and that is capable of containing developer; a developer bearing member for bearing the developer, the developer bearing member being arranged to front on the opening; a developer charging member for charging the developer bore by the developer bearing member; and a sealing member for preventing the developer from spilling out from between the housing and a circumferential surface of the developer bearing member at an end section in an axial direction of the developer bearing member, the housing further including a pressing portion for pressing the developer charging member towards the developer bearing member, wherein a pressing force caused by the pressing portion and exerted on an end section, in the axial direction of the developer bearing member, of the developer charging member becomes smaller from an end in the axial direction towards a center of the developer bearing member.

In this way, it becomes possible to provide an image-forming apparatus that achieves the effects mentioned above. Further, it is possible to realize a computer system comprising: a computer unit; a display device that can be connected to the computer unit; and an image-forming apparatus that can be connected to the computer unit and that includes: a developing device including: a housing that has an opening and that is capable of containing developer; a developer bearing member for bearing the developer, the developer bearing member being arranged to front on the opening; a developer charging member for charging the developer bore by the developer bearing member; and a sealing member for preventing the developer from spilling out from between the housing and a circumferential surface of the developer bearing member at an end section in an axial direction of the developer bearing member, the housing further including a pressing portion for pressing the developer charging member towards the developer bearing member, wherein a pressing force caused by the pressing portion and exerted on an end section, in the axial direction of the developer bearing member, of the developer charging member becomes smaller from an end in the axial direction towards a center of the developer bearing member.

A computer system configured as above will be superior to existing computer systems as a whole.

(4) Another aspect of the present invention is a developing device comprising: a developer bearing member for bearding developer, the developer bearing member having a rotation shaft and being capable of rotating about the rotation shaft; a shaft bearing member for receiving the rotation shaft of the developer bearing member; and a thickness restricting unit having a thickness restricting member for restricting a thickness of a layer of the developer bore by the developer bearing member, wherein the position of the thickness restricting unit is determined by the shaft bearing member.

Since the position of the thickness restricting unit is determined by the shaft bearing member, it becomes possible to prevent a misalignment in a relative position of a thickness restricting member with respect to a developer bearing member from occurring.

Further, it is preferable that the thickness restricting member abuts against the developer bearing member to restrict the thickness of the layer of the developer bore by the developer bearing member.

In such a situation, the thickness of the developer tends to become uneven due to the counterforce that the developer charging member receives from the developer bearing member. Therefore, the functions mentioned above will be exerted more effectively.

Further, it is preferable that the thickness restricting unit has a hole; the shaft bearing member has a protrusion; and the position of the thickness restricting unit is determined by fitting the protrusion into the hole.

In this way, the position of the thickness restricting unit can be determined according to a simple method.

Further, it is preferable that the thickness restricting unit has a plurality of holes; the shaft bearing member has a plurality of protrusions; each of the protrusions is fit into a corresponding one of the holes; and a first protrusion among the plurality of protrusions has a shaft bearing hole for receiving the rotation shaft.

In this way, the position of the thickness restricting unit can be determined more certainly.

Further, it is preferable that, among the plurality of holes, a first hole into which the first protrusion is fit has a circular shape.

Accordingly, it will be easy to form the shape of the hole. On the other hand, in such a situation, the thickness restricting unit tends to rotate about the center of the first protrusion with respect to the shaft bearing member. Therefore, the function of the protrusions other than the first protrusion to prevent the above-mentioned rotation will be achieved more effectively.

Further, it is preferable that the first protrusion is fit together with the first hole.

In this way, the position of the thickness restricting unit can be determined more certainly.

Further, it is preferable that a second protrusion that is different from the first protrusion is fit into a second hole that is different from the first hole; and a direction from a center of the first hole towards a center of the second hole intersects a direction of a counterforce that the thickness restricting member receives from the developer bearing member by abutting against the developer bearing member.

In this way, the function of the second protrusion to prevent the thickness restricting unit from rotating about the center of the first protrusion with respect to the shaft bearing member will be achieved more effectively.

Further, it is preferable that a second protrusion that is different from the first protrusion is fit into a second hole that is different from the first hole; the second protrusion abuts against the second hole at two sections; and a direction of a line that passes through the two sections is parallel to a direction of a counterforce that the thickness restricting member receives from the developer bearing member by abutting against the developer bearing member.

In this way, the function of the second protrusion to prevent the thickness restricting unit from rotating about the center of the first protrusion with respect to the shaft bearing member will be achieved more effectively.

Further, it is preferable that the developing device further comprises a housing capable of containing the developer, and that the protrusion is fit into the hole across the housing.

In this way, the thickness restricting member and the developer bearing member will be appropriately fixed to the housing.

Further, it is possible to realize a developing device comprising: a developer bearing member for bearding developer, the developer bearing member having a rotation shaft and being capable of rotating about the rotation shaft; a shaft bearing member for receiving the rotation shaft of the developer bearing member; and a thickness restricting unit having a thickness restricting member for restricting a thickness of a layer of the developer bore by the developer bearing member by abutting against the developer bearing member, wherein: the thickness restricting unit has a plurality of holes; the shaft bearing member has a plurality of protrusions; the position of the thickness restricting unit is determined by the shaft bearing member by fitting each of the protrusions into a corresponding one of the holes; a first protrusion among the plurality of protrusions has a shaft bearing hole for receiving the rotation shaft; among the plurality of holes, a first hole into which the first protrusion is fit has a circular shape; the first protrusion is fit together with the first hole; a second protrusion that is different from the first protrusion is fit into a second hole that is different from the first hole; a direction from a center of the first hole towards a center of the second hole intersects a direction of a counterforce that the thickness restricting member receives from the developer bearing member by abutting against the developer bearing member; the second protrusion abuts against the second hole at two sections; a direction of a line that passes through the two sections is parallel to a direction of a counterforce that the thickness restricting member receives from the developer bearing member by abutting against the developer bearing member; the developing device further comprises a housing capable of containing the developer; and the protrusions are fit into the holes across the housing.

Another aspect of the present invention is an image-forming apparatus comprising: a developing device including: a developer bearing member for bearding developer, the developer bearing member having a rotation shaft and being capable of rotating about the rotation shaft; a shaft bearing member for receiving the rotation shaft of the developer bearing member; and a thickness restricting unit having a thickness restricting member for restricting a thickness of a layer of the developer bore by the developer bearing member, wherein the position of the thickness restricting unit is determined by the shaft bearing member.

In this way, it becomes possible to provide an image-forming apparatus that achieves the effects mentioned above.

Further, it is possible to realize a computer system comprising: a computer unit; a display device that can be connected to the computer unit; and an image-forming apparatus that can be connected to the computer unit and that includes: a developing device including: a developer bearing member for bearding developer, the developer bearing member having a rotation shaft and being capable of rotating about the rotation shaft; a shaft bearing member for receiving the rotation shaft of the developer bearing member; and a thickness restricting unit having a thickness restricting member for restricting a thickness of a layer of the developer bore by the developer bearing member, wherein the position of the thickness restricting unit is determined by the shaft bearing member.

A computer system configured as above will be superior to existing computer systems as a whole.

Example of Overall Configuration of Image-Forming Apparatus

Next, with reference to FIG. 1, an outline of an image-forming apparatus will be described, taking a laser-beam printer 10 (hereinafter referred to also as "printer") as an example. FIG. 1 is a diagram showing some main structural components constructing the printer 10. Note that in FIG. 1, the vertical direction is shown by the arrow; for example, a paper supply tray 92 is arranged at a lower section of the printer 10, and a fusing unit 90 is arranged at an upper section of the printer 10.

As shown in FIG. 1, the printer 10 according to the present embodiment comprises the following components: a charging unit 30; an exposing unit 40; a YMCK developing unit 50; a first transferring unit 60; an intermediate transferring element 70; and a cleaning head 75. These components are arranged in the circumferential (rotating) direction of a photoconductor 20, which is an example of an image bearing member being capable of bearing a latent image. The printer 10 further comprises: a second transferring unit 80; a fusing unit 90; a displaying unit 95 comprising a liquid-crystal display and serving as notifying means to a user; and a control unit (FIG. 2) for controlling these units and the like and managing the operations as a printer.

The photoconductor 20 comprises a cylindrical, conductive base and a photoconductive layer formed on the outer peripheral surface of the conductive base, and is rotatable about a central axis. In the present embodiment, the photoconductor 20 rotates clockwise, as shown by the arrow in FIG. 1.

The charging unit 30 is a device for charging the photoconductor 20. The exposing unit 40 is a device for forming a latent image on the charged photoconductor 20 by radiating laser thereon. The exposing unit 40 has, for example, a semiconductor laser, a polygon mirror, an F-θ lens, and the like, and radiates modulated laser onto the charged photoconductor 20 according to image signals having been input from a host computer (not shown) such as a personal computer or a word processor.

The YMCK developing unit 50 is a device for developing the latent image formed on the photoconductor 20 using toner (as an example of developer) contained in each of the developing devices, that is, yellow (Y) toner, magenta (M) toner, cyan (C) toner, and black (K) toner. The black (K) toner is contained in a black developing device 51, the magenta (M) toner is contained in a magenta developing device 52, the cyan (C) toner is contained in a cyan developing device 53, and the yellow (Y) toner is contained in a yellow developing device 54.

In the present embodiment, the YMCK developing unit 50 can move the positions of the four developing devices 51, 52, 53, 54 by rotating them. More specifically, the YMCK developing unit 50 holds the four developing devices 51, 52, 53, 54 with four holders, or holding sections, 55*a*, 55*b*, 55*c*, 55*d*. The four developing devices 51, 52, 53, 54 can be rotated about a rotating shaft 50*a*, which is an axis of rotation, while maintaining their relative positions.

As the photoconductor 20 makes one revolution, each of the developing devices 51, 52, 53, 54 selectively opposes the photoconductor 20. Accordingly, the latent image formed on the photoconductor 20 is developed by the toner contained in each of the developing devices 51, 52, 53, 54. Note that the developing devices will be described in detail later.

The first transferring unit 60 is a device for transferring a single-color toner image formed on the photoconductor 20 onto the intermediate transferring element 70. When the toners of all four colors are sequentially transferred in a superimposing manner, a full-color toner image will be formed on the intermediate transferring element 70. The intermediate transferring element 70 is an endless belt, and is rotatingly driven at substantially the same circumferential speed as the photoconductor 20. The second transferring unit 80 is a device for transferring the single-color toner image or the full-color toner image formed on the intermediate transferring element 70 onto a recording medium such as paper, film, cloth, and the like.

The fusing unit 90 is a device for fusing, to the recording medium such as paper, the single-color toner image or the full-color toner image which has been transferred onto the recording medium to make it into a permanent image.

The cleaning unit 75 is a device that is provided between the first transferring unit 60 and the charging unit 30, has a rubber cleaning blade 76 placed in contact with (or, abutting against) the surface of the photoconductor 20, and can remove the toner remaining on the photoconductor 20 by scraping it off with the cleaning blade 76 after the toner image has been transferred onto the intermediate transferring element 70 by the first transferring unit 60.

Figure 2:
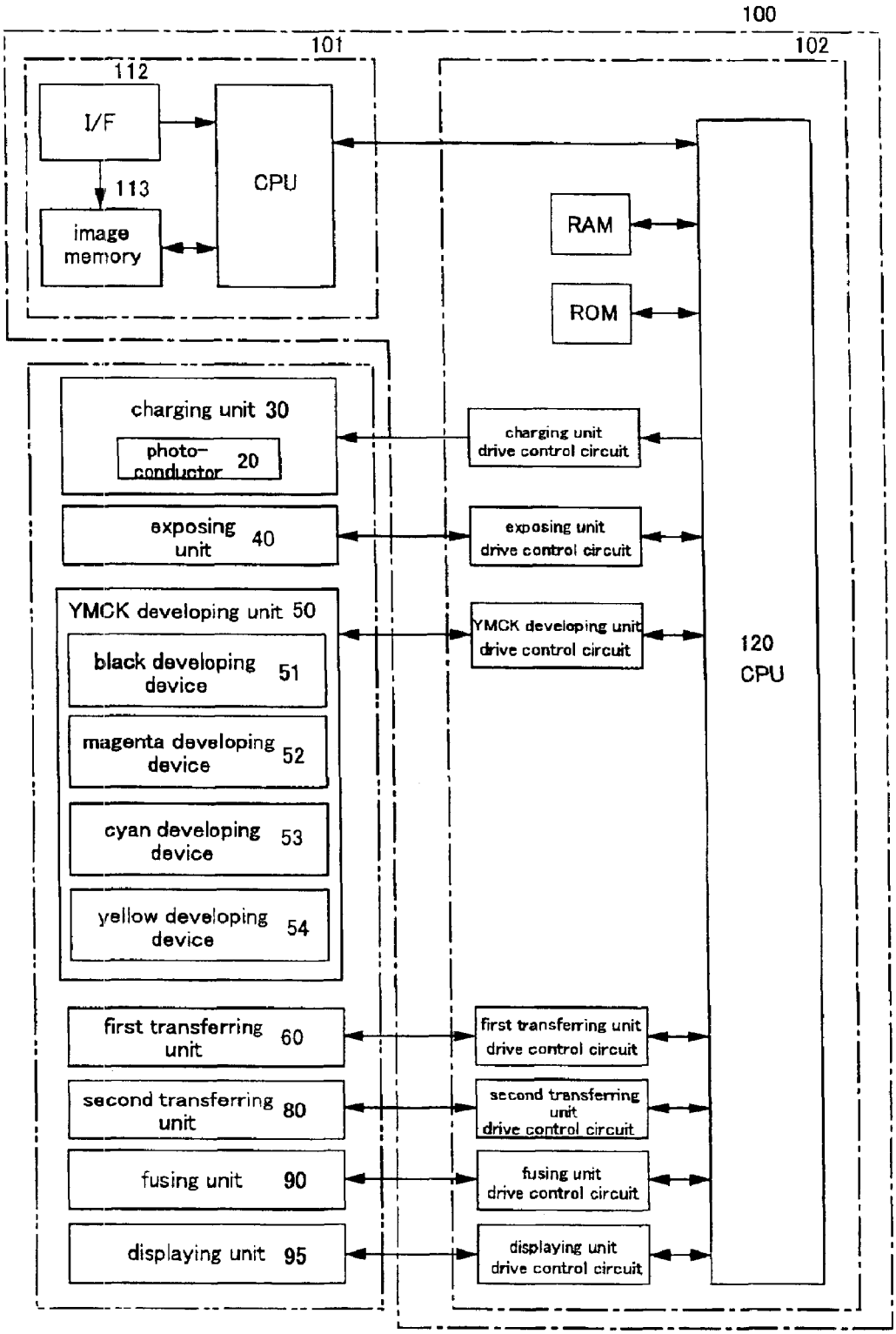
FIG. 2 is a block diagram showing a control unit of the image-forming apparatus according to the embodiment of FIG. 1.

The control unit 100 comprises a main controller 101 and a unit controller 102 as shown in FIG. 2. An image signal is input to the main controller 101. According to instructions based on the image signal, the unit controller 102 controls each of the above-mentioned units and the like to form an image.

Next, operations of the printer 10 structured as above will be described with reference to other structural components.

First, when an image signal is input from the host computer (not shown) to the main controller 101 of the printer 10 through an interface (I/F) 112, the photoconductor 20, a developing roller provided in the developing device as an example of a "developer bearing member", and the intermediate transferring element 70 rotate under the control of the unit controller 102 based on the instructions from the main controller 101. While being rotated, the photoconductor 20 is sequentially charged by the charging unit 30 at a charging position.

With the rotation of the photoconductor 20, the charged area of the photoconductor 20 reaches an exposure position. A latent image in accordance with image information about the first color, for example yellow Y, is formed in the charged area by the exposing unit 40. The YMCK developing unit 50 locates the yellow developing device 54 containing yellow (Y) toner in the developing position opposing the photoconductor 20.

With the rotation of the photoconductor 20, the latent image formed on the photoconductor 20 reaches the developing position, and is developed with the yellow toner by the yellow developing device 54. Thus, a yellow toner image is formed on the photoconductor 20.

With the rotation of the photoconductor 20, the yellow toner image formed on the photoconductor 20 reaches a first transferring position, and is transferred onto the intermediate transferring element 70 by the first transferring unit 60. Here, a first transferring voltage, having an opposite polarity from the charge polarity of the toner, is applied to the first transferring unit 60. During the above-mentioned processes, the second transferring unit 80 is kept apart from the intermediate transferring element 70.

By repeating the above-mentioned processes for the second, the third, and the fourth colors, toner images in four colors corresponding to the respective image signals are transferred to the intermediate transferring element 70 in a superimposed manner. As a result, a full-color toner image is formed on the intermediate transferring element 70.

With the rotation of the intermediate transferring element 70, the full-color toner image formed on the intermediate transferring element 70 reaches a second transferring position, and is transferred onto a recording medium by the second transferring unit 80. The recording medium is carried from the paper supply tray 92 to the second transferring unit 80 through the paper-feed roller 94 and resisting rollers 96. While the image is being transferred, a second transferring voltage is applied to the second transferring unit 80 as the unit 80 is pressed against the intermediate transferring element 70.

The full-color toner image transferred onto the recording medium is heated and pressurized by the fusing unit 90 and fused to the recording medium.

On the other hand, after the photoconductor 20 passes the first transferring position, the toner attaching to the surface of the photoconductor 20 is scraped off by the cleaning blade 76 that is supported to the cleaning unit 75, and the photoconductor 20 is prepared for charging for forming a next latent image. The scraped-off toner is collected in a remaining-toner collector that the cleaning unit 75 comprises.

Overview of Control Unit

Next, with reference to FIG. 2, the configuration of the control unit 100 will be described. The main controller 101 of the control unit 100 is connected to the host computer through the interface (I/F) 112 and comprises an image memory 113 for storing image signals input from the host computer. The unit controller 102 is electrically connected to each of the units of the printing apparatus (i.e., the charging unit 30, the exposing unit 40, the YMCK developing unit 50, the first transferring unit 60, the cleaning unit 75, the second transferring unit 80, the fusing unit 90, and the displaying unit 95). By receiving signals from sensors provided on each of the units, the unit controller 102 detects the state of each unit and controls each unit according to the signals input from the main controller 101.

Configuration Example of Developing Device

Figure 3:
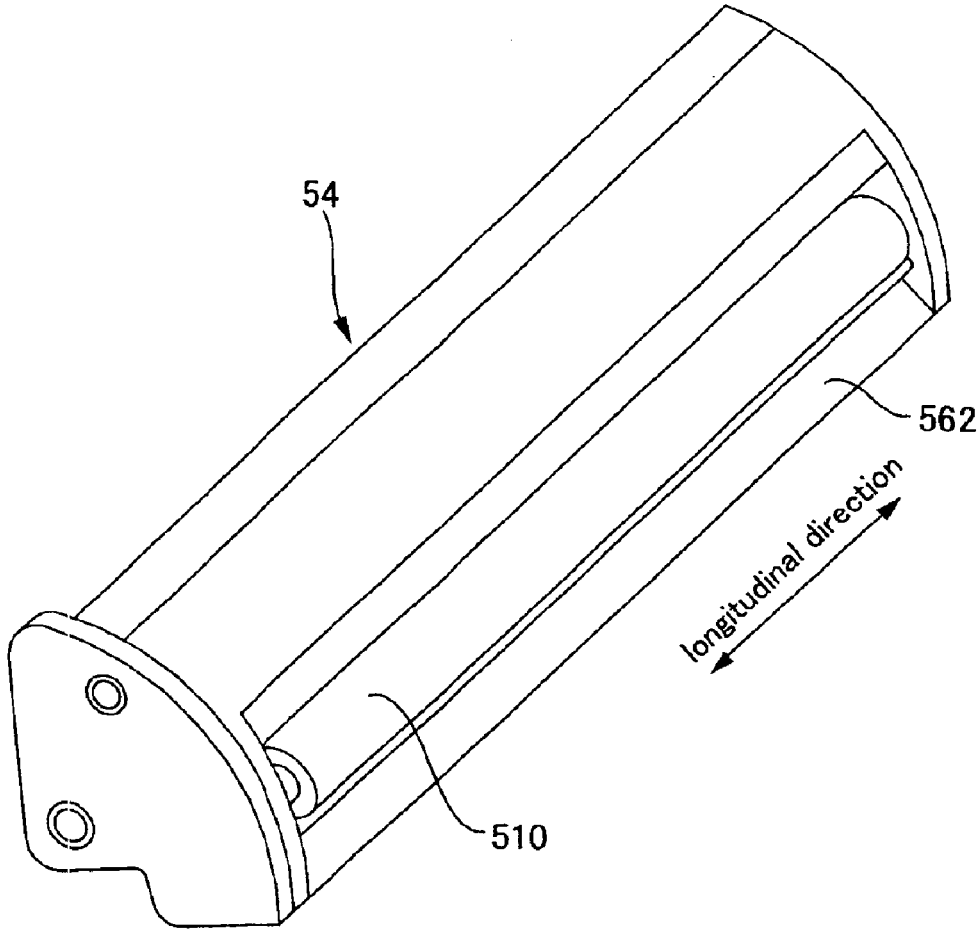
FIG. 3 is a perspective view of a developing device according to the embodiment.
Figure 4:
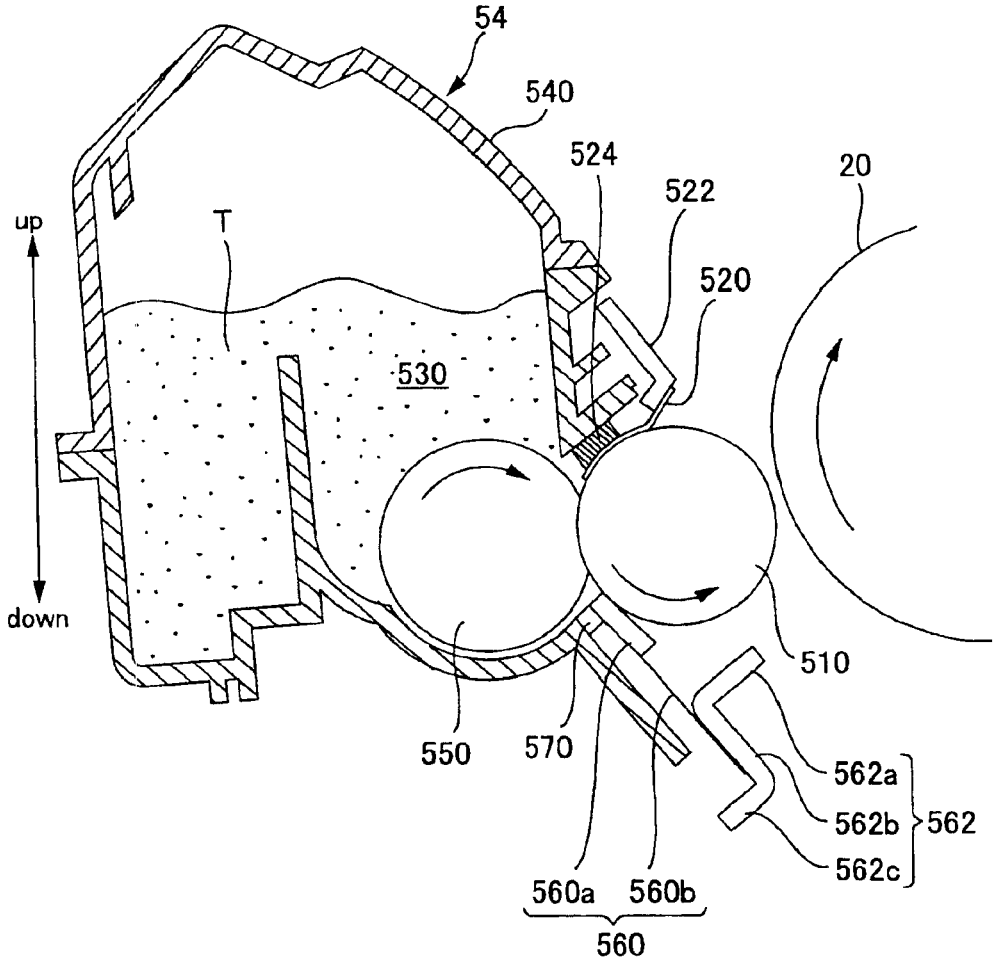
FIG. 4 is a section view showing some main structural components of the developing device according to the embodiment.

Next, with reference to FIG. 3 and FIG. 4, an example of a configuration of the developing device will be described. FIG. 3 is a perspective view of the developing device. FIG. 4 is a section view showing some main structural components of the developing device. Note that the section view of FIG. 4 shows a section of the developing device bisected by a plane perpendicular to the longitudinal direction shown in FIG. 3. Further, in FIG. 4, the arrow indicates the vertical directions as in FIG. 1; for example, the central axis of the developing roller 510 is located below the central axis of the photoconductor 20. Further, FIG. 4 shows a state in which the yellow developing device 54 is located in the developing position opposing the photoconductor 20.

The YMCK developing unit 50 comprises: the black developing device 51 containing black (K) toner; the magenta developing device 52 containing magenta (M) toner; the cyan developing device 53 containing cyan (C) toner; and the yellow developing device 54 containing yellow (Y) toner. Since the configuration of each of the developing devices is the same, explanation will be made only of the yellow developing device 54.

The yellow developing device 54 comprises, for example, the developing roller 510, a sealing members 520, a toner reservoir 530, a frame 540 (which is also referred to as a housing 540), a toner-supplying roller 550, and a restriction blade 560, which serves as an example of a "developer charging member" and also an example of a "thickness restricting member".

The developing roller 510 bears toner T and delivers it to a developing position opposing the photoconductor 20. The developing roller 510 is made from, for example, aluminum alloy such as aluminum alloy 5056 or aluminum alloy 6063, or iron alloy such as STKM, and the roller 510 is plated with, for example, nickel plating or chromium plating, as necessary. Further, the developing roller 510 is rotatable about a central axis. More specifically, the developing roller 510 has a toner bearing portion 510*a* (FIG. 33) and a rotary shaft 510*b* (FIG. 33), which serves as an example of a rotation shaft, and the developing roller 510 is rotatable about the rotary shaft 510*b*. As shown in FIG. 4, the roller 510 rotates in the opposite direction (counterclockwise in FIG. 4) to the rotating direction of the photoconductor 20 (clockwise in FIG. 4). The central axis of the roller 510 is located below the central axis of the photoconductor 20. As shown in FIG. 4, in the state where the yellow developing device 54 opposes the photoconductor 20, there exists a gap between the developing roller 510 and the photoconductor 20. That is, the yellow developing device 54 develops the latent image formed on the photoconductor 20 in a non-contacting state. Note that an alternating field is generated between the developing roller 510 and the photoconductor 20 upon developing the latent image formed on the photoconductor 20. Note that the developing roller 510 will be described in further detail later.

The sealing member 520 prevents the toner T in the yellow developing device 54 from spilling out therefrom, and also collects the toner T, which is on the developing roller 510 that has passed the developing position, into the developing device without scraping. The sealing member 520 is a seal made from, for example, polyethylene film. The sealing member 520 is supported by a seal-supporting metal plate 522, and is attached to the frame 540 through the seal-supporting metal plate 522. A seal-impelling member 524 made from, for example, Moltoprene is provided on one side of the sealing member 520 opposite from the side of the developing roller 510. The sealing member 520 is pressed against the developing roller 510 by the elastic force of the seal-impelling member 524. Note that the abutting position at which the sealing member 520 abuts against the developing roller 510 is situated above the central axis of the developing roller 510.

The toner reservoir 530 is a section for receiving (containing) the toner T. A portion of the frame 540 structures the reservoir 530. A stirring member for stirring the toner T contained in the toner reservoir 530 may be provided. However, in the present embodiment, each of the developing devices (the black developing device 51, the magenta developing device 52, the cyan developing device 53, and the yellow developing device 54) rotates with the rotation of the YMCK developing unit 50, and the toner T contained in each developing device is stirred therewith. Therefore, the toner reservoir 530 of the present embodiment does not comprise a stirring member.

The toner-supplying roller 550 supplies the toner T contained in the toner reservoir 530 to the developing roller 510. The toner-supplying roller 550 is made from, for example, polyurethane foam, and is placed in contact with the developing roller 510 in an elastically-deformed state. The toner-supplying roller 550 is arranged at a lower section of the toner reservoir 530. The toner T contained in the toner reservoir 530 is supplied to the developing roller 510 by the toner-supplying roller 550 at the lower section of the toner reservoir 530. The toner-supplying roller 550 is rotatable about a central axis. The central axis of the toner-supplying roller 550 is situated below the central axis of rotation of the developing roller 510. Further, the toner-supplying roller 550 rotates in the opposite direction (clockwise in FIG. 4) to the rotating direction of the developing roller 510 (counterclockwise in FIG. 4). Note that the toner-supplying roller 550 has functions to supply the toner T contained in the toner reservoir 530 (described later) to the developing roller 510 and to strip the toner remaining on the developing roller 510 after development off from the developing roller 510.

The restriction blade 560 gives charge to the toner T bore by the developing roller 510 and also restricts the thickness of the layer of the toner T bore by the developing roller 510. The structures of the restriction blade 560 and peripheral components will be described in detail later.

The frame 540 is manufactured by joining a plurality of integrally-molded frames (for example, an upper frame and a bottom frame). As shown in FIG. 3, the frame 540 has an opening at its lower section. The developing roller 510 is arranged at the opening in a state in which a portion of the roller 510 is exposed outside. It should be noted that the frame 540 includes, for example, the toner reservoir 530 described above and a toner charging unit fixing portion 526 described later.

In the yellow developing device 54 thus structured, the toner-supplying roller 550 supplies the toner T contained in the toner reservoir 530 to the developing roller 510. With the rotation of the developing roller 510, the toner T, which has been supplied to the developing roller 510, reaches the abutting position of the restriction blade 560; and, as the toner T passes the abutting position, the toner is charged and its thickness is restricted. With further rotation of the developing roller 510, the toner T on the developing roller 510, whose thickness has been restricted, reaches the developing position opposing the photoconductor 20; and under the alternating field, the toner T is used at the developing position for developing the latent image formed on the photoconductor 20. With further rotation of the developing roller 510, the toner T on the developing roller 510, which has passed the developing position, passes the sealing member 520 and is collected into the developing device by the sealing member 520 without being scraped off. Then, the toner still remaining on the developing roller 510 can be stripped off by the toner supplying roller 550.

Figure 5:
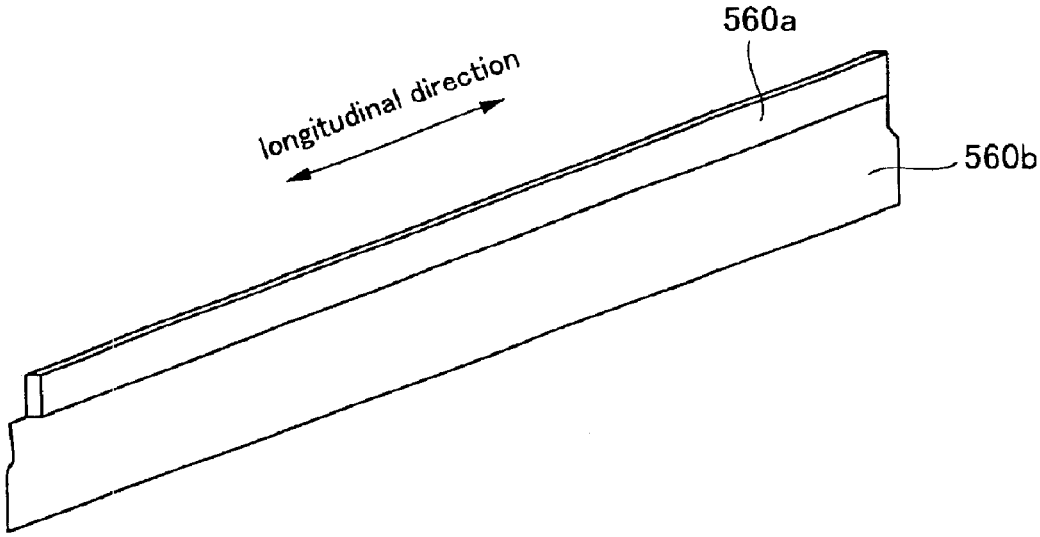
FIG. 5 is a perspective view of a restriction blade 560 according to the embodiment.
Figure 6A:
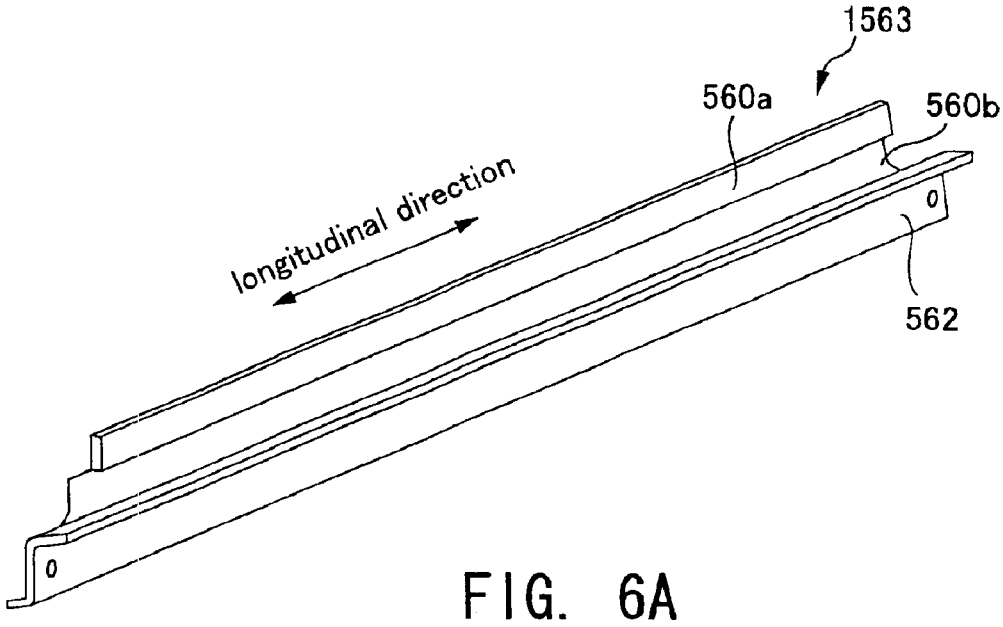
FIG. 6A and FIG. 6B are perspective views showing a state in which the restriction blade 560 is fixed to a blade-supporting metal plate 562 according to a first embodiment.
Figure 6B:
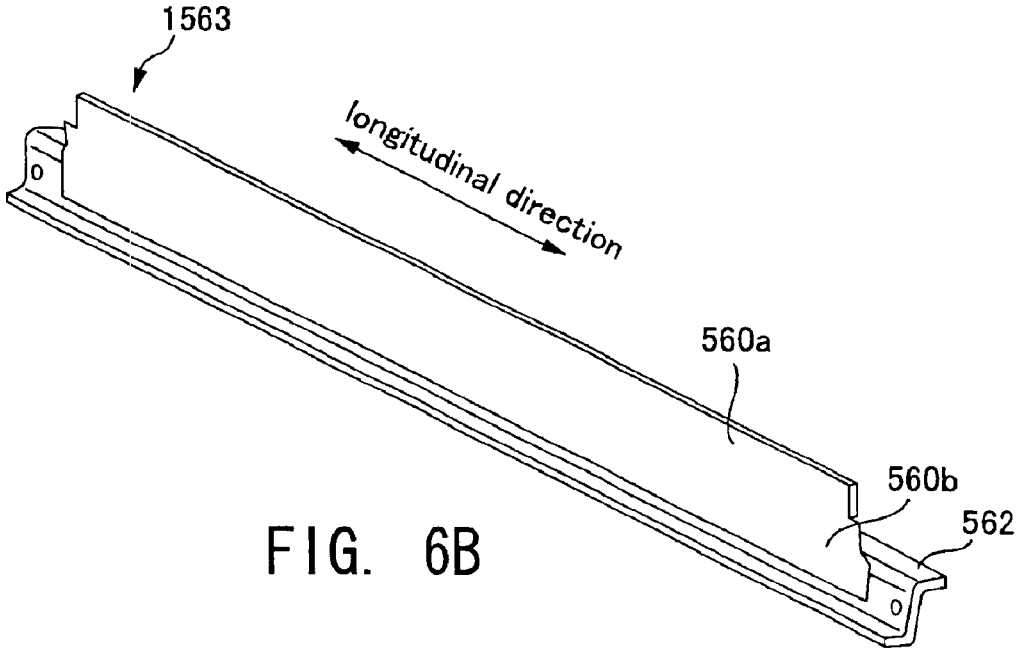
Figure 7:
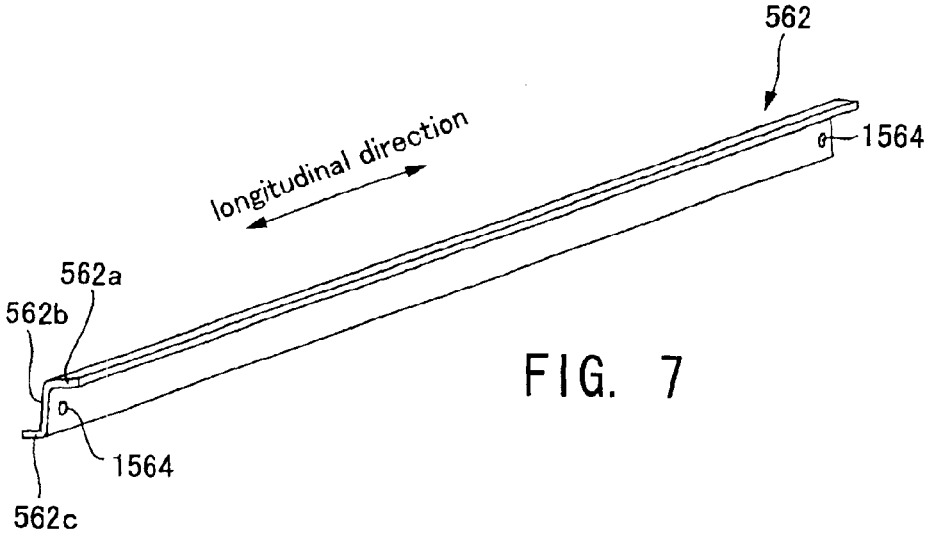
FIG. 7 is a perspective view of the blade-supporting metal plate 562 according to the first embodiment.
Figure 8:
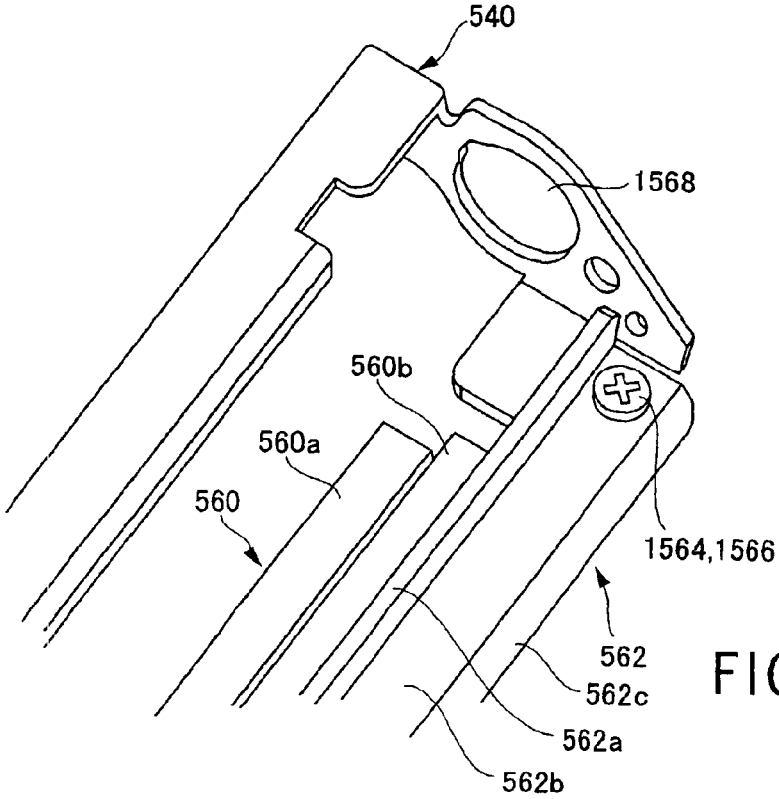
FIG. 8 is a perspective view showing the restriction blade 560 attached to a frame 540 through the blade-supporting metal plate 562 according to the first embodiment.

First Embodiment of the Structure of the Restriction Blade and Peripheral Components Next, with reference to FIG. 4 through FIG. 8, the structures of the restriction blade 560 and peripheral components thereof will be described. FIG. 5 is a perspective view of the restriction blade 560. FIG. 6A and FIG. 6B are perspective views showing a state in which the restriction blade 560 is fixed to the blade-supporting metal plate 562. FIG. 7 is a perspective view of the blade-supporting metal plate 562. FIG. 8 is a perspective view showing the restriction blade 560 attached to the frame 540 through the blade-supporting metal plate 562.

As described above, the restriction blade 560 has functions of giving charge to the toner T (which serves as developer) bore by the developing roller 510 (which serves as a developer bearing member) and restricting the thickness of the layer of the toner T bore by the developing roller 510.

As shown in FIG. 5, the restriction blade 560 comprises a rubber portion 560*a* as an elastic body and a rubber-supporting portion 560*b* as an elastic-body-supporting member. The rubber portion 560*a* is made from, for example, silicone rubber or urethane rubber. The rubber-supporting portion 560*b* is a thin plate that has a thickness of 1 mm or less, that is made from, for example, phosphor bronze or stainless steel, and that has a springy characteristic.

As shown in FIG. 5, the rubber portion 560*a* is supported by the rubber-supporting portion 560*b*. As shown in FIG. 4, the surface of the rubber portion 560*a* is placed in contact with the surface of the developing roller 510, and in this way, the rubber portion 560*a* achieves the above-mentioned functions with respect to the toner T bore by the developing roller 510.

The rubber-supporting portion 560*b* presses the rubber portion 560*a* against the developing roller 510 with its elastic force. As shown in FIG. 6A and FIG. 6B, one end of the rubber-supporting portion 560*b* is fixed to the blade-supporting metal plate 562, which serves as an example of a supporting member for supporting the developer charging member. The blade-supporting metal plate 562 is, for example, a steel plate having a zinc plating layer. Note that FIG. 6A is a diagram showing, to the front, the surface of the rubber portion 560*a* that abuts against the developing roller 510, and FIG. 6B is a diagram showing, to the front, the back surface of the surface of the rubber portion 560*a* that abuts against the developing roller 510.

As shown in FIG. 7, the blade-supporting metal plate 562 has a first bent portion 562*a*, a supporting portion 562*b*, and a second bent portion 562*c* that are formed by bending a rectangular member along its longitudinal direction. The rectangular member has a thickness of 1.8 mm or more. The first bent portion 562*a* is bent in a direction opposite to the second bent portion 562*c*, and as shown in FIG. 4, the cross-section of the blade-supporting metal plate 562 is formed in a so-called "Z" shape. Note that in the present embodiment, among the first and second bent portions 562*a* and 562*c*, the bent portion that is closer to the rubber portion 560*a* is called the first bent portion 562*a*. Further, as shown in FIG. 4, FIG. 6A, and FIG. 6B, the rubber-supporting portion 560*b* is fixed to the supporting portion 562*b*, and the supporting portion 562*b* supports the restriction blade 560.

Note that, in the present embodiment, the restriction blade 560 and the blade-supporting metal plate 562 to which the restriction blade 560 is fixed are integrated into one unit as shown in FIG. 6A and FIG. 6B, and this unit is referred to as a toner charging unit 1563, which is an example of a developer charging unit.

As shown in FIG. 7, the blade-supporting metal plate 562 has screw holes 1564 at both end sections, in the longitudinal direction, of the supporting portion 562*b* for fixing the blade-supporting metal plate 562 to the developing device. As shown in FIG. 8, the toner charging unit 1563 is fixed to the frame 540 at both end sections, in the longitudinal direction, of the supporting portion 562*b* with screws 1566. FIG. 8 shows only one end section in the longitudinal direction of the toner charging unit 1563. However, the other end is configured in the same way.

Note that, although it is not shown in FIG. 8, the developing roller 510 is supported by developing roller supporting holes 1568 provided in both end sections, in the longitudinal direction, of the frame 540. That is, in FIG. 8, the developing roller 510 is positioned above the restriction blade 560.

Further, a blade-backing member 570 made from, for example, Moltoprene is provided on the other side of the restriction blade 560 opposite from the side of the developing roller 510. The blade-backing member 570 prevents the toner T from entering between the rubber-supporting portion 560*b* and the frame 540 and stabilizes the elastic force of the rubber-supporting portion 560*b*. Further, the blade-backing member 570 impels (i.e., applies force to) the rubber portion 560*a* from the back thereof towards the developing roller 510 to press the rubber portion 560*a* against the developing roller 510. In this way, the blade-backing member 570 makes the rubber portion 560*a* abut against the developing roller 510 more evenly.

The other end of the restricting blade 560 that is not being supported by the blade-supporting metal plates 562 (i.e., the free end of the restriction blade 560) is not placed in contact with the developing roller 510; rather, a section at a predetermined distance from the free end contacts, with some breadth, the developing roller 510. In other words, the restriction blade 560 does not abut against the developing roller 510 at its tip end, but abuts against the roller 510 near its central portion. Further, the restriction blade 560 is arranged so that its tip end faces towards the upper stream of the rotating direction of the developing roller 510, and thus, makes a so-called counter-contact with respect to the roller 510. Note that the abutting position at which the restriction blade 560 abuts against the developing roller 510 is situated below the central axis of the developing roller 510 and also below the central axis of the toner-supplying roller 550.

Fixing the Restriction Blade 560 to the Blade-Supporting Metal Plate 562

Next, with reference to FIG. 9A through FIG. 9C, FIG. 10A, and FIG. 10B, the way in which the restriction blade 560 is fixed to the blade-supporting metal plate 562 will be described. FIG. 9A through FIG. 9C, FIG. 10A, and FIG. 10B are explanatory diagrams for illustrating how the restriction blade 560 is fixed to the blade-supporting metal plate 562.

As described above, the restriction blade 560 is fixed to the blade-supporting metal plate 562 by fixing the rubber-supporting portion 560*b* of the restriction blade 560 to the supporting portion 562*b* of the blade-supporting metal plate 562. This fixing is realized through spot welding by laser welding.

In laser welding, the rubber-supporting portion 560*b* and the plating layer of the blade-supporting metal plate 562 are mainly welded. The reason to this is as follows. Since the rubber-supporting portion 560*b* needs to have elasticity, it is preferable for the rubber-supporting portion 560*b* to be a thin plate made from, for example, phosphor bronze or stainless steel. On the other hand, since the blade-supporting metal plate 562 needs to have high rigidity, it is preferable for the blade-supporting metal plate 562 to be a thick steel plate. Since it is difficult to weld metal plates that differ in material and that also differ greatly in thickness, laser welding that allows accurate and precise control is adopted under such circumstances. Further, since the heat quantity necessary for welding the thick blade-supporting metal plate 562 will become large, a zinc-plated steel plate that has a zinc plating layer on its surface is used in order to avoid direct welding of the rubber-supporting portion 560*b* to the base metal.

Further, spot welding by laser welding can be performed in a short amount of time and can be automated by use of robots etc., and therefore, spot welding allows the restriction blade 560 and the blade-supporting metal plate 562 to be fixed together more efficiently and at more points than fixing them together with screws.

Figure 9A:
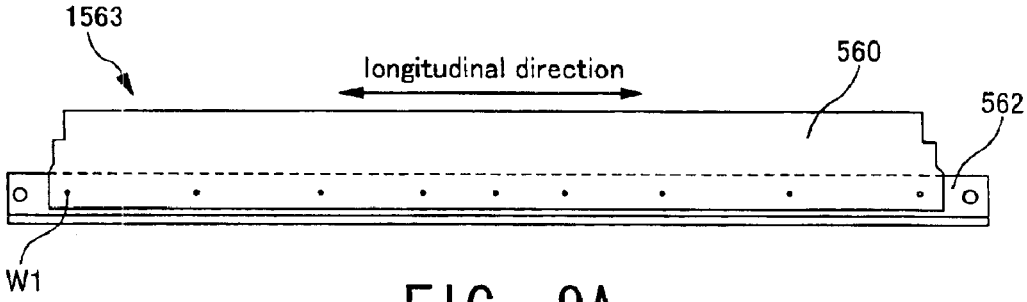
FIG. 9A through FIG. 9C are explanatory diagrams for illustrating how the restriction blade 560 is fixed to the blade-supporting metal plate 562 according to the first embodiment.

Next, with reference to FIG. 9A, the positions of the welding points W1 for spot welding will be described. FIG. 9A is a diagram of the toner charging unit 1563 shown in FIG. 6A and FIG. 6B seen right from the back of the rubber portion 560*a*. As can be seen in FIG. 9A, in the present embodiment, a plurality of welding points W1 are lined up from one end of the restriction blade 560 to the other in the longitudinal direction of the restriction blade 560, and the spacing between two welding points W1 that are arranged in the central section in the longitudinal direction of the restriction blade 560 is shorter than the spacing between two welding points W1 that are located at the end sections in the longitudinal direction of the restriction blade 560. Further, the closer the welding points W1 are located to the center in the longitudinal direction of the restriction blade 560, the shorter the spacing between two welding points W1 becomes.

By making the spacing between welding points in the central section in the longitudinal direction of the restriction blade shorter than the spacing between welding points that are located at the end sections in the longitudinal direction of the restriction blade, it becomes possible to make the toner charge even.

More specifically, as described in the "BACKGROUND OF THE INVENTION", since the restriction blade abuts against the developing roller, there is a possibility that the restriction blade will bend due to the load applied from the developing roller. Particularly, in case the developing roller and the restriction blade (or the support member for supporting the restriction blade) are supported at their end sections in the longitudinal direction, the degree of bending will become larger in the central section in the longitudinal direction of the restriction blade. If such bending occurs in the restriction blade, the pressing force of the restriction blade against the developing roller will become weak at the central section in the longitudinal direction of the restriction blade, and therefore, the pressing force will become uneven. Such an uneven pressing of the restriction blade may cause the toner charge to be uneven.

In order to address such a problem, the spacing between welding points in the central section in the longitudinal direction of the restriction blade is made to be shorter than the spacing between welding points that are located at the end sections in the longitudinal direction of the restriction blade. In this way, the pressing force of the restriction blade against the developing roller at the central section thereof in the longitudinal direction will become larger than the pressing force at the end sections in the longitudinal direction, and therefore, it becomes possible to reduce unevenness in pressing force. Accordingly, it becomes possible to make the toner charge even and prevent problems such as deterioration in image, toner spill, and toner scatter, which are caused by unevenness in toner charge.

Figure 9B:
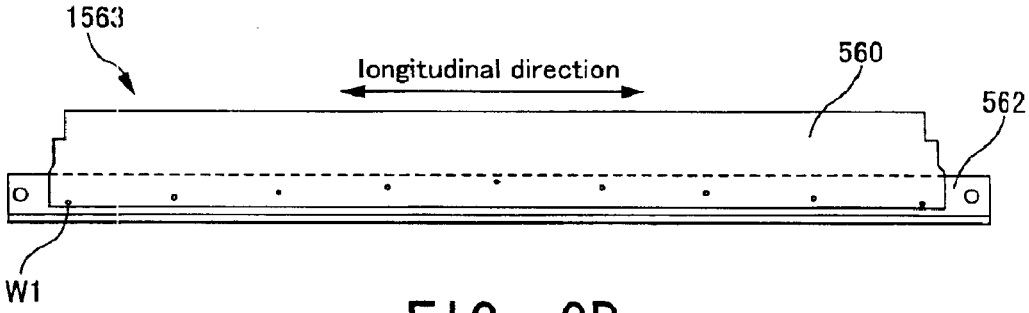

Next, with reference to FIG. 9B, another embodiment of the positions of the welding points W1 will be described. Similar to FIG. 9A, FIG. 9B is a diagram of the toner charging unit 1563 shown in FIG. 6A and FIG. 6B seen from the back of the rubber portion 560*a*. As can be seen in FIG. 9B, in the present embodiment, a plurality of welding points W1 are lined up from one end of the restriction blade 560 to the other in the longitudinal direction of the restriction blade 560, and the distance between the free end of the restriction blade 560 and a welding point W1 located in the central section in the longitudinal direction of the restriction blade 560 is shorter than the distance between the free end of the restriction blade 560 and a welding point W1 located at the end sections in the longitudinal direction of the restriction blade 560. Further, the closer the welding point W1 is located to the center in the longitudinal direction of the restriction blade 560, the shorter the distance between the free end of the restriction blade 560 and the welding point W1 becomes.

By making the distance between the free end of the restriction blade and a welding point located in the central section in the longitudinal direction of the restriction blade shorter than the distance between the free end of the restriction blade and a welding point located at the end sections in the longitudinal direction of the restriction blade, the pressing force of the restriction blade against the developing roller at the central section thereof in the longitudinal direction will become larger than the pressing force at the end sections in the longitudinal direction, and therefore, it becomes possible to reduce unevenness in pressing force. Accordingly, it becomes possible to make the toner charge even and prevent problems such as deterioration in image, toner spill, and toner scatter, which are caused by unevenness in toner charge.

Figure 9C:
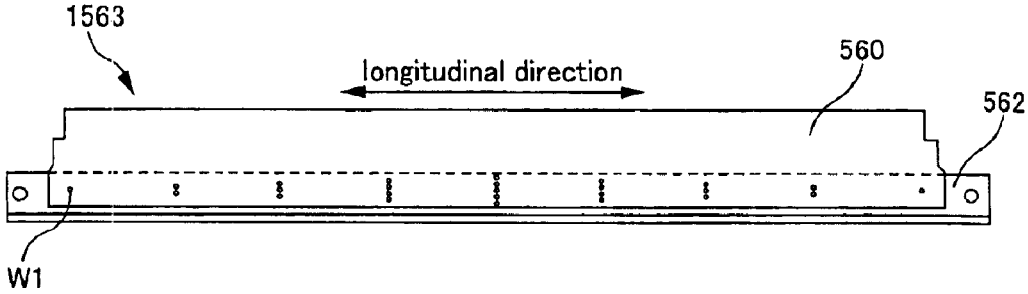
Figure 10A:
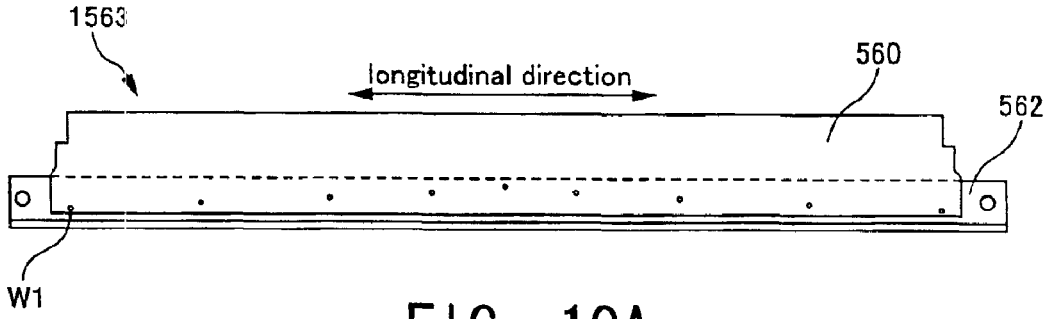
FIG. 10A, and FIG. 10B are explanatory diagrams for illustrating how the restriction blade 560 is fixed to the blade-supporting metal plate 562 according to the first embodiment.
Figure 10B:
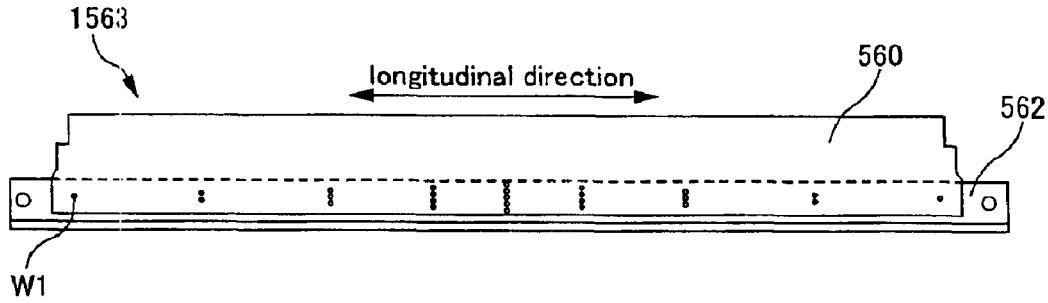

Next, with reference to FIG. 9C, another embodiment of the positions of the welding points W1 will be described. Similar to FIG. 9A, FIG. 9C is a diagram of the toner charging unit 1563 shown in FIG. 6A and FIG. 6B seen from the back of the rubber portion 560*a*. As can be seen in FIG. 9C, in the present embodiment, a plurality of welding points W1 are lined up from one end of the restriction blade 560 to the other in the longitudinal direction of the restriction blade 560, and the number of welding points W1 in the central section in the longitudinal direction of the restriction blade 560 is larger than the number of welding points W1 at the end sections in the longitudinal direction of the restriction blade 560. Further, the closer the welding points W1 are located to the center in the longitudinal direction of the restriction blade 560, the larger the number of welding points W1 becomes.

By making the number of welding points in the central section in the longitudinal direction of the restriction blade larger than the number of welding points at the end sections in the longitudinal direction of the restriction blade, the pressing force of the restriction blade against the developing roller at the central section thereof in the longitudinal direction will become larger than the pressing force at the end sections in the longitudinal direction, and therefore, it becomes possible to reduce unevenness in pressing force. Accordingly, it becomes possible to make the toner charge even and prevent problems such as deterioration in image, toner spill, and toner scatter, which are caused by unevenness in toner charge.

In the above, three different measures for reducing unevenness in pressing force and making the toner charge even were described. However, it is possible to combine two or three of the above three measures together. For example, by combining the first and second measures, the welding points W1 can be arranged according to the arrangement shown in FIG. 10A, and by combining the first and third measures, the welding points W1 can be arranged according to the arrangement shown in FIG. 10B. In this way, it becomes possible to solve the above-mentioned problems in a more effective way.

Further, in FIG. 9A through FIG. 9C, FIG. 10A, and FIG. 10B, for the sake of facilitating understanding of the embodiments, only nine welding points W1 (nine sets of welding points W1 in FIG. 9C and FIG. 10B) were shown. However, the number and arrangement of the welding points do not have to be limited to those shown, and the number can either be larger or smaller.

Figure 11A:
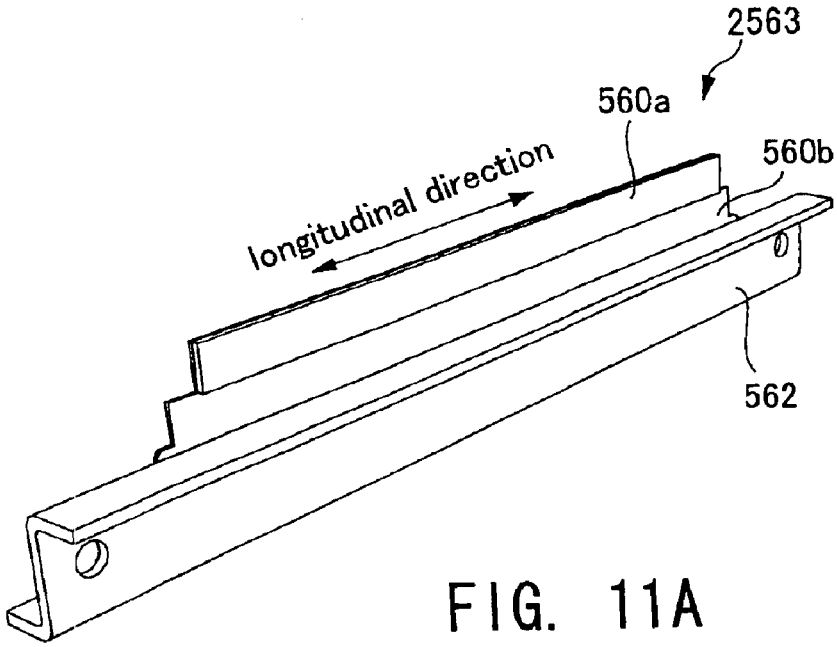
FIG. 11A and FIG. 11B are perspective views of a toner charging unit 2563 according to a second embodiment.
Figure 11B:
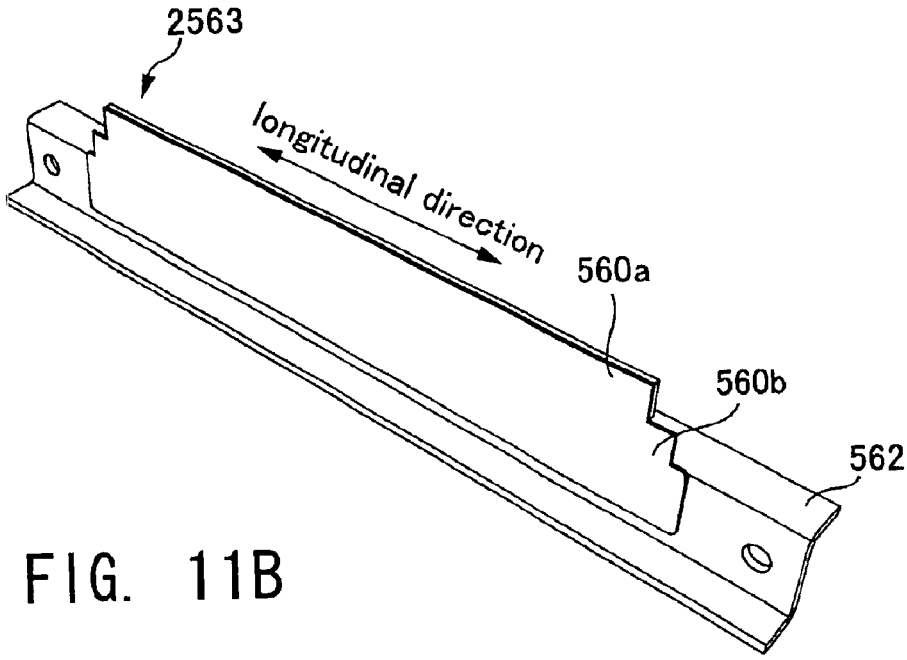
Figure 12:
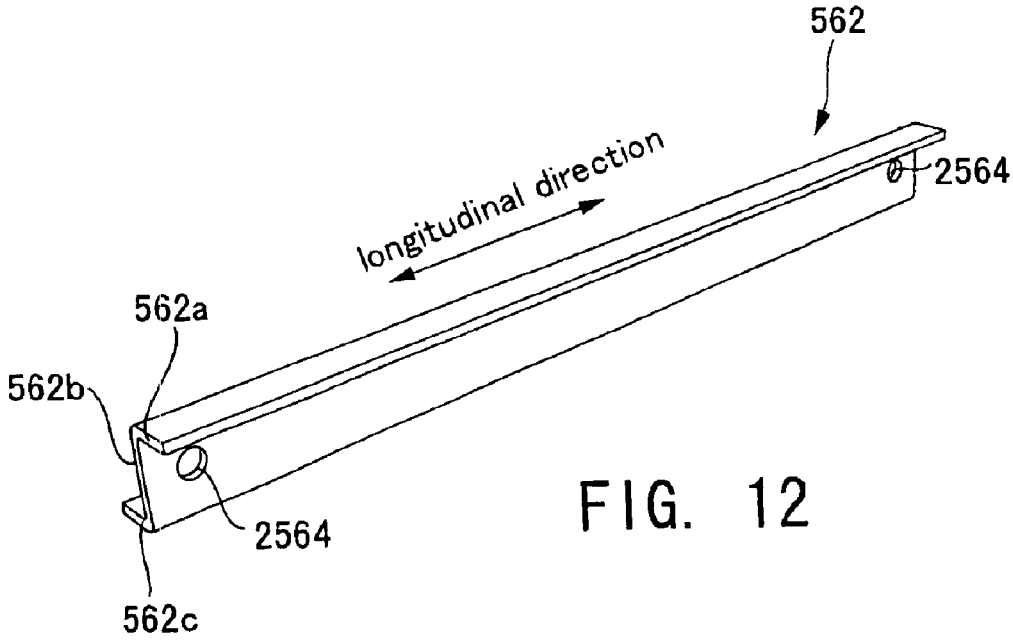
FIG. 12 is a perspective view of the blade-supporting metal plate 562 according to the second embodiment.
Figure 13:
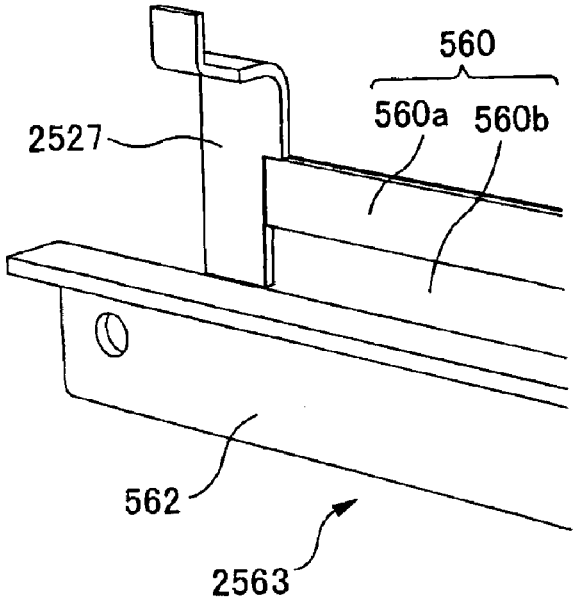
FIG. 13 is a perspective view showing the toner charging unit 2563 in which end seals 2527 are fixed to a rubber-supporting portion 560*b* according to the second embodiment.
Figure 14:
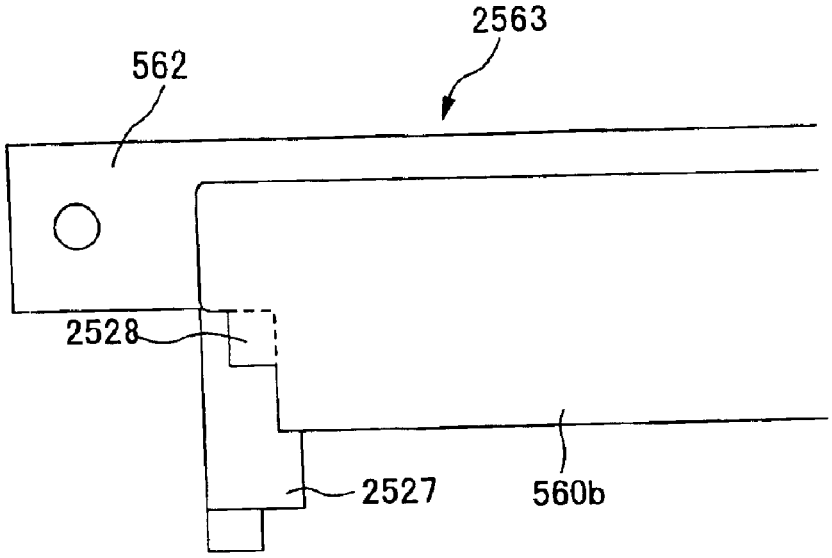
FIG. 14 is a diagram of the toner charging unit 2563 in which the end seals 2527 are fixed to the rubber-supporting portion 560*b*, seen from the back side of a rubber portion 560*a* according to the second embodiment.
Figure 15:
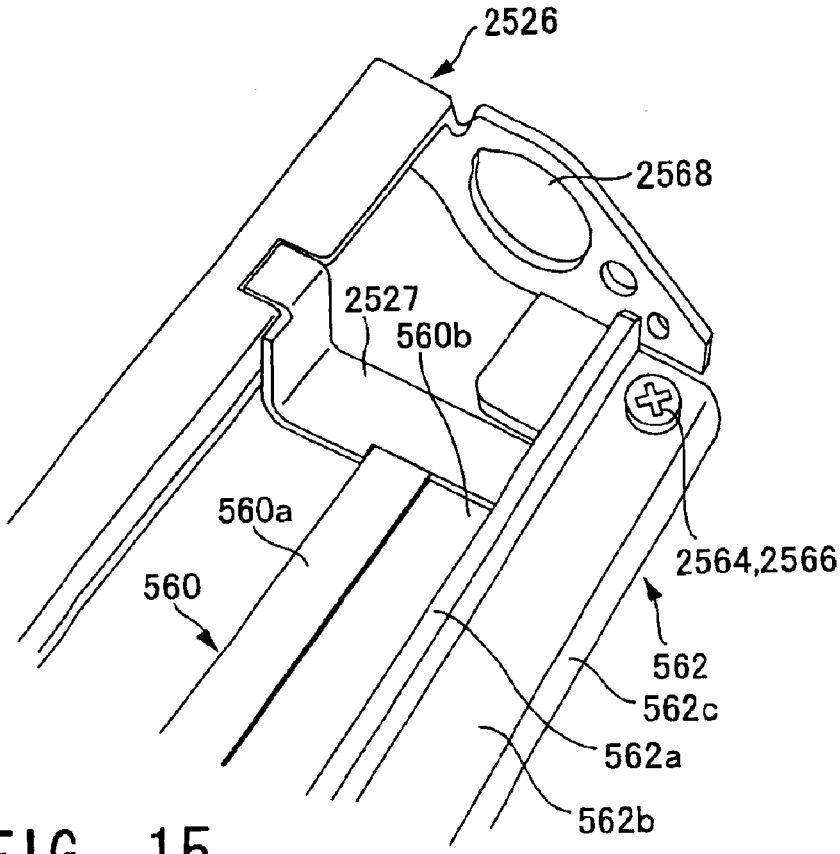
FIG. 15 is a perspective view showing the restriction blade 560 attached to the frame 540 through the blade-supporting metal plate 562 according to the second embodiment.

Second Embodiment of the Structure of the Restriction Blade and Peripheral Components Next, with reference to FIG. 4, FIG. 5, FIG. 11A, FIG. 11B, and FIG. 12 through FIG. 15, the structures of the restriction blade 560 and peripheral components thereof will be described. FIG. 11A and FIG. 11B are perspective views of a toner charging unit 2563. FIG. 12 is a perspective view of the blade-supporting metal plate 562. FIG. 13 is a perspective view showing the toner charging unit 2563 in which end seals 2527 are fixed to the rubber-supporting portion 560*b*. FIG. 14 is a diagram of the toner charging unit 2563 in which the end seals 2527 are fixed to the rubber-supporting portion 560*b*, seen from the back side of the rubber portion 560*a*. FIG. 15 is a perspective view showing the restriction blade 560 attached to the frame 540 through the blade-supporting metal plate 562.

As described above, the restriction blade 560 has functions of giving charge to the toner T (which serves as developer) bore by the developing roller 510 (which serves as a developer bearing member) and restricting the thickness of the layer of the toner T bore by the developing roller 510.

As shown in FIG. 5, the restriction blade 560 comprises a rubber portion 560*a* as an elastic body and a rubber-supporting portion 560*b* as an elastic-body-supporting member. In the present embodiment, the rubber portion 560*a* is made from, for example, silicone rubber or urethane rubber having a thickness of about 2 mm. The rubber-supporting portion 560*b* is a thin plate that has a thickness of 1 mm or less, that is made from, for example, phosphor bronze or stainless steel, and that has a springy characteristic.

As shown in FIG. 5, the rubber portion 560*a* is supported by the rubber-supporting portion 560*b*. As shown in FIG. 4, the surface of the rubber portion 560*a* is placed in contact with the surface of the developing roller 510, and in this way, the rubber portion 560*a* achieves the above-mentioned functions with respect to the toner T bore by the developing roller 510.

The rubber-supporting portion 560*b* presses the rubber portion 560*a* against the developing roller 510 with its elastic force. As shown in FIG. 11A and FIG. 11B, one end of the rubber-supporting portion 560*b* is fixed to the blade-supporting metal plate 562, which serves as an example of a supporting member for supporting the developer charging member. The blade-supporting metal plate 562 is, for example, a steel plate having a zinc plating layer. Note that FIG. 11A is a diagram showing, to the front, the surface of the rubber portion 560*a* that abuts against the developing roller 510, and FIG. 11B is a diagram showing, to the front, the back surface of the surface of the rubber portion 560*a* that abuts against the developing roller 510.

As shown in FIG. 12, the blade-supporting metal plate 562 has a first bent portion 562*a*, a supporting portion 562*b*, and a second bent portion 562*c* that are formed by bending a rectangular member along its longitudinal direction. The rectangular member has a thickness of 1.8 mm or more. The first bent portion 562*a* is bent in a direction opposite to the second bent portion 562*c*, and as shown in FIG. 4, the cross-section of the blade-supporting metal plate 562 is formed in a so-called "Z" shape. Note that in the present embodiment, among the first and second bent portions 562*a* and 562*c*, the bent portion that is closer to the rubber portion 560*a* is called the first bent portion 562*a*. Further, as shown in FIG. 4, FIG. 11A, and FIG. 11B, the rubber-supporting portion 560*b* is fixed to the supporting portion 562*b*, and the supporting portion 562*b* supports the restriction blade 560.

Note that, in the present embodiment, the restriction blade 560 and the blade-supporting metal plate 562 to which the restriction blade 560 is fixed are integrated into one unit as shown in FIG. 11A and FIG. 11B, and this unit is referred to as a toner charging unit 2563, which is an example of a developer charging unit.

Further, as shown in FIG. 13, an end seal 2527, which is an example of a sealing member, is provided at each end section in the longitudinal direction of the restriction blade 560. The end seal 2527 is made of nonwoven cloth and has a function of preventing the toner T from spilling out from between the frame 540 and the circumferential surface of the developing roller 510. The thickness of the end seal 2527 is made thicker than the thickness of the rubber portion 560*a* of the restriction blade 560 described above, and is about 2.6 mm.

Further, as shown in FIG. 14, the end seal 2527 is fixed to the rubber-supporting portion 560*b* of the restriction blade 560. Note that, in the present embodiment, the end seal 2527 and the rubber-supporting portion 560*b* are attached to each other with a double-faced adhesive tape at a rectangular attaching section 2528. That is, the rubber portion 560*a* and the end seal 2527 are fixed to the rubber-supporting portion 560*b* next to each other.

Note that, although FIG. 13 and FIG. 14 show only one end section in the longitudinal direction of the restriction blade etc., the other end is configured in the same way.

As shown in FIG. 15, the blade-supporting metal plate 562 has screw holes 2564 at both end sections, in the longitudinal direction, of the supporting portion 562*b* for fixing the blade-supporting metal plate 562 to the developing device. As shown in FIG. 15, the toner charging unit 2563 is fixed to a toner charging unit fixing portion 2526, which is provided on the frame 540, at both end sections in the longitudinal direction of the supporting portion 562*b* with screws 2566. FIG. 15 shows only one end section in the longitudinal direction of the toner charging unit 2563. However, the other end is configured in the same way.

Note that, although it is not shown in FIG. 15, the developing roller 510 is supported by developing roller supporting holes 2568 provided in both end sections, in the longitudinal direction, of the toner charging unit fixing portion 2526. That is, in FIG. 15, the developing roller 510 is positioned above the restriction blade 560. In this state, the rubber portion 560*a* and the end seal 2527 abut against a toner bearing region and a toner non-bearing region on the surface of the developing roller 510, respectively, and achieve their functions described above.

It should be noted that the toner charging unit fixing portion 2526 is a structural part that is provided on the frame 540 in an attachable/detachable manner. The frame 540 is structured so that the end seal 2527 can be arranged along a portion of the frame 540 formed in a manner as to oppose the outer circumferential surface of the developing roller 510 when the toner charging unit fixing portion 2526 is attached to the frame 540.

Further, a blade-backing member 570 made from, for example, Moltoprene is provided on the other side of the restriction blade 560 opposite from the side of the developing roller 510. The blade-backing member 570 prevents the toner T from entering between the rubber-supporting portion 560*b* and the frame 540 and stabilizes the elastic force of the rubber-supporting portion 560*b*. Further, the blade-backing member 570 impels (i.e., applies force to) the rubber portion 560*a* from the back thereof towards the developing roller 510 to press the rubber portion 560*a* against the developing roller 510. In this way, the blade-backing member 570 makes the rubber portion 560*a* abut against the developing roller 510 more evenly.

The other end of the restricting blade 560 that is not being supported by the blade-supporting metal plates 562 (i.e., the free end of the restriction blade 560) is not placed in contact with the developing roller 510; rather, a section at a predetermined distance from the free end contacts, with some breadth, the developing roller 510. In other words, the restriction blade 560 does not abut against the developing roller 510 at its tip end, but abuts against the roller 510 near its central portion. Further, the restriction blade 560 is arranged so that its tip end faces towards the upper stream of the rotating direction of the developing roller 510, and thus, makes a so-called counter-contact with respect to the roller 510. Note that the abutting position at which the restriction blade 560 abuts against the developing roller 510 is situated below the central axis of the developing roller 510 and also below the central axis of the toner-supplying roller 550.

Fixing the Restriction Blade 560 to the Blade-Supporting Metal Plate 562

Figure 16:
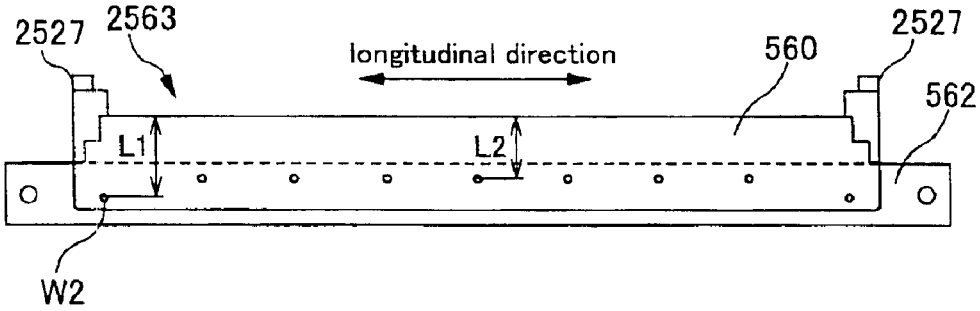
FIG. 16 is explanatory diagrams for illustrating how the restriction blade 560 is fixed to the blade-supporting metal plate 562 according to the second embodiment.
Figure 17:
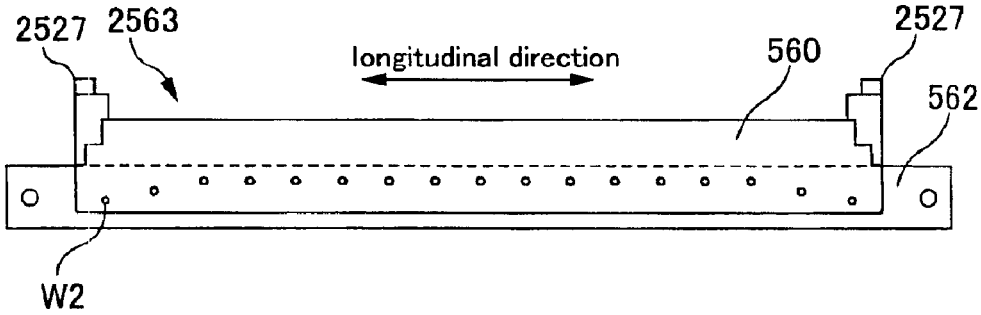
FIG. 17 is explanatory diagrams for illustrating how the restriction blade 560 is fixed to the blade-supporting metal plate 562 according to the second embodiment.

Next, with reference to FIG. 16 and FIG. 17, the way in which the restriction blade 560 is fixed to the blade-supporting metal plate 562 will be described. FIG. 16 and FIG. 17 are explanatory diagrams for illustrating how the restriction blade 560 is fixed to the blade-supporting metal plate 562.

As described above, the restriction blade 560 is fixed to the blade-supporting metal plate 562 by fixing the rubber-supporting portion 560*b* of the restriction blade 560 to the supporting portion 562*b* of the blade-supporting metal plate 562. This fixing is realized through spot welding by laser welding.

In laser welding, the rubber-supporting portion 560*b* and the plating layer of the blade-supporting metal plate 562 are mainly welded. The reason to this is as follows. Since the rubber-supporting portion 560*b* needs to have elasticity, it is preferable for the rubber-supporting portion 560*b* to be a thin plate made from, for example, phosphor bronze or stainless steel. On the other hand, since the blade-supporting metal plate 562 needs to have high rigidity, it is preferable for the blade-supporting metal plate 562 to be a thick steel plate. Since it is difficult to weld metal plates that differ in material and that also differ greatly in thickness, laser welding that allows accurate and precise control is adopted under such circumstances. Further, since the heat quantity necessary for welding the thick blade-supporting metal plate 562 will become large, a zinc-plated steel plate that has a zinc plating layer on its surface is used in order to avoid direct welding of the rubber-supporting portion 560*b* to the base metal.

Further, spot welding by laser welding can be performed in a short amount of time and can be automated by use of robots etc., and therefore, spot welding allows the restriction blade 560 and the blade-supporting metal plate 562 to be fixed together more efficiently and at more points than fixing them together with screws.

Next, with reference to FIG. 16, the positions of the welding points W2 for spot welding will be described. FIG. 16 is a diagram of the toner charging unit 2563 shown in FIG. 11A and FIG. 11B seen right from the back of the rubber portion 560*a*. As can be seen in FIG. 16, in the present embodiment, a plurality of welding points W2 are lined up from one end of the restriction blade 560 to the other in the longitudinal direction of the restriction blade 560, and the distance between the free end of the restriction blade 560 and a welding point W2 located at the end sections in the longitudinal direction of the restriction blade 560 is longer than the distance between the free end of the restriction blade 560 and a welding point W2 located in the central section in the longitudinal direction of the restriction blade 560. For example, the distance indicated by L1 in FIG. 16 is longer than the distance indicated by L2.

Further, the spacing between two of the welding points W2 located at the end section in the longitudinal direction of the restriction blade 560 is wider than the spacing between two of the welding points W2 located in the central section in the longitudinal direction of said restriction blade 560. For example, in FIG. 16, the distance between the welding point W2 located furthest to the left and the second welding point W2 from the left is longer than the distance between the fourth welding point W2 from the left and the welding point W2 located in the center.

By making the distance between the free end of the restriction blade and a welding point located at the end sections in the longitudinal direction of the restriction blade longer than the distance between the free end of the restriction blade and a welding point located in the central section in the longitudinal direction of the restriction blade, it becomes possible to make the toner charge even.

More specifically, as described in the "BACKGROUND OF THE INVENTION", although the restriction blade and the end seals abut against the surface of the developing roller in order to achieve their functions described above, the characteristics of the end seals (for example, thickness, the properties of the material, etc.) is different from those of the restriction blade. Therefore, the end seals may have an influence on the pressing force of the restriction blade against the developing roller, and in some cases, the pressing force of the restriction blade against the developing roller becomes stronger at the end sections in the longitudinal direction of the restriction blade.

Such an uneven pressing of the restriction blade may cause the toner charge to be uneven, and such unevenness in toner charge may cause problems such as deterioration in image, toner spill, and toner scatter.

In order to address such a problem, the distance between the free end of the restriction blade and a welding point located at the end sections in the longitudinal direction of the restriction blade is made to be longer than the distance between the free end of the restriction blade and a welding point located in the central section in the longitudinal direction of the restriction blade. In this way, the intensity of the pressing force of the restriction blade against the developing roller at the end sections thereof in the longitudinal direction will be reduced compared to the intensity of the pressing force at the central section in the longitudinal direction, and therefore, it becomes possible to reduce unevenness in pressing force. Accordingly, it becomes possible to make the toner charge even and prevent problems such as deterioration in image, toner spill, and toner scatter, which are caused by unevenness in toner charge.

It should be noted that in FIG. 16, for the sake of facilitating understanding of the embodiments, only nine welding points W2 were shown. However, the number and arrangement of the welding points do not have to be limited to those shown, and the number can either be larger or smaller.

Further, in FIG. 16, only the distance between the free end of the restriction blade and a welding point located closest to the end sections in the longitudinal direction was illustrated to be longer than the distance between the free end of the restriction blade and the other welding points. However, as shown in FIG. 17, the arrangement does not have to be limited to that shown in FIG. 16 as far as the distance between the free end of the restriction blade and a welding point located at the end sections in the longitudinal direction of the restriction blade is longer than the distance between the free end of the restriction blade and a welding point located in the central section in the longitudinal direction of the restriction blade.

Figure 18A:
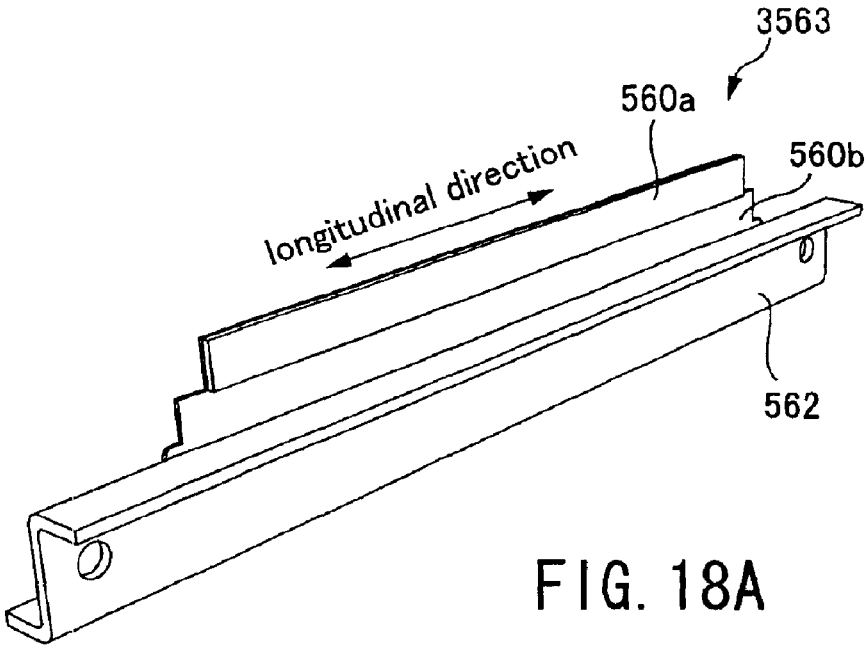
FIG. 18A and FIG. 18B are perspective views of a toner charging unit 3563 according to a third embodiment.
Figure 18B:
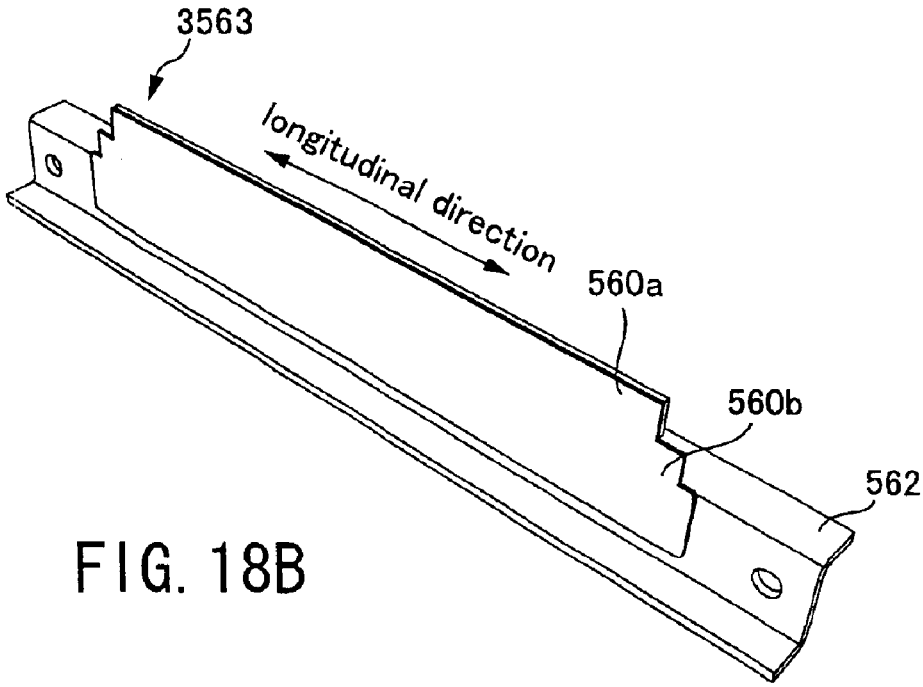
Figure 19:
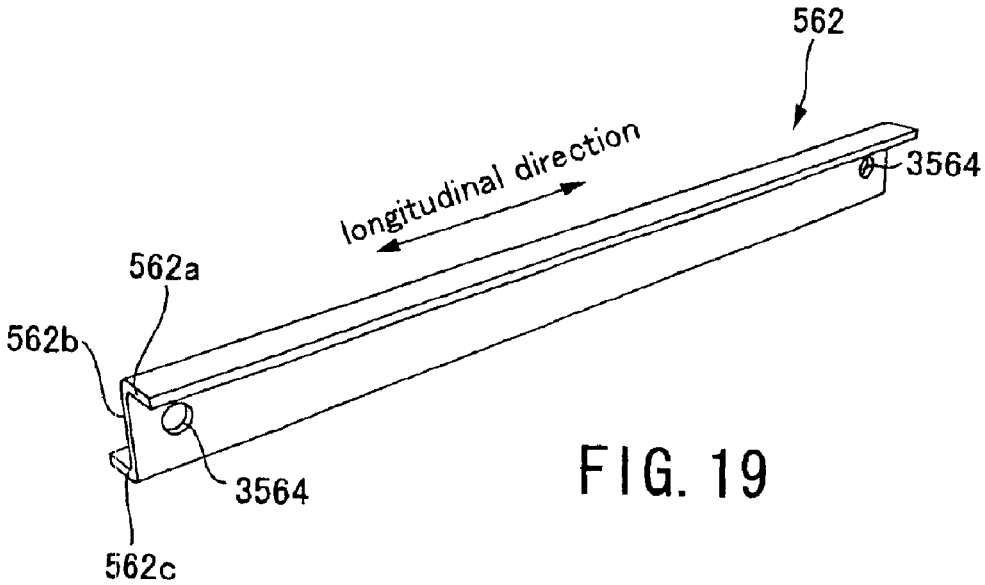
FIG. 19 is a perspective view of the blade-supporting metal plate 562 according to the third embodiment.
Figure 20:
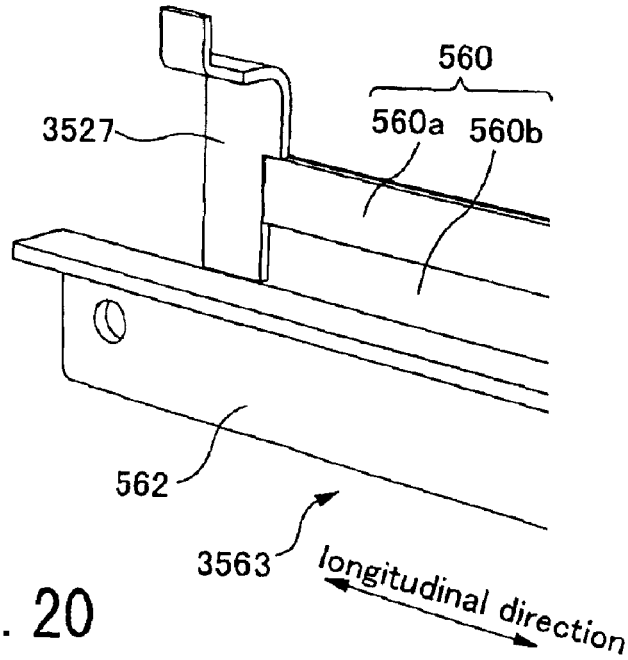
FIG. 20 is a perspective view showing the toner charging unit 3563 in which end seals 3527 are fixed to the rubber-supporting portion 560*b* according to the third embodiment.
Figure 21:
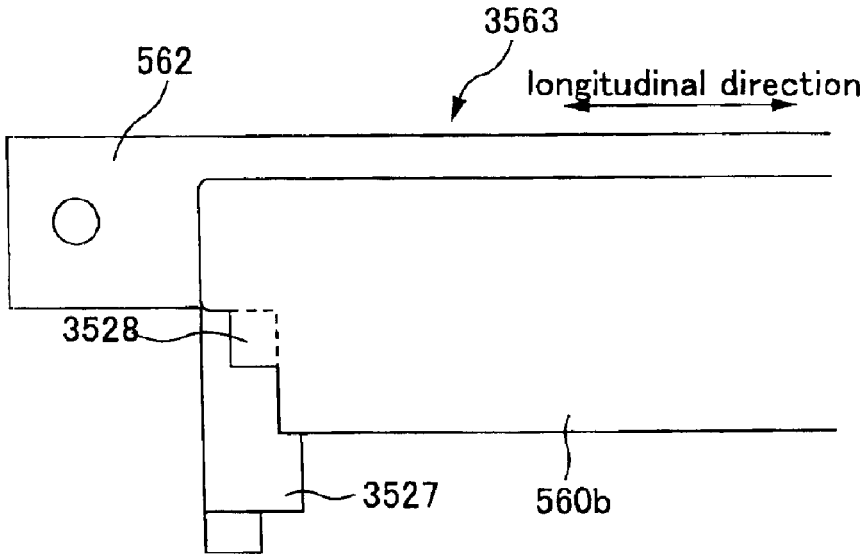
FIG. 21 is a diagram of the toner charging unit 3563 in which the end seals 3527 are fixed to the rubber-supporting portion 560*b*, seen from the back side of the rubber portion 560*a* according to the third embodiment.
Figure 22:
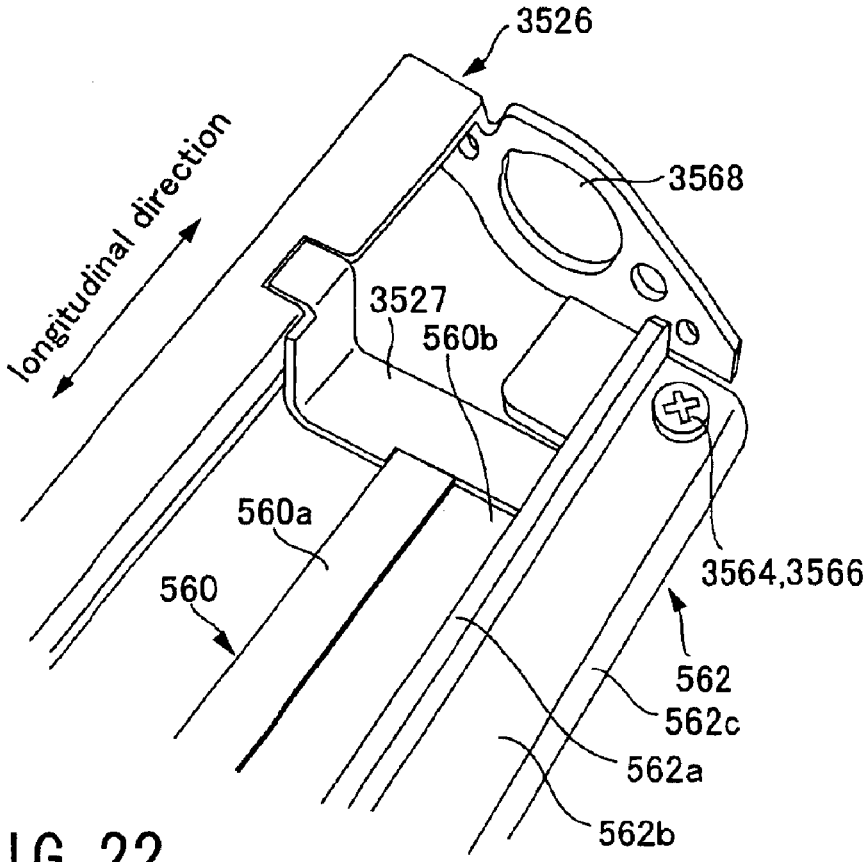
FIG. 22 is a perspective view showing a toner charging unit fixing portion 3526 to which the toner charging unit 3563 is fixed according to the third embodiment.

Third Embodiment of the Structure of the Restriction Blade and Peripheral Components Next, with reference to FIG. 4, FIG. 5, FIG. 18A, FIG. 18B, and FIG. 19 through FIG. 26, the structures of the restriction blade 560 and peripheral components thereof will be described. FIG. 18A and FIG. 18B are perspective views of a toner charging unit 3563. FIG. 19 is a perspective view of the blade-supporting metal plate 562. FIG. 20 is a perspective view showing the toner charging unit 3563 in which end seals 3527 are fixed to the rubber-supporting portion 560*b*. FIG. 21 is a diagram of the toner charging unit 3563 in which the end seals 3527 are fixed to the rubber-supporting portion 560*b*, seen from the back side of the rubber portion 560*a*. FIG. 22 is a perspective view showing a toner charging unit fixing portion 3526 to which the toner charging unit 3563 is fixed. FIG. 23 through FIG. 26 will be described later.

As described above, the restriction blade 560 has functions of giving charge to the toner T (which serves as developer) bore by the developing roller 510 (which serves as a developer bearing member) and restricting the thickness of the layer of the toner T bore by the developing roller 510.

As shown in FIG. 5, the restriction blade 560 comprises a rubber portion 560*a* as an abutting member and a rubber-supporting portion 560*b* as an impelling member. In the present embodiment, the rubber portion 560*a* is made from, for example, silicone rubber or urethane rubber having a thickness of about 2 mm. The rubber-supporting portion 560*b* is a thin plate that has a thickness of 1 mm or less, that is made from, for example, phosphor bronze or stainless steel, and that has a springy characteristic.

As shown in FIG. 5, the rubber portion 560*a* is supported by the rubber-supporting portion 560*b*. As shown in FIG. 4, the surface of the rubber portion 560*a* is placed in contact with the surface of the developing roller 510, and in this way, the rubber portion 560*a* achieves the above-mentioned functions with respect to the toner T bore by the developing roller 510.

The rubber-supporting portion 560*b* presses the rubber portion 560*a* against the developing roller 510 with its impelling force. As shown in FIG. 18A and FIG. 18B, one end of the rubber-supporting portion 560*b* is fixed to the blade-supporting metal plate 562. The blade-supporting metal plate 562 is, for example, a steel plate having a zinc plating layer. Note that such fixing is achieved through spot welding by laser welding. Further, FIG. 18A is a diagram showing, to the front, the surface of the rubber portion 560*a* that abuts against the developing roller 510, and FIG. 18B is a diagram showing, to the front, the back surface of the surface of the rubber portion 560*a* that abuts against the developing roller 510.

As shown in FIG. 19, the blade-supporting metal plate 562 has a first bent portion 562*a*, a supporting portion 562*b*, and a second bent portion 562*c* that are formed by bending a rectangular member along its longitudinal direction. The rectangular member has a thickness of 1.8 mm or more. The first bent portion 562*a* is bent in a direction opposite to the second bent portion 562*c*, and as shown in FIG. 4, the cross-section of the blade-supporting metal plate 562 is formed in a so-called "Z" shape. Note that in the present embodiment, among the first and second bent portions 562*a* and 562*c*, the bent portion that is closer to the rubber portion 560*a* is called the first bent portion 562*a*. Further, as shown in FIG. 4, FIG. 18A, and FIG. 18B, the rubber-supporting portion 560*b* is fixed to the supporting portion 562*b*, and the supporting portion 562*b* supports the restriction blade 560.

Note that, in the present embodiment, the restriction blade 560 and the blade-supporting metal plate 562 to which the restriction blade 560 is fixed are integrated into one unit as shown in FIG. 18A and FIG. 18B, and this unit is referred to as a toner charging unit 3563.

Further, as shown in FIG. 20, an end seal 3527, which is an example of a sealing member, is provided at each end section in the longitudinal direction of the restriction blade 560. The end seal 3527 is made of nonwoven cloth and has a function of preventing the toner T from spilling out from between the housing 540 and the circumferential surface of the developing roller 510 at the end sections in the axial direction thereof. The thickness of the end seal 3527 is made thicker than the thickness of the rubber portion 560*a* of the restriction blade 560 described above, and is about 2.6 mm.

Further, as shown in FIG. 21, the end seal 3527 is fixed to the rubber-supporting portion 560*b* of the restriction blade 560. Note that, in the present embodiment, the end seal 3527 and the rubber-supporting portion 560*b* are attached to each other with a double-faced adhesive tape at a rectangular attaching section 3528. That is, the rubber portion 560*a* and the end seal 3527 are fixed to the rubber-supporting portion 560*b* next to each other.

Note that, although FIG. 20 and FIG. 21 show only one end section in the longitudinal direction of the restriction blade etc., the other end is configured in the same way.

As shown in FIG. 22, the blade-supporting metal plate 562 has screw holes 3564 at both end sections, in the longitudinal direction, of the supporting portion 562*b* for fixing the blade-supporting metal plate 562 to the developing device. As shown in FIG. 22, the toner charging unit 3563 is fixed to a toner charging unit fixing portion 3526, which is provided on the housing 540, at both end sections in the longitudinal direction of the supporting portion 562*b* with screws 3566. FIG. 22 shows only one end section in the longitudinal direction of the toner charging unit 3563. However, the other end is configured in the same way.

Figure 23:
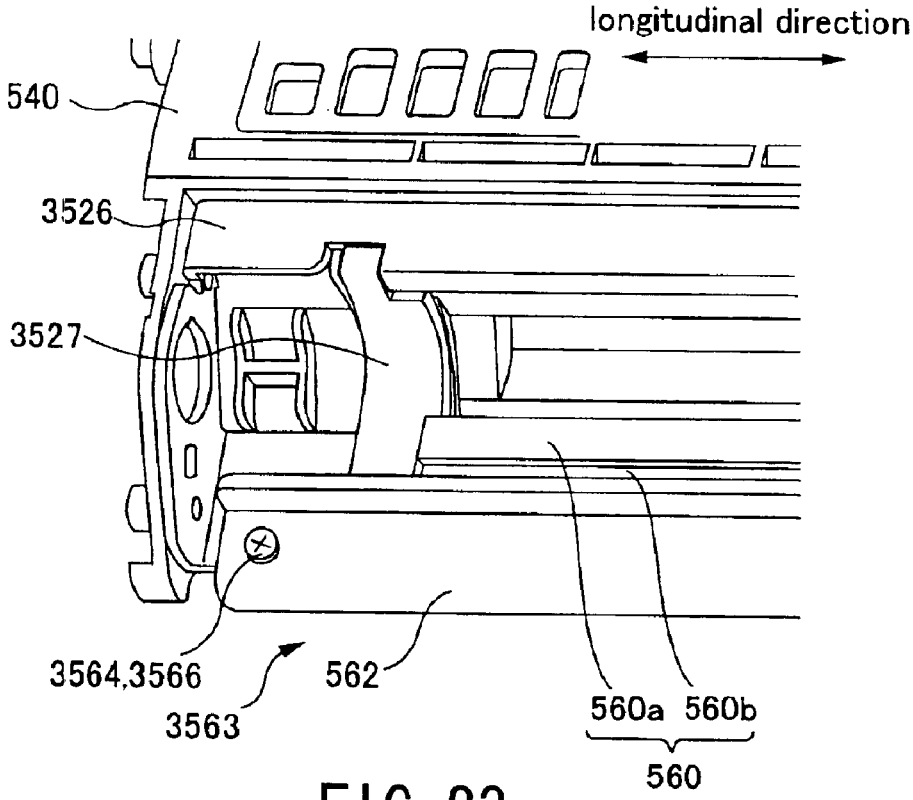
FIG. 23 is a diagram showing the housing 540 when the toner charging unit fixing portion 3526 is attached to the housing body according to the third embodiment.

On the other hand, the housing 540 comprises the toner charging unit fixing portion 3526 described above, and the housing 540 is structured so that the toner charging unit fixing portion 3526 is attachable/detachable. FIG. 23 is a diagram showing the housing 540 when the toner charging unit fixing portion 3526 is attached to the housing body. As can be seen in FIG. 23, the housing 540 is structured so that the end seal 3527 can be arranged along a portion of the housing 540 formed in a manner as to oppose the outer circumferential surface of the developing roller 510 when the toner charging unit fixing portion 3526 is attached to the housing body.

Although it is not shown in FIG. 23, the developing roller 510 is supported by shaft bearing members (not shown) provided outward, in the longitudinal direction, of the developing roller through holes 3568 in a state in which the shaft of the roller 510 is passed through developing roller through holes 3568 (FIG. 10) provided in both end sections, in the longitudinal direction, of the toner charging unit fixing portion 3526 and through developing roller through holes 3569 (FIG. 12) provided in both end sections, in the longitudinal direction, of the housing 540. That is, in FIG. 23, the developing roller 510 is positioned above the toner charging unit 3563. In this state, the rubber portion 560*a* and the end seal 3527 abut against a toner bearing region and a toner non-bearing region on the surface of the developing roller 510, respectively, and achieve their functions described above.

It should be noted that the other end of the restricting blade 560 that is not being supported by the blade-supporting metal plates 562 (i.e., the free end of the restriction blade 560) is not placed in contact with the developing roller 510; rather, a section at a predetermined distance from the free end contacts, with some breadth, the developing roller 510. In other words, the restriction blade 560 does not abut against the developing roller 510 at its tip end, but abuts against the roller 510 near its central portion. Further, the restriction blade 560 is arranged so that its tip end faces towards the upper stream of the rotating direction of the developing roller 510, and thus, makes a so-called counter-contact with respect to the roller 510. Note that the abutting position at which the restriction blade 560 abuts against the developing roller 510 is situated below the central axis of the developing roller 510 and also below the central axis of the toner-supplying roller 550.

Figure 24:
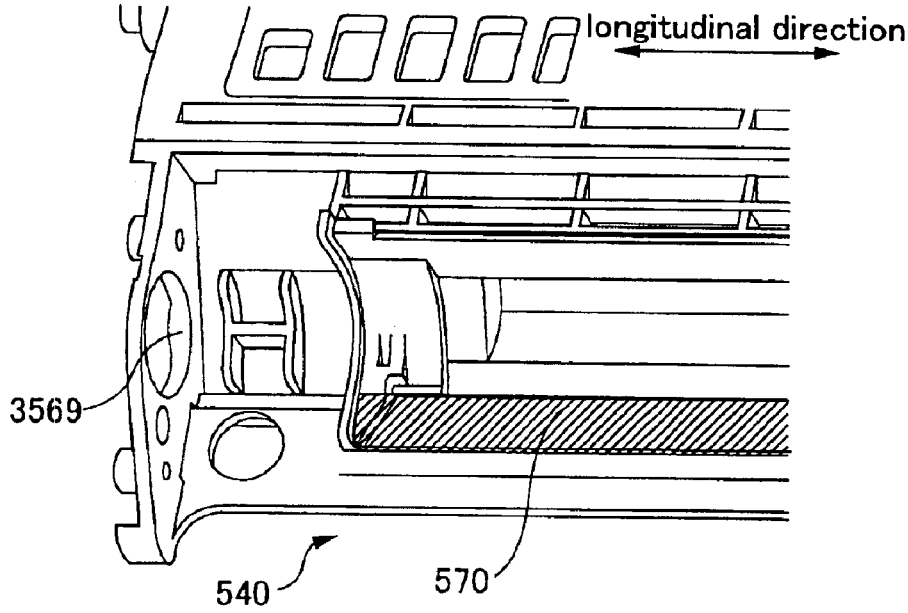
FIG. 24 is a diagram showing the housing 540 when the toner charging unit fixing portion 3526 is not attached to the housing body according to the third embodiment.

Further, as shown in FIG. 24, a blade-backing member 570 that serves as an example of a second sealing member and that is made from, for example, Moltoprene is provided on the other side of the restriction blade 560 opposite from the side of the developing roller 510. FIG. 24 is a diagram showing the housing 540 when the toner charging unit fixing portion 3526 is not attached to the housing body. The blade-backing member 570 keeps the toner T from entering between the restriction blade 560 and a pressing portion 3542 (described later) of the housing 540 to prevent toner T from spilling out from therebetween. The blade-backing member 570 also stabilizes the elastic force of the rubber-supporting portion 560*b* of the restriction blade 560. Further, the blade-backing member 570 impels (i.e., applies force to) the rubber portion 560*a* from the back thereof towards the developing roller 510 to press the rubber portion 560*a* against the developing roller 510. In this way, the blade-backing member 570 makes the rubber portion 560*a* abut against the developing roller 510 more evenly.

Figure 25:
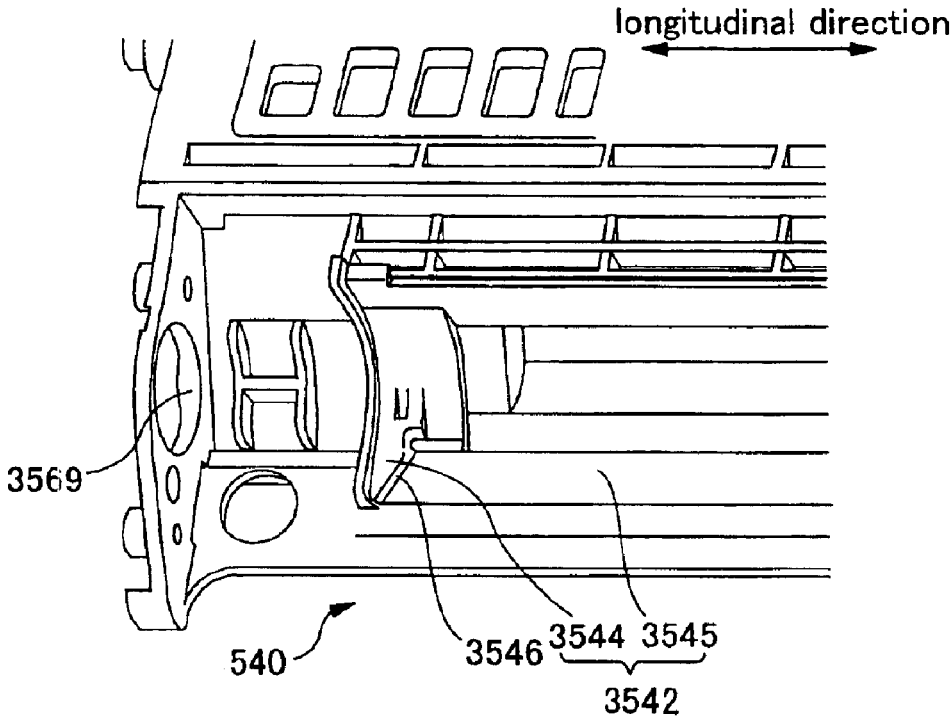
FIG. 25 is a diagram showing the housing 540 when a blade-backing member 570 is removed from the housing shown in FIG. 24 according to the third embodiment.

As shown in FIG. 25, the housing 540 comprises a pressing portion 3542 for pressing the restriction blade 560 towards the developing roller 510. FIG. 25 is a diagram showing the housing 540 when the blade-backing member 570 is removed from the housing shown in FIG. 24.

More specifically, the pressing portion 3542 is arranged in a position capable of coming into contact with the blade-backing member 570 of the housing 540, and the pressing portion 3542 presses the rubber portion 560*a* of the restriction blade 560 against the developing roller 510 through the blade-backing member 570.

Further, the pressing portion 3542 has a protruding portion 3544 that protrudes towards the restriction blade 560 at the end of the pressing portion 3542 in the axial direction of the developing roller 510. As shown in FIG. 25, the width of the protruding portion 3544 in a direction perpendicular to the above-mentioned axial direction gradually becomes narrow from the end of the pressing portion 3542 towards the center in the above-mentioned axial direction. Further, in the pressing portion 3542, a gentle inclined surface 3546 is formed between the protruding portion 3544 and a non-protruding portion 3545 in order to prevent abrupt differences in level from arising between the protruding portion 3544 and the non-protruding portion 3545.

Further, as it may be readily understood from the fact that the protruding portion 3544 protrudes towards the restriction blade 560, as regards the spacing between the pressing portion 3542 and the restriction blade 560, the spacing between the protruding portion 3544 and the restriction blade 560 is smaller than the spacing between the non-protruding portion 3545 and the restriction blade 560. Since the protruding portion 3544 is located at the end of the pressing portion 3542, it can be said that the spacing between the pressing portion 3542 and the restriction blade 560 becomes wider from the end towards the center in the axial direction of the developing roller 510.

Figure 26:
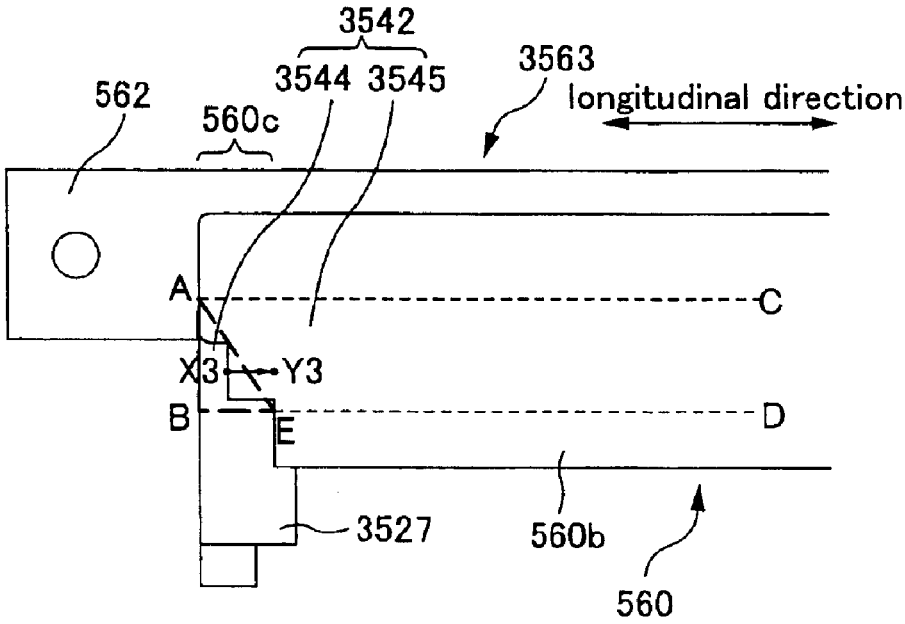
FIG. 26 is conceptual diagram for illustrating the relative positional relationship between a pressing portion 3542 and the restriction blade 560 and the end seal 3527 according to the third embodiment.

Next, with reference to FIG. 26, description will be made of a relative positional relationship between the pressing portion 3542 and the restriction blade 560 and the end seal 3527 when the toner charging unit fixing portion 3526 is attached to the housing body. FIG. 26 is conceptual diagram for illustrating the relative positional relationship between the pressing portion 3542 and the restriction blade 560 and the end seal 3527.

In FIG. 26, the restriction blade 560, the end seal 3527, and the blade-supporting metal plate 562 are shown. The positional relationship among these members is the same as the positional relationship shown in FIG. 21. Further, broken line CABD shows the pressing portion 3542 in order to illustrate the relative positional relationship between the pressing portion 3542 provided in the housing 540 and the above-mentioned members when the toner charging unit fixing portion 3526 is attached to the housing body. Further, in the pressing portion 3542, broken line ABE indicates the protruding portion 3544, and broken line CAED indicates the non-protruding portion 3545. Further, although it is not shown in FIG. 26, the blade-backing member 570 is located between the pressing portion 3542, and the restriction blade 560 and the end seal 3527, as described above.

As shown in FIG. 26, the boarder between the protruding portion 3544 and the non-protruding portion 3545 runs along the boarder between the restriction blade 560 and the end seal 3527. As a result, the end seal 3527 is pressed mainly by the protruding portion 3544 against the developing roller 510 through the blade-backing member 570, whereas the restriction blade 560 is pressed mainly by the non-protruding portion 3545 against the developing roller 510 through the blade-backing member 570. Accordingly, the pressing force caused by the pressing portion 3542 and exerted on an end section 560*c*, in the axial direction of the developing roller 510, of the restriction blade 560 becomes smaller from the end in the above-mentioned axial direction towards the center. For example, the pressing force caused by the pressing portion 3542 and exerted on the end section 560*c*, in the axial direction of the developing roller 510, of the restriction blade 560 becomes smaller from point X3 towards point Y3 in the figure.

Note that in FIG. 26, the above-mentioned inclined surface 3546 is omitted as a result of simplifying the figure for facilitating description thereof. Actually, however, the inclined surface 3546 is provided at a position along broken line AE. Further, FIG. 23 through FIG. 26 show only one end section in the axial direction of the developing roller 510. However, the other end is also configured in the same way.

By making the pressing force caused by the pressing portion and exerted on an end section, in the axial direction of the developing roller, of the restriction blade smaller from the end in the above-mentioned axial direction towards the center, it becomes possible to make the toner charge even.

More specifically, as described in the "BACKGROUND OF THE INVENTION", although the restriction blade and the end seals abut against the surface of the developing roller in order to achieve their functions described above, it is necessary to press the end seals against the developing roller with a sufficiently large pressing force in order to make the end seals appropriately achieve their functions of preventing spilling of toner. On the other hand, if the pressing force of the restriction blade against the developing roller at the end sections, in the axial direction of the developing roller, of the restriction blade is equal to or larger than the strength of the pressing force of the end seals against the developing roller, then there is a possibility that the pressing force at the end sections of the restriction blade will become significantly greater than the other sections of the restriction blade.

Such an uneven pressing of the restriction blade may cause the toner charge to be uneven, and such unevenness in toner charge may cause problems such as deterioration in image, toner spill, and toner scatter.

In order to address such a problem, the pressing force caused by the pressing portion and exerted on an end section, in the axial direction of the developing roller, of the restriction blade is made to be smaller from the end in the above-mentioned axial direction towards the center. In this way, the pressing force of the restriction blade at the end sections thereof will become substantially equal to the other sections of the restriction blade, and therefore, it becomes possible to reduce unevenness in pressing force. Accordingly, it becomes possible to make the toner charge even and prevent problems such as deterioration in image, toner spill, and toner scatter, which are caused by unevenness in toner charge.

Figure 27A:
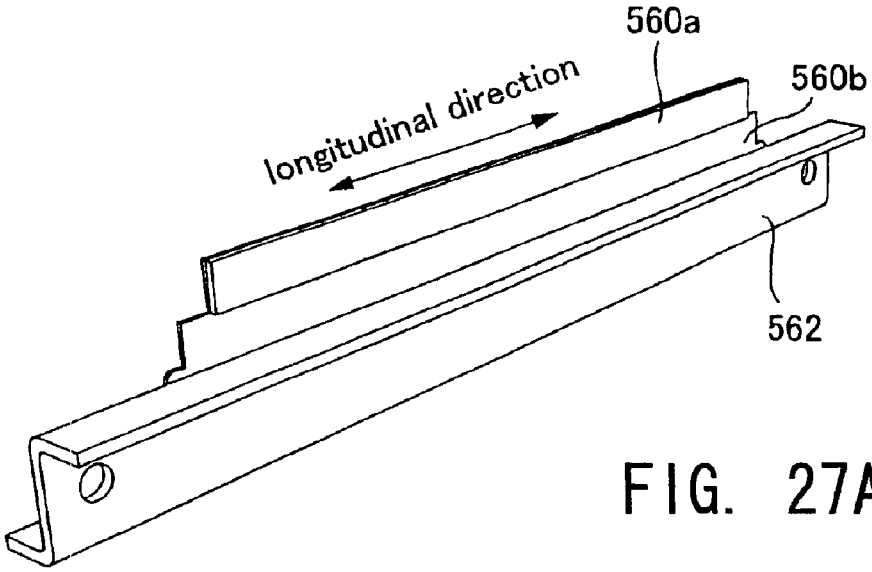
FIG. 27A and FIG. 27B are perspective views showing a state in which the restriction blade 560 is fixed to the blade-supporting metal plate 562 according to a fourth embodiment.
Figure 27B:
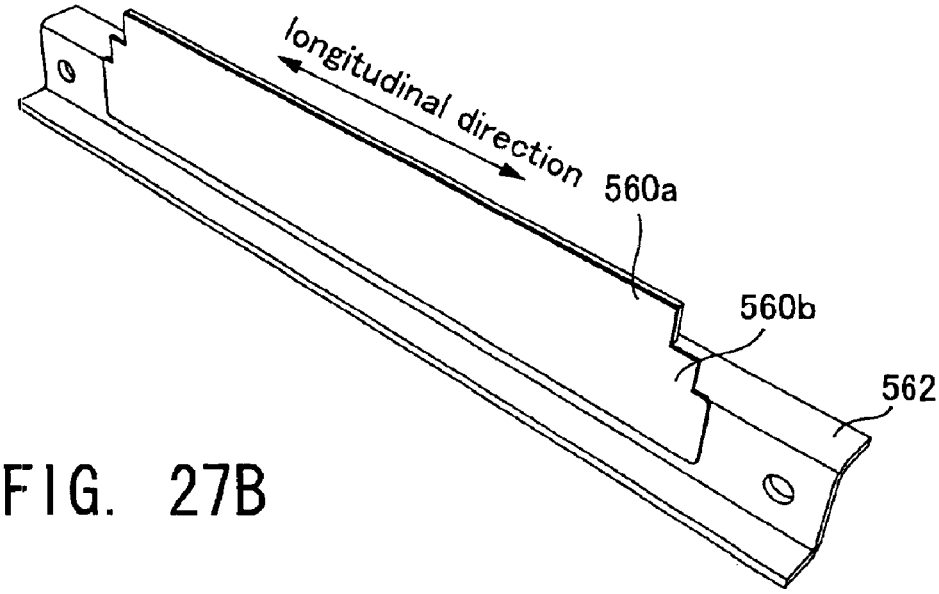
Figure 28:
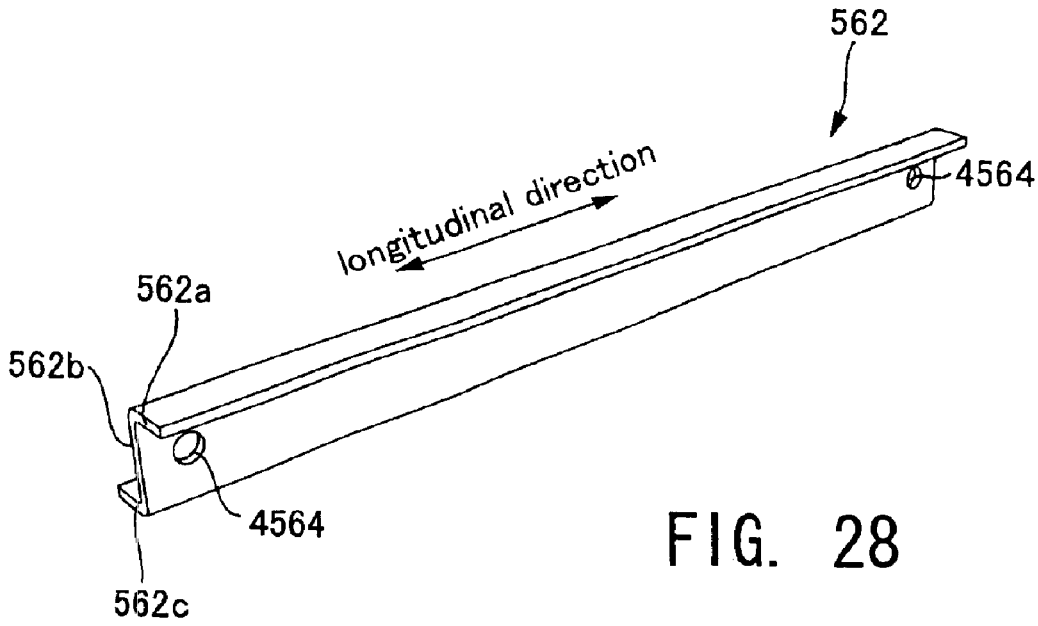
FIG. 28 is a perspective view of the blade-supporting metal plate 562 according to the fourth embodiment.
Figure 29:
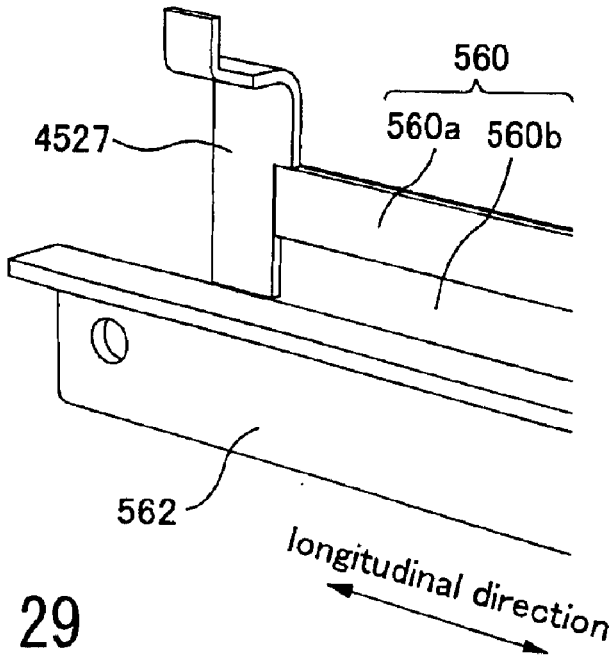
FIG. 29 is a perspective view showing a state where the restriction blade 560, in which an end seal 4527 is fixed to the rubber-supporting portion 560*b*, is fixed to the blade-supporting metal plate 562 according to the fourth embodiment.
Figure 30:
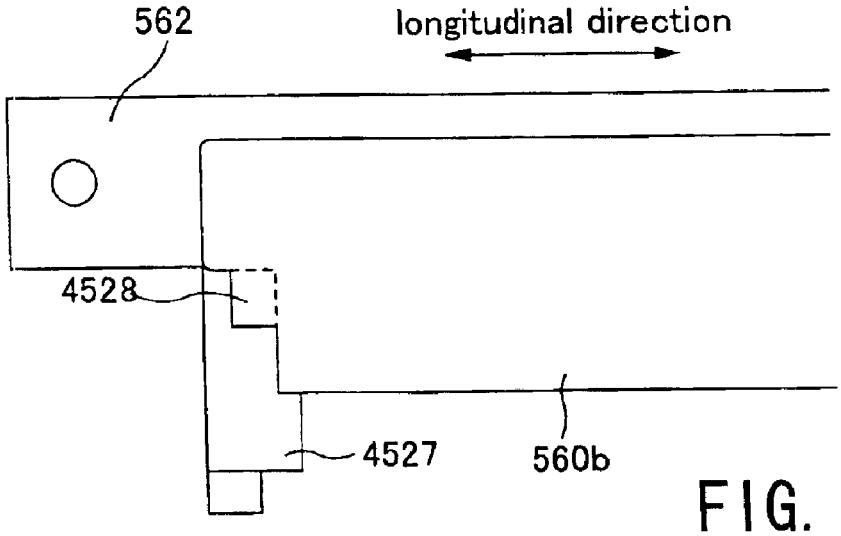
FIG. 30 is a diagram showing a state where the restriction blade 560, in which the end seal 4527 is fixed to the rubber-supporting portion 560*b*, is fixed to the blade-supporting metal plate 562, seen from the back side of the rubber portion 560*a* according to the fourth embodiment.
Figure 31:
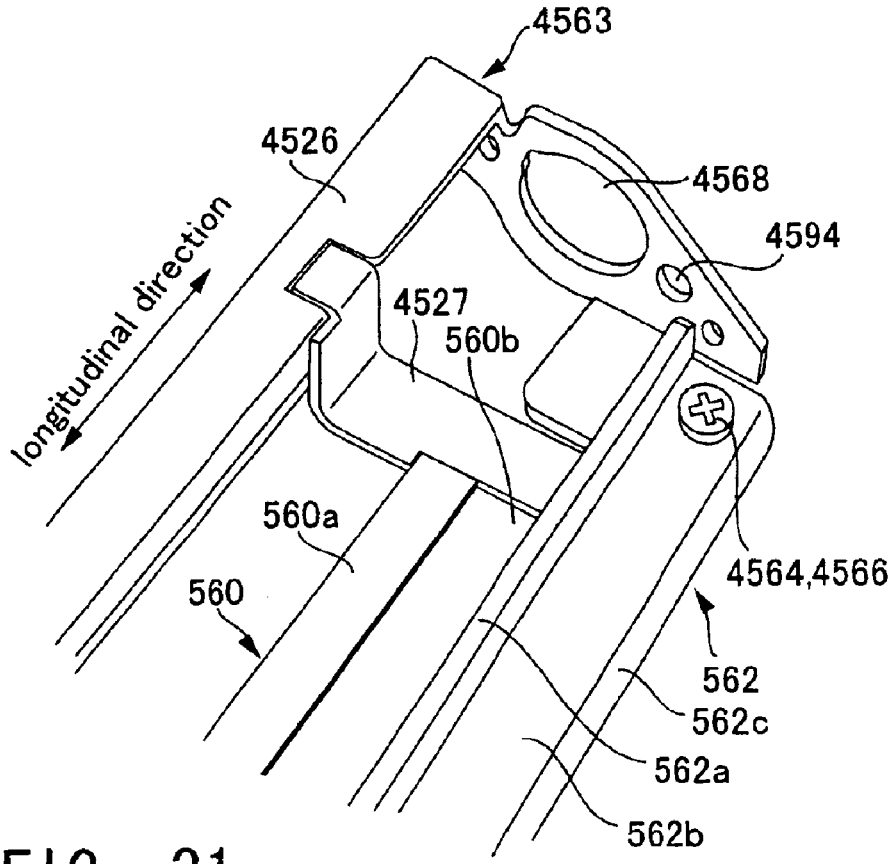
FIG. 31 is a perspective view showing a thickness restricting unit 4563 according to the fourth embodiment.
Figure 32:
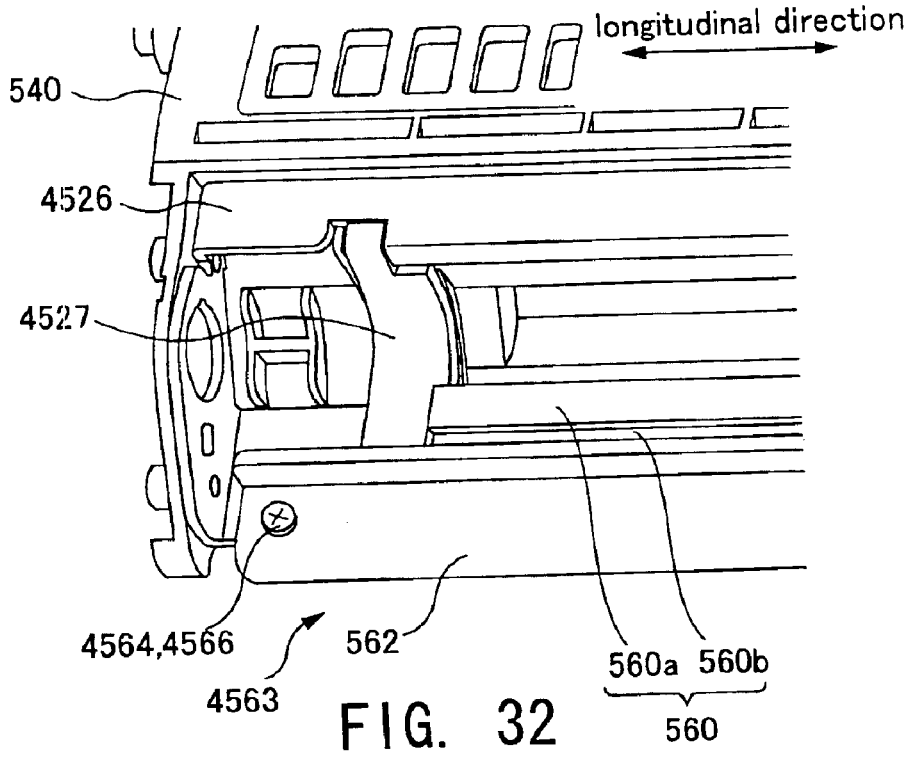
FIG. 32 is a diagram showing a state in which the thickness restricting unit 4563 is attached to the housing 540 according to the fourth embodiment.
Figure 33:
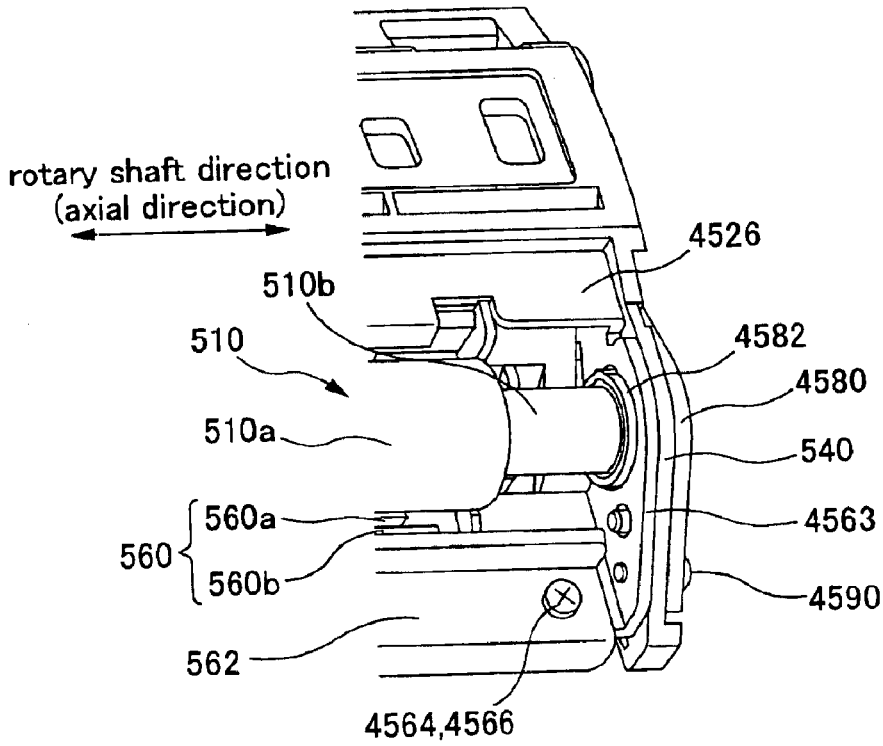
FIG. 33 is a diagram showing a state in which the developing roller 510 is being supported by a shaft bearing member 4580 according to the fourth embodiment.
Figure 34:
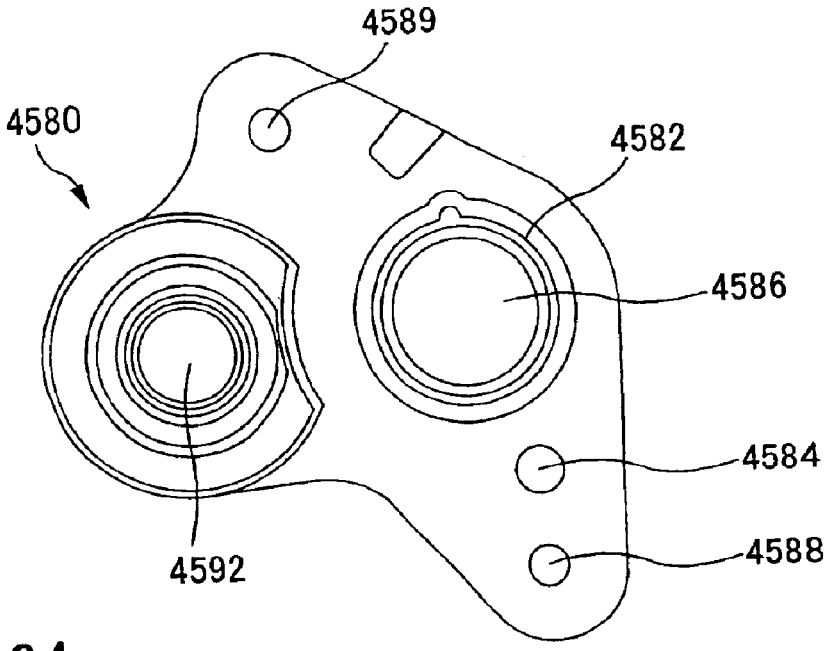
FIG. 34 is a diagram illustrating the shaft bearing member 4580 according to the fourth embodiment.
Figure 35:
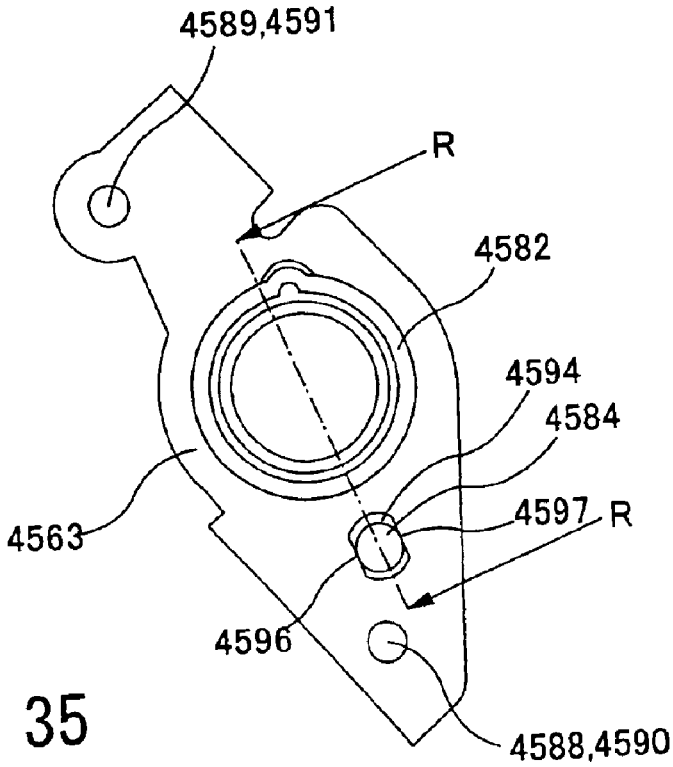
FIG. 35 is a diagram showing a state in which the position of the thickness restricting unit 4563 is determined by the shaft bearing member 4580, seen from the side of a toner bearing portion 510*a* according to the fourth embodiment.
Figure 36:
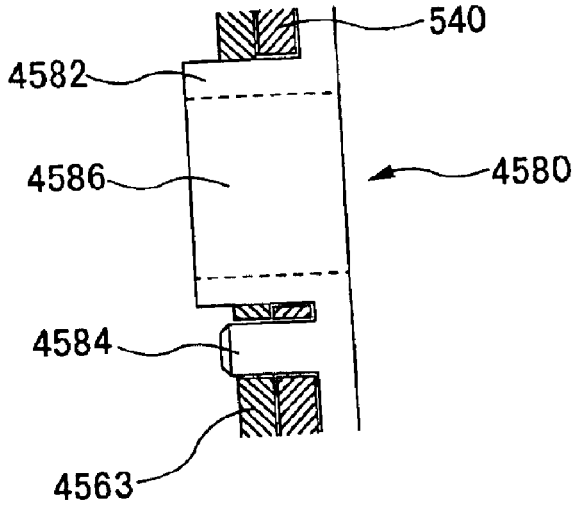
FIG. 36 is a sectional view taken along line R—R shown in FIG. 35 according to the fourth embodiment.
Figure 37:
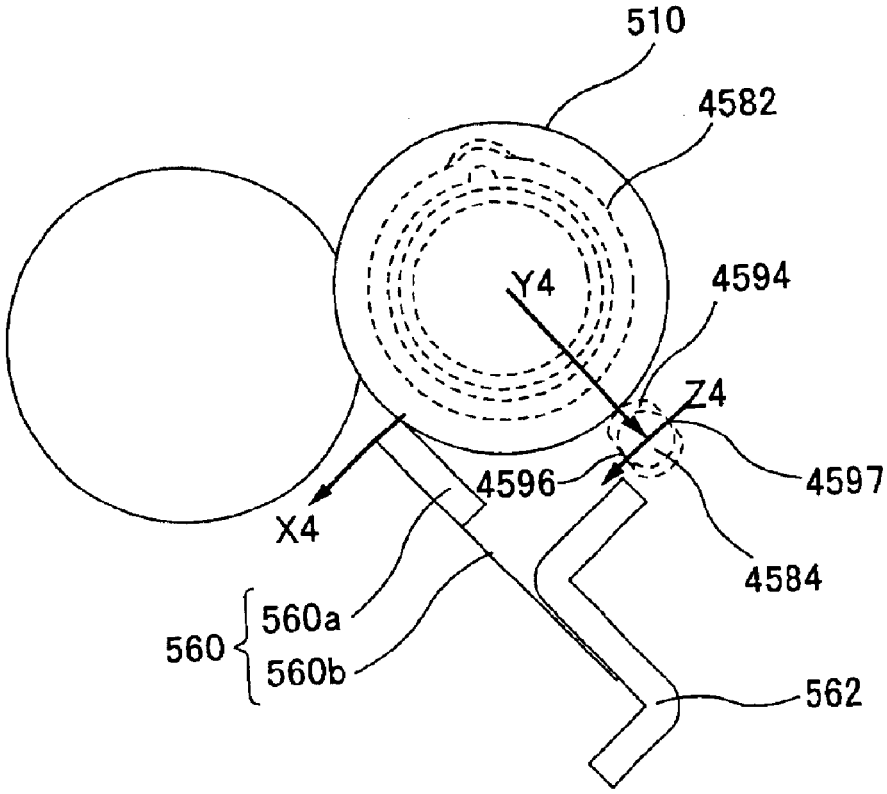
FIG. 37 is a schematic diagram illustrating the relative positional relationship between the restriction blade 560 and protrusions (or holes) according to the fourth embodiment.

Fourth Embodiment of the Structure of the Restriction Blade and Peripheral Components Next, with reference to FIG. 4, FIG. 5, FIG. 27A, FIG. 27B, and FIG. 28 through FIG. 37, the structures of the restriction blade 560 and peripheral components thereof will be described. FIG. 27A and FIG. 27B are perspective views showing a state in which the restriction blade 560 is fixed to the blade-supporting metal plate 562. FIG. 28 is a perspective view of the blade-supporting metal plate 562. FIG. 29 is a perspective view showing a state where the restriction blade 560, in which the end seal 4527 is fixed to the rubber-supporting portion 560*b*, is fixed to the blade-supporting metal plate 562. FIG. 30 is a diagram showing a state where the restriction blade 560, in which the end seal 4527 is fixed to the rubber-supporting portion 560*b*, is fixed to the blade-supporting metal plate 562, seen from the back side of the rubber portion 560*a*. FIG. 31 is a perspective view showing the thickness restricting unit 4563. FIG. 32 is a diagram showing a state in which the thickness restricting unit 4563 is attached to the housing 540. FIG. 33 is a diagram showing a state in which the developing roller 510 is being supported by a shaft bearing member 4580. FIG. 34 is a diagram illustrating the shaft bearing member 4580. FIG. 35 is a diagram showing a state in which the position of the thickness restricting unit 4563 is determined by the shaft bearing member 4580, seen from the side of the toner bearing portion 510*a*. FIG. 36 is a sectional view taken along line R—R shown in FIG. 35. FIG. 37 will be described later.

As described above, the restriction blade 560 has functions of giving charge to the toner T (which serves as developer) bore by the developing roller 510 (which serves as a developer bearing member) and restricting the thickness of the layer of the toner T bore by the developing roller 510.

As shown in FIG. 5, the restriction blade 560 comprises a rubber portion 560*a* and a rubber-supporting portion 560*b*. In the present embodiment, the rubber portion 560*a* is made from, for example, silicone rubber or urethane rubber having a thickness of about 2 mm. The rubber-supporting portion 560*b* is a thin plate that has a thickness of 1 mm or less, that is made from, for example, phosphor bronze or stainless steel, and that has a springy characteristic.

As shown in FIG. 5, the rubber portion 560*a* is supported by the rubber-supporting portion 560*b*. As shown in FIG. 4, the surface of the rubber portion 560*a* is placed in contact with the surface of the developing roller 510, and in this way, the rubber portion 560*a* achieves the above-mentioned functions with respect to the toner T bore by the developing roller 510.

The rubber-supporting portion 560*b* presses the rubber portion 560*a* against the developing roller 510 with its impelling force. As shown in FIG. 27A and FIG. 27B, one end of the rubber-supporting portion 560*b* is fixed to the blade-supporting metal plate 562. The blade-supporting metal plate 562 is, for example, a steel plate having a zinc plating layer. Note that such fixing is achieved through spot welding by laser welding. Further, FIG. 27A is a diagram showing, to the front, the surface of the rubber portion 560*a* that abuts against the developing roller 510, and FIG. 27B is a diagram showing, to the front, the back surface of the surface of the rubber portion 560*a* that abuts against the developing roller 510.

As shown in FIG. 28, the blade-supporting metal plate 562 has a first bent portion 562*a*, a supporting portion 562*b*, and a second bent portion 562*c* that are formed by bending a rectangular member along its longitudinal direction. The rectangular member has a thickness of 1.8 mm or more. The first bent portion 562*a* is bent in a direction opposite to the second bent portion 562*c*, and as shown in FIG. 4, the cross-section of the blade-supporting metal plate 562 is formed in a so-called "Z" shape. Note that in the present embodiment, among the first and second bent portions 562*a* and 562*c*, the bent portion that is closer to the rubber portion 560*a* is called the first bent portion 562*a*. Further, as shown in FIG. 4, FIG. 27A, and FIG. 27B, the rubber-supporting portion 560*b* is fixed to the supporting portion 562*b*, and the supporting portion 562*b* supports the restriction blade 560.

Further, as shown in FIG. 29, an end seal 4527 is provided at each end section in the longitudinal direction of the restriction blade 560. The end seal 4527 is made of non-woven cloth and has a function of preventing the toner T from spilling out from between the housing 540 and the circumferential surface of the developing roller 510 at the end sections in the axial direction thereof. The thickness of the end seal 4527 is made thicker than the thickness of the rubber portion 560*a* of the restriction blade 560 described above, and is about 2.6 mm.

Further, as shown in FIG. 30, the end seal 4527 is fixed to the rubber-supporting portion 560*b* of the restriction blade 560. Note that, in the present embodiment, the end seal 4527 and the rubber-supporting portion 560*b* are attached to each other with a double-faced adhesive tape at a rectangular attaching section 4528. That is, the rubber portion 560*a* and the end seal 4527 are fixed to the rubber-supporting portion 560*b* next to each other.

Note that, although FIG. 29 and FIG. 30 show only one end section in the longitudinal direction of the restriction blade etc., the other end is configured in the same way.

As shown in FIG. 31, the blade-supporting metal plate 562 has screw holes 4564 at both end sections, in the longitudinal direction, of the supporting portion 562*b* for fixing the blade-supporting metal plate 562 to the developing device. The blade-supporting metal plate 562 is fixed to a frame 4526 at both end sections in the longitudinal direction of the supporting portion 562*b* with screws 4566.

Note that, in the present embodiment, the restriction blade 560, the blade-supporting metal plate 562 to which the restriction blade 560 is fixed, and the frame 4526 are integrated into one unit as shown in FIG. 31, and this unit is referred to as the thickness restricting unit 4563.

As shown in FIG. 32, the thickness restricting unit 4563 is structured so that it is attachable/detachable to/from the housing 540 described above. As can be seen in FIG. 32, the housing 540 is structured so that the end seal 4527 can be arranged along a portion of the housing 540 formed in a manner as to oppose the outer circumferential surface of the developing roller 510 when the thickness restricting unit 4563 is attached to the housing 540.

Further, as shown in FIG. 33, the position of the thickness restricting unit 4563 is determined by shaft bearing members 4580 for receiving the rotary shaft 510*b* of the developing roller 510 in a state in which the thickness restricting unit 4563 is attached to the housing 540.

More specifically, as shown in FIG. 34, the shaft bearing member 4580 has, for example, a first protrusion 4582 having a shaft bearing hole 4586, a second protrusion 4584, two screw holes 4588, 4589, and a toner-supplying roller supporting portion 4592. As shown in FIG. 33, FIG. 35 and FIG. 36, the first protrusion 4582 of the shaft bearing member 4580 is fit into the developing roller through hole 4568 (FIG. 10), which is provided in each end in the longitudinal direction of the thickness restricting unit 4563 and serves as an example of a first hole, across the housing 540. That is, the housing 540 is sandwiched between the shaft bearing member 4580 and the thickness restricting unit 4563. The second protrusion 4584 of the shaft bearing member 4580 is fit into a second hole 4594, which is provided in each end in the longitudinal direction of the thickness restricting unit 4563, across the housing 540.

Further, the first protrusion 4582 and the developing roller through hole 4568 into which the first protrusion 4582 is fit are both formed in a circular shape, and the first protrusion 4582 fits together (or mates) with the developing roller through hole 4568. The second protrusion 4584 is formed in a circular shape, whereas the second hole 4594 is substantially oval. Thus, the second protrusion 4584 abuts against the second hole 4594 at two abutting sections 4596, 4597 (FIG. 14). That is, the second protrusion 4584 functions to prevent the thickness restricting unit 4563 from rotating with respect to the shaft bearing member 4580 about the center of the first protrusion 4582. By fitting the two protrusions into the two holes in this way, the position of the thickness restricting unit 4563 is determined by the shaft bearing member 4580.

Note that, as shown in FIG. 33 and FIG. 35, the thickness restricting unit 4563 is screwed to the shaft bearing member 4580 with screws 4590, 4591 across the housing 540 (i.e., with the housing 540 sandwiched between the thickness restricting unit 4563 and the shaft bearing member 4580).

Next, with reference to FIG. 37, the relative positional relationship between the restriction blade 560 and the above-mentioned protrusions (or holes) will be described. FIG. 37 is a schematic diagram illustrating the relative positional relationship between the restriction blade 560 and the above-mentioned protrusions (or holes). Similar to FIG. 4, FIG. 37 is a sectional view showing some of the structural components of the developing device. However, in order to facilitate the following description, among those structural components, only the developing roller 510, the toner-supplying roller 550, the restriction blade 560, and the blade-supporting metal plate 562 are shown in solid lines in FIG. 37. The relative positions of the first protrusion 4582 (or the developing roller through hole 4568 serving as the first hole) and the second protrusion 4584 (or the second hole 4594) with respect to the above-mentioned structural components are shown by the broken lines in FIG. 37.

More specifically, the direction (indicated by Y4 in FIG. 37) from the center of the first protrusion 4582 (or the developing roller through hole 4568 serving as the first hole) towards the center of the second protrusion 4584 (or the second hole 4594) intersects the direction of a counterforce (indicated by X4 in FIG. 37) that the restriction blade 560 receives from the developing roller 510 by abutting against the developing roller 510. Further, the direction of a line (indicated by Z4 in FIG. 37) that passes through the above-mentioned abutting section 4596 and the abutting section 4597 is parallel to the direction of the above-mentioned counterforce (indicated by X4 in FIG. 37).

It should be noted that, as shown in FIG. 33, the developing roller 510 is supported by the shaft bearing members 4580 provided outward, in the longitudinal direction, of the developing roller through holes 4568 in a state in which the rotary shaft 510*b* of the roller 510 is passed through the developing roller through holes 4568 (FIG. 10) and holes provided in the housing 540. In this state, the rubber portion 560*a* and the end seal 4527 abut against a toner bearing region and a toner non-bearing region on the surface of the developing roller 510, respectively, and achieve their functions described above.

Further, the other end of the restricting blade 560 that is not being supported by the blade-supporting metal plates 562 (i.e., the free end of the restriction blade 560) is not placed in contact with the developing roller 510; rather, a section at a predetermined distance from the free end contacts, with some breadth, the developing roller 510. In other words, the restriction blade 560 does not abut against the developing roller 510 at its tip end, but abuts against the roller 510 near its central portion. Further, the restriction blade 560 is arranged so that its tip end faces towards the upper stream of the rotating direction of the developing roller 510, and thus, makes a so-called counter-contact with respect to the roller 510. Note that the abutting position at which the restriction blade 560 abuts against the developing roller 510 is situated below the central axis of the developing roller 510 and also below the central axis of the toner-supplying roller 550.

Further, a blade-backing member 570 (FIG. 4) that is made from, for example, Moltoprene is provided on the other side of the restriction blade 560 opposite from the side of the developing roller 510. The blade-backing member 570 keeps the toner T from entering between the restriction blade 560 and the housing 540 to prevent toner T from spilling out from therebetween. The blade-backing member 570 also stabilizes the elastic force of the rubber-supporting portion 560*b* of the restriction blade 560. Further, the blade-backing member 570 impels (i.e., applies force to) the rubber portion 560*a* from the back thereof towards the developing roller 510 to press the rubber portion 560*a* against the developing roller 510. In this way, the blade-backing member 570 makes the rubber portion 560*a* abut against the developing roller 510 more evenly.

It should be noted that, although FIG. 31 through FIG. 33 show only one end section in the axial direction of the developing roller 510, the other end is configured in the same way.

By determining the position of the thickness restricting unit using the shaft bearing member, it becomes possible to prevent a misalignment in relative position of the restriction blade with respect to the developing roller from occurring.

More specifically, as described in the "BACKGROUND OF THE INVENTION", if there is a misalignment in the relative position, the thickness of the toner may become uneven. Such unevenness in thickness may bring about a problem that the degree of toner charge becomes uneven.

In order to address such a problem, the position of the thickness restricting unit is determined using a shaft bearing member. Since the position of the restriction blade is determined by the thickness restricting unit and the position of the developing roller is determined by the shaft bearing member, the misalignment in the relative position of the restriction blade with respect to the developing roller becomes smaller compared to, for example, a case where the position of the thickness restricting unit is determined using the housing. Accordingly, the thickness of the toner becomes even, and it becomes possible to prevent the toner charge from becoming uneven.

Other Embodiments

Above, a developer charging unit (thickness restricting unit) etc. according to the present invention were described based on various embodiments. However, the above-mentioned embodiments of the invention are merely given for facilitating understanding of the present invention, and are not to limit the scope of the present invention. It is without saying that the present invention may be altered and/or modified without departing from the scope thereof, and that the present invention includes its equivalents.

In the embodiments described above, a full-color laser-beam printer of the intermediate-transferring type was taken as an example of an image-forming apparatus. However, the present invention is applicable to various image-forming apparatuses such as full-color laser-beam printers other than the intermediate-transferring type, monochrome laser-beam printers, photocopiers, and facsimile machines.

Further, the photoconductor is not limited to the so-called photoconductive roller structured by providing a photoconductive layer on the outer peripheral surface of a cylindrical, conductive base. The photoconductor can be a so-called photoconductive belt structured by providing a photoconductive layer on a surface of a belt-like conductive base.

(1) Further, in the first embodiment described above, the closer the welding points are located to the center in the longitudinal direction of the restriction blade, the shorter the spacing between two of the welding points becomes. However, the configuration is not limited to the above. For example, the spacings between the welding points located at the end sections in the longitudinal direction of the restriction blade may be constant, and the spacings between the welding points located in the central section of the restriction blade may be shorter than the spacings at the end sections.

However, the embodiment described above is preferable because according to such a configuration, it becomes possible to reduce the unevenness in the above-mentioned pressing force in an ideal manner, and as a result, it becomes possible to make the toner charge even more effectively.

Further, in the first embodiment, the closer a welding point is located to the center in the longitudinal direction of the restriction blade, the shorter the distance between the free end of the restriction blade and that welding point becomes. However, the configuration is not limited to the above. For example, the distance between the free end of the restriction blade and a welding point located at the end sections in the longitudinal direction of the restriction blade may be constant, and the distance between the free end and a welding point located in the central section of the restriction blade may be shorter than the distance at the end sections.

However, the embodiment described above is preferable because according to such a configuration, it becomes possible to reduce the unevenness in the above-mentioned pressing force in an ideal manner, and as a result, it becomes possible to make the toner charge even more effectively.

Further, in the first embodiment, the closer the welding points are located to a center in the longitudinal direction of the restriction blade, the larger the number of the welding points becomes. However, the configuration is not limited to the above. For example, the number of welding points located at the end sections in the longitudinal direction of the restriction blade may be constant, and the number of welding points located in the central section of the restriction blade may be larger than the number of welding points at the end sections.

However, the embodiment described above is preferable because according to such a configuration, it becomes possible to reduce the unevenness in the above-mentioned pressing force in an ideal manner, and as a result, it becomes possible to make the toner charge even more effectively.

Further, in the first embodiment, the restriction blade and the blade-supporting metal plate are fixed together by welding. However, the configuration is not limited to the above. For example, the restriction blade and the blade-supporting metal plate may be fixed together using screws.

However, the embodiment described above is preferable because, if the members are fixed together by welding, it becomes possible to fix the members together efficiently and at many points.

Further, in the first embodiment, welding is by laser welding. However, the configuration is not limited to the above, and other kinds of welding can be adopted.

However, the embodiment described above is preferable because, by using laser welding, accurate and precise control can be achieved, and it will become possible to overcome the difficulty in welding metal plates that differ in material and that also differ greatly in thickness.

Further, in the first embodiment, the restriction blade includes a rubber portion that is capable of abutting against the surface of the developing roller, and a rubber-supporting portion for supporting the rubber portion; and the rubber-supporting portion and the blade-supporting metal plate are fixed together. However, the configuration is not limited to the above. For example, the rubber portion and the blade-supporting metal plate may be fixed together directly.

However, the embodiment described above is preferable because it is possible to easily fix the restriction blade and the blade-supporting metal plate together.

Further, in the first embodiment, a screw hole for fixing the blade-supporting metal plate to the developing device is provided at each end section of the blade-supporting metal plate in the longitudinal direction thereof. However, the configuration is not limited to the above.

However, the embodiment described above is more effective in terms that the above-mentioned effect, i.e., the effect that the unevenness in pressing force can be reduced and the toner charge can be made even will be exerted more effectively in a situation according to the embodiment described above, since in the above embodiment, the blade-supporting metal plate is securely supported at both end sections thereof, and the bending in the central section in the longitudinal direction of the restriction blade becomes larger, and therefore, the pressing force of the restriction blade against the developing roller at the central section becomes weak.

(2) Further, in the second embodiment, the spacing between two of the welding points located at the end section in the longitudinal direction of the restriction blade is made to be wider than the spacing between two of the welding points located in the central section in the longitudinal direction of the restriction blade. However, the configuration is not limited to the above. For example, the spacing between two of the welding points located at the end section in the longitudinal direction of the restriction blade may be equal to or narrower than the spacing between two of the welding points located in the central section of the restriction blade.

However, the embodiment described above is preferable because the intensity of the pressing force of the restriction blade against the developing roller at the end sections in the longitudinal direction is reduced compared to the intensity of the pressing force of the restriction blade at the central section, and therefore, it becomes possible to reduce the unevenness in the above-mentioned pressing force in an ideal manner. As a result, it becomes possible to make the toner charge even more effectively.

Further, in the second embodiment, the restriction blade and the blade-supporting metal plate are fixed together by welding. However, the configuration is not limited to the above. For example, the restriction blade and the blade-supporting metal plate may be fixed together using screws.

However, the embodiment described above is preferable because, if the members are fixed together by welding, it becomes possible to fix the members together efficiently and at many points.

Further, in the second embodiment, welding is by laser welding. However, the configuration is not limited to the above, and other kinds of welding can be adopted.

However, the embodiment described above is preferable because, by using laser welding, accurate and precise control can be achieved and it will become possible to overcome the difficulty in welding metal plates that differ in material and that also differ greatly in thickness.

Further, in the second embodiment, the end seals for preventing the toner from spilling are provided at the end sections in the longitudinal direction of the restriction blade. However, the configuration is not limited to the above. For example, a member other than an end seal may be provided at the end sections in the longitudinal direction of the restriction blade, and such a member may abut against the toner non-bearing region on the surface of the developing roller.

However, the embodiment described above is more effective in terms that the above-mentioned effect, i.e., the effect of reducing the problem that the end seals have an influence on the pressing force of the restriction blade against the developing roller due to the difference in the characteristics of the end seals (for example, thickness, the properties of the material, etc.) from those of the restriction blade and that the pressing force of the restriction blade against the developing roller becomes stronger at the end sections in the longitudinal direction of the restriction blade is exerted more effectively.

Further, in the second embodiment, the restriction blade includes a rubber portion that is capable of abutting against the surface of the developing roller, and a rubber-supporting portion for supporting the rubber portion; and the end seals are fixed to the rubber-supporting portion. However, the configuration is not limited to the above. For example, the end seals may be fixed to the above-mentioned frame.

However, the embodiment described above is more effective in terms that the above-mentioned effect, i.e., the effect that the toner charge can be made even by reducing the unevenness in pressing force will be exerted more effectively in a situation according to the embodiment described above, since in the above embodiment, the end seal may have a greater influence on the pressing force of the restriction blade against the developing roller due to the difference in characteristics of the end seal and the restriction blade because the end seal is attached directly to the restriction blade.

Further, in the second embodiment, the thickness of the end seal is thicker than the thickness of the rubber portion. However, the configuration is not limited to the above. For example, the thickness of the end seal may be equal to or less than the thickness of the rubber portion.

However, the embodiment described above is more effective in terms that the above-mentioned effect, i.e., the effect that the intensity of the pressing force of the restriction blade against the developing roller at the end sections in the longitudinal direction can be reduced compared to the intensity of the pressing force of the restriction blade in the central section and the unevenness in pressing force can be reduced, and as a result, the toner charge can be made even will be exerted more effectively in a situation according to the embodiment described above, since in the above embodiment, the pressing force of the restriction blade against the developing roller at the end sections in the longitudinal direction of the restriction blade tends to become larger because the thickness of the end seal is thicker than the restriction blade.

Further, in the second embodiment, the rubber portion and the end seals are fixed to the rubber-supporting portion next to each other; and the rubber portion and the end seals abut against the surface of the developing roller. However, the configuration is not limited to the above. For example, the rubber portion and the end seals may be fixed to the rubber-supporting portion separated from each other.

However, the embodiment described above is more effective in terms that the above-mentioned effect, i.e., the effect that the toner charge can be made even by reducing the unevenness in pressing force will be exerted more effectively in a situation according to the embodiment described above, since in the above embodiment, the end seal may have a greater influence on the pressing force of the restriction blade against the developing roller due to the difference in characteristics of the end seal and the restriction blade.

(3) Further, in the third embodiment, a blade-backing member for preventing the toner from spilling out from between the pressing portion and the restriction blade is provided between the pressing portion and the restriction blade. However, the configuration is not limited to the above. For example, a blade-backing member does not have to be provided between the pressing portion and the restriction blade.

However, according to the embodiment described above, it is possible to prevent the toner from spilling out from between the pressing portion and the restriction blade and it is also possible to stabilize the elastic force of the rubber-supporting portion of the restriction blade. Further, it is possible to make the rubber portion abut against the developing roller more evenly. Therefore, the embodiment described above is preferable.

Further, in the third embodiment, the spacing between the pressing portion and the restriction blade is made to become wider from the end towards the center in the axial direction of the developing roller. However, the configuration is not limited to the above.

However, the embodiment described above is preferable because it is possible to make the pressing force caused by the pressing portion and exerted on the end sections, in the axial direction of the developing roller, of the restriction blade become smaller from the end in the axial direction towards the center according to a simple method.

Further, in the third embodiment, the pressing portion has a protruding portion protruding towards the restriction blade at an end, in the axial direction of the developing roller, of the pressing portion. However, the configuration is not limited to the above.

However, the embodiment described above is preferable because it is possible to make the pressing force caused by the pressing portion and exerted on the end sections, in the axial direction of the developing roller, of the restriction blade become smaller from the end in the axial direction towards the center according to a simple method.

Further, in the third embodiment, the protruding portion presses the end seal through the blade-backing member. However, the configuration is not limited to the above.

However, the embodiment described above is preferable because it becomes possible to press the end seal against the developing roller with a sufficiently large pressing force and make the end seal appropriately achieve its function of preventing the toner from spilling.

Further, in the third embodiment, the pressing portion has an inclined surface between the protruding portion and a non-protruding portion of the pressing portion. However, the configuration is not limited to the above. For example, the portion between the protruding portion and the non-protruding portion can be configured in a stair-like shape.

However, the embodiment described above is preferable because it becomes possible for the blade-backing member to be arranged smoothly along the pressing portion and to appropriately achieve the above-mentioned functions of the blade-backing member.

Further, in the third embodiment, the restriction blade includes a rubber portion that is made to abut against the developing roller, and a rubber-supporting portion for impelling the rubber portion; the rubber portion and the end seals are fixed to the rubber-supporting portion next to each other; and the rubber portion and the end seals abut against the surface of the developing roller. However, the configuration is not limited to the above. For example, the rubber portion and the end seals may be fixed to the rubber-supporting portion separated from each other, or only the rubber portion may be fixed to the rubber-supporting portion and the end seals may be fixed to the housing.

However, the embodiment described above is more effective in terms that the above-mentioned effect, i.e., the effect that the toner charge can be made even by reducing the unevenness in pressing force will be exerted more effectively in a situation according to the embodiment described above, since in the above embodiment, the pressing force of the end seal against the developing roller tends to have a greater influence on the pressing force of the restriction blade against the developing roller.

(4) Further, in the fourth embodiment, the restriction blade abuts against the developing roller to restrict the thickness of the layer of the toner bore by the developing roller. However, the configuration is not limited to the above. For example, the restriction blade may restrict the thickness of the layer of the toner bore by the developing roller in a non-contacting state with respect to the developing roller.

However, if the restriction blade restricts the thickness of the toner by abutting against the developing roller, the thickness of the toner tends to become uneven due to the counterforce that the restriction blade receives from the developing roller. Therefore, the embodiment described above is more effective in terms that the functions mentioned above will be exerted more effectively.

Further, in the fourth embodiment, the thickness restricting unit has a hole; the shaft bearing member has a protrusion; and the position of the thickness restricting unit is determined by fitting the protrusion into the hole. However, the configuration is not limited to the above, and the position can be determined in any way as long as the position of the thickness restricting unit is determined by the shaft bearing member.

However, the embodiment described above is preferable because the position of the thickness restricting unit can be determined according to a simple method.

Further, in the fourth embodiment, the thickness restricting unit has a plurality of holes; the shaft bearing member has a plurality of protrusions; each of the protrusions is fit into a corresponding one of the holes; and a first protrusion among the plurality of protrusions has a shaft bearing hole for receiving the rotation shaft. However, the configuration is not limited to the above. For example, there may only be one hole in the thickness restricting unit and there may be only one protrusion on the shaft bearing member that is to be fit into the hole.

However, the embodiment described above is preferable because the position of the thickness restricting unit can be determined more certainly.

Further, in the fourth embodiment, the first hole, among the plurality of holes, into which the first protrusion is fit has a circular shape. However, the configuration is not limited to the above. For example, the first hole may be oval or rectangular.

However, if the first hole has a circular shape, it will be easy to form the shape of the hole. On the other hand, the embodiment described above is more effective in terms that, since in the above embodiment the thickness restricting unit tends to rotate about the center of the first protrusion with respect to the shaft bearing member, the function of the protrusions other than the first protrusion to prevent the above-mentioned rotation will be achieved more effectively.

Further, in the fourth embodiment, the first protrusion is fit together with the first hole. However, the configuration is not limited to the above. For example, the first protrusion may be fit into the first hole in a state in which the shapes thereof do not match each other.

However, the embodiment described above is preferable because the position of the thickness restricting unit can be determined more certainly.

Further, in the fourth embodiment, a second protrusion that is different from the first protrusion is fit into a second hole that is different from the first hole; and the direction from the center of the first hole towards the center of the second hole intersects the direction of a counterforce that the restriction blade receives from the developing roller by abutting against the developing roller. However, the configuration is not limited to the above. For example, the direction from the center of the first hole towards the center of the second hole may be parallel to the direction of the counterforce.

However, the embodiment described above is more effective in terms that the function of the second protrusion to prevent the thickness restricting unit from rotating about the center of the first protrusion with respect to the shaft bearing member will be achieved more effectively.

Further, in the fourth embodiment, a second protrusion that is different from the first protrusion is fit into a second hole that is different from the first hole; the second protrusion abuts against the second hole at two sections; and the direction of a line that passes through the two sections is parallel to the direction of a counterforce that the restriction blade receives from the developing roller by abutting against the developing roller. However, the configuration is not limited to the above.

For example, the direction of the line that passes through the two abutting sections may intersect the direction of the counterforce.

However, the embodiment described above is more effective in terms that the function of the second protrusion to prevent the thickness restricting unit from rotating about the center of the first protrusion with respect to the shaft bearing member will be achieved more effectively.

Further, in the fourth embodiment, a housing capable of containing the toner is provided, and the protrusion is fit into the hole across the housing. However, the configuration is not limited to the above. For example, the protrusion may be fit into the hole without the housing being sandwiched.

However, the embodiment described above is preferable because the thickness restricting unit and the shaft bearing member, and thus, the restriction blade and the developing roller will be appropriately fixed to the housing.

Configuration of Computer System Etc.

Next, an embodiment of a computer system, which is an example of an embodiment of the present invention, will be described with reference to the drawings.

Figure 38:
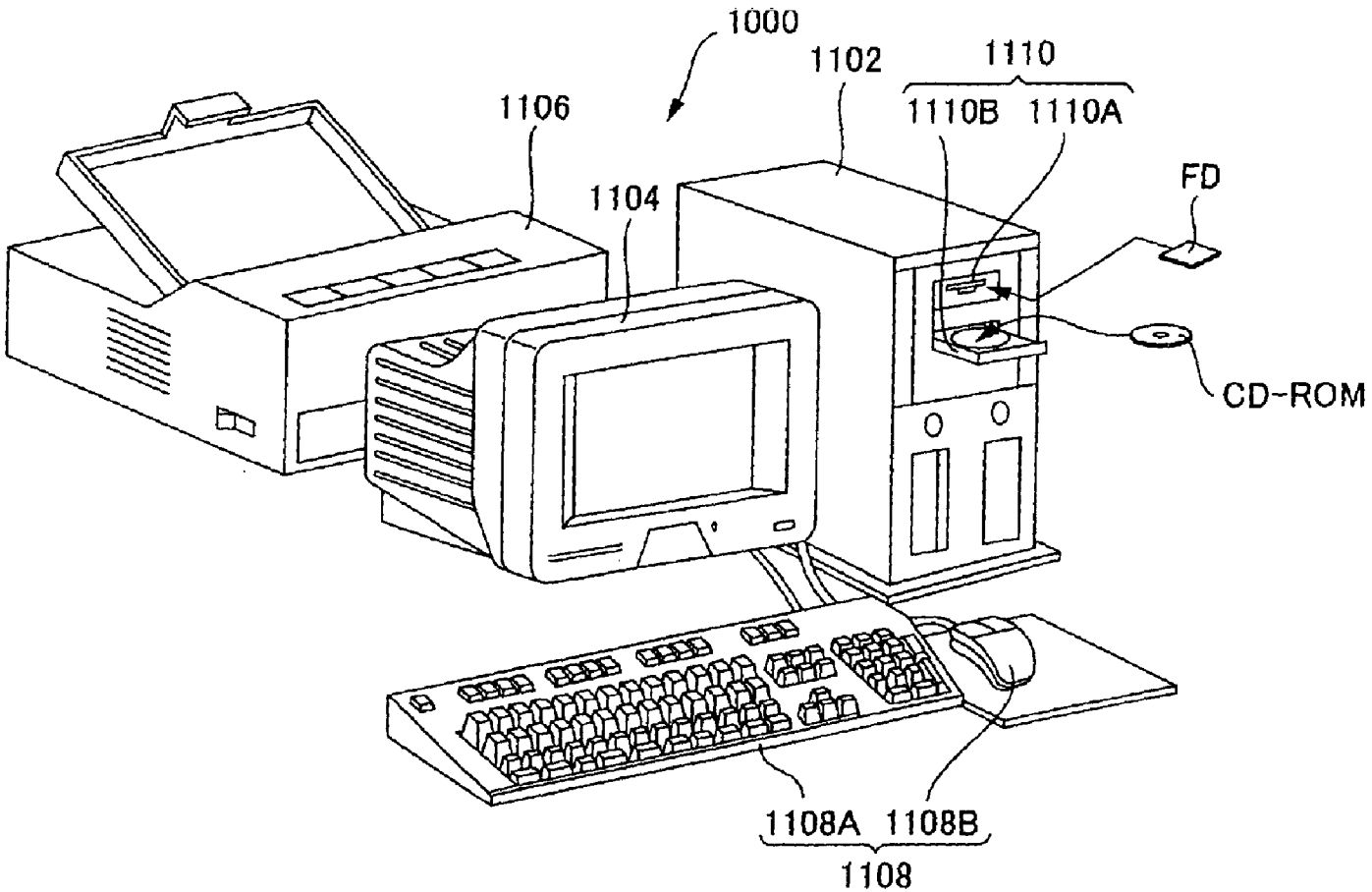
FIG. 38 is an explanatory diagram showing the external configuration of a computer system according to an embodiment.

FIG. 38 is an explanatory diagram showing the external configuration of a computer system. The computer system 1000 includes: a computer unit 1102; a display device 1104; a printer 1106; an input device 1108; and a reading device 1110. In the present embodiment, the computer unit 1102 is housed in a mini-tower casing; however the structure is not limited to this example. Although a CRT (cathode ray tube), a plasma display, or a liquid crystal display device is generally used as the display device 1104, any other kinds of devices can be used. The printer described above is used as the printer 1106. In the present embodiment, a keyboard 1108A and a mouse 1108B are used as the input device 1108; however, any other kinds of devices can be used. In the present embodiment, a flexible disk drive device 1110A and a CD-ROM drive device 1110B are used as the reading device 1110; however, it is also possible to use an MO (magneto-optical) disk drive device, a DVD (digital versatile disk) drive, or any other kinds of devices.

Figure 39:
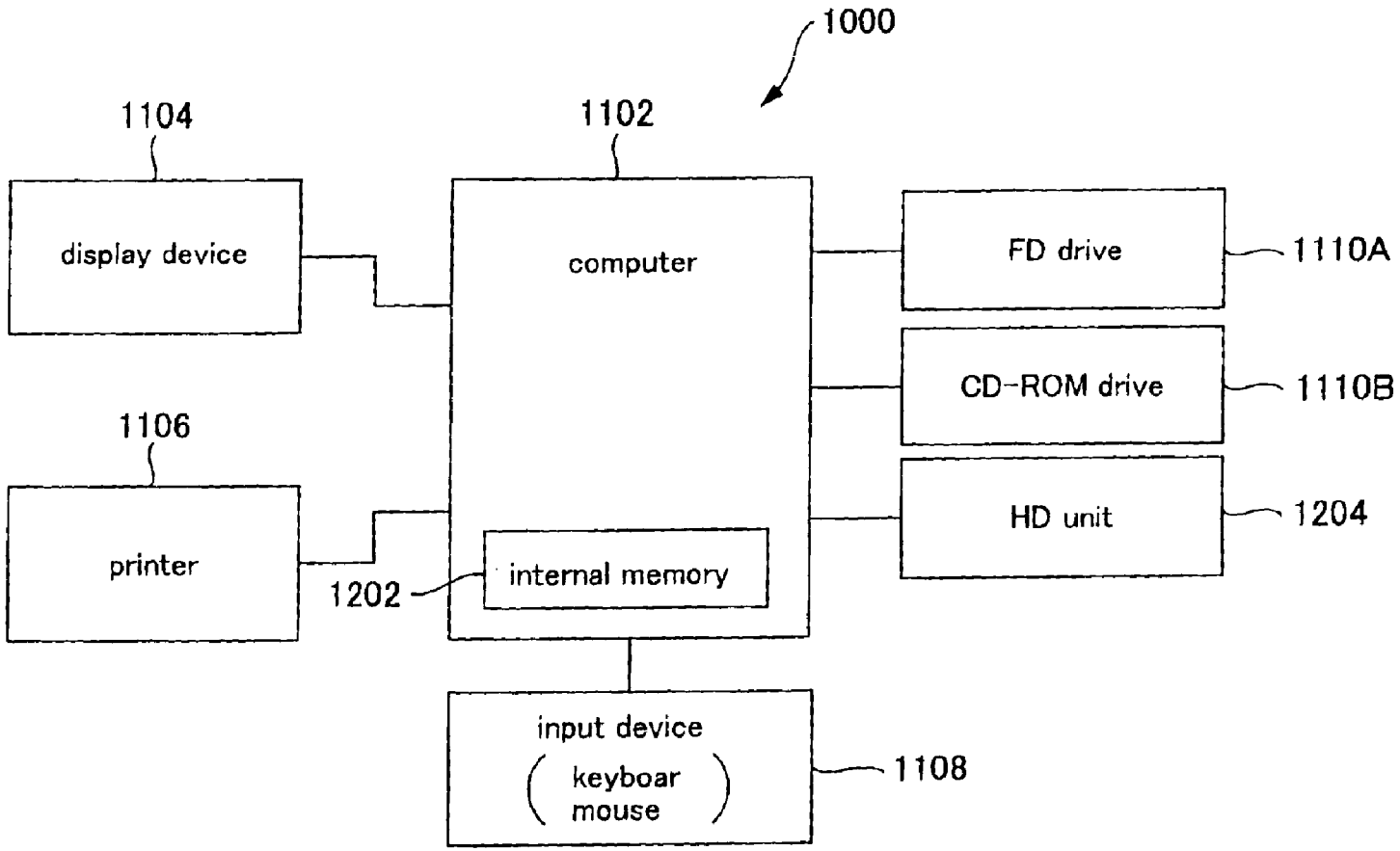
FIG. 39 is a block diagram showing the configuration of the computer system shown in FIG. 38.

FIG. 39 is a block diagram showing the configuration of the computer system shown in FIG. 38. FIG. 39 shows that an internal memory 1202, such as a RAM, provided inside the casing in which the computer unit 1102 is housed, and an external memory, such as a hard-disk drive unit 1204, are also provided.

In the above, description was made of an example in which the printer 1106 is connected to the computer unit 1102, the display device 1104, the input device 1108, and the reading device 1110 to configure the computer system. However, the configuration is not limited to the above. For example, the computer system may be configured comprising only the computer unit 1102 and the printer 1106, and it does not have to comprise any one of the display device 1104, the input device 1108, and the reading device 1110.

Further, for example, it is also possible for the printer 1106 to have some of the functions or mechanisms of each of the computer unit 1102, the display device 1104, the input devices 1108, and the reading device 1110. For example, it is possible to structure the printer 1106 so that it comprises an image processor for processing images, a display section for performing various kinds of displaying, and a recording media mounting section for detachably mounting a recording medium on which image data captured with a digital camera or the like is stored.

A computer system configured as above will be superior to existing computer systems as a whole.

According to the present invention, it is possible to realize a developer charging unit, a developing device, an image-forming apparatus, and a computer system, which are capable of making the charge of developer even and preventing a misalignment in a relative position of a thickness restricting member with respect to a developer bearing member from occurring.

What is claimed is:

1. A developer charging unit comprising:

a developer charging member for charging developer borne by a developer bearing member by abutting against said developer bearing member;

a supporting member for supporting said developer charging member; and a plurality of fixing portions for fixing said developer charging member and said supporting member together, said fixing portions being lined up according to a predetermined arrangement, wherein a spacing between two of said fixing portions located in a central section in a longitudinal direction of said developer charging member is shorter than a spacing between two of said fixing portions located at an end section in said longitudinal direction of said developer charging member.

2. A developer charging unit according to claim 1, wherein:

the closer said fixing portions are located to a center in said longitudinal direction of said developer charging member, the shorter the spacing between two of said fixing portions becomes.

3. A developer charging unit comprising:

a developer charging member for charging developer borne by a developer bearing member by abutting against said developer bearing member;

a supporting member for supporting said developer charging member; and a plurality of fixing portions for fixing said developer charging member and said supporting member together, said fixing portions being lined up according to a predetermined arrangement, wherein a distance between a free end of said developer charging member and one of said fixing portions located in a central section in a longitudinal direction of said developer charging member is shorter than a distance between said free end of said developer charging member and one of said fixing portions located at an end section in said longitudinal direction of said developer charging member.

4. A developer charging unit according to claim 3, wherein:

the closer a fixing portion is located to a center in said longitudinal direction of said developer charging member, the shorter the distance between said free end of said developer charging member and that fixing portion becomes.

5. A developer charging unit comprising:

a developer charging member for charging developer borne by a developer bearing member by abutting against said developer bearing member;

a supporting member for supporting said developer charging member; and a plurality of fixing portions for fixing said developer charging member and said supporting member together, said fixing portions being lined up according to a predetermined arrangement, wherein a number of said fixing portions located in a central section in a longitudinal direction of said developer charging member is larger than a number of said fixing portions located at an end section in said longitudinal direction of said developer charging member.

6. A developer charging unit according to claim 5, wherein:

the closer said fixing portions are located to a center in said longitudinal direction of said developer charging member, the larger the number of said fixing portions becomes.

7. A developer charging unit according to claim 1, wherein said developer charging member and said supporting member are fixed together by welding.

8. A developer charging unit according to claim 7, wherein said welding is laser welding.

9. A developer charging unit according to claim 1, wherein:

said developer charging member includes an elastic body that is capable of abutting against a surface of said developer bearing member, and an elastic-body-supporting member for supporting surface elastic body; and said elastic-body-supporting member and said supporting member are fixed together.

10. A developer charging unit according to claim 1, wherein a screw hole for fixing said supporting member to a developing device is provided at each end section of said supporting member in said longitudinal direction thereof.

11. A developer charging unit comprising:

a developer charging member for charging developer borne by a developer bearing member by abutting against said developer bearing member;

a supporting member for supporting said developer charging member; and a plurality of fixing portions for fixing said developer charging member and said supporting member together, said fixing portions being lined up according to a predetermined arrangement, wherein:

a spacing between two of said fixing portions located in a central section in a longitudinal direction of said developer charging member is shorter than a spacing between two of said fixing portions located at an end section in said longitudinal direction of said developer charging member;

the closer said fixing portions are located to a center in said longitudinal direction of said developer charging member, the shorter the spacing between two of said fixing portions becomes;

said developer charging member and said supporting member are fixed together by laser welding;

said developer charging member includes an elastic body that is capable of abutting against a surface of said developer bearing member, and an elastic-body-supporting member for supporting said elastic body;

said elastic-body-supporting member and said supporting member are fixed together; and a screw hole for fixing said supporting member to a developing device is provided at each end section of said supporting member in said longitudinal direction thereof.

12. A developer charging unit comprising:

a developer charging member for charging developer borne by a developer bearing member by abutting against said developer bearing member;

a supporting member for supporting said developer charging member; and a plurality of fixing portions for fixing said developer charging member and said supporting member together, said fixing portions being lined up according to a predetermined arrangement, wherein:

a distance between a free end of said developer charging member and one of said fixing portions located in a central section in a longitudinal direction of said developer charging member is shorter than a distance between said free end of said developer charging member and one of said fixing portions located at an end section in said longitudinal direction of said developer charging member;

the closer a fixing portion is located to a center in said longitudinal direction of said developer charging member, the shorter the distance between said free end of said developer charging member and that fixing portion becomes;

said developer charging member and said supporting member are fixed together by laser welding;

said developer charging member includes an elastic body that is capable of abutting against a surface of said developer bearing member, and an elastic-body-supporting member for supporting said elastic body;

said elastic-body-supporting member and said supporting member are fixed together; and a screw hole for fixing said supporting member to a developing device is provided at each end section of said supporting member in said longitudinal direction thereof.

13. A developer charging unit comprising:

a developer charging member for charging developer borne by a developer bearing member by abutting against said developer bearing member;

a supporting member for supporting said developer charging member; and a plurality of fixing portions for fixing said developer charging member and said supporting member together, said fixing portions being lined up according to a predetermined arrangement, wherein:

a number of said fixing portions located in a central section in a longitudinal direction of said developer charging member is larger than a number of said fixing portions located at an end section in said longitudinal direction of said developer charging member;

the closer said fixing portions are located to a center in said longitudinal direction of said developer charging member, the larger the number of said fixing portions becomes;

said developer charging member and said supporting member are fixed together by laser welding;

said developer charging member includes an elastic body that is capable of abutting against a surface of said developer bearing member, and an elastic-body-supporting member for supporting said plastic body;

said elastic-body-supporting member and said supporting member are fixed together; and a screw hole for fixing said supporting member to a developing device is provided at each end section of said supporting member in said longitudinal direction thereof.

14. A developing device comprising:

a developer bearing member for bearing developer; and a developer charging unit according to claim 1, wherein a latent image borne by an image bearing member is developed using said developer borne by said developer bearing member and charged by said developer charging member provided in said developer charging unit.

15. An image-forming apparatus comprising:

an image bearing member for bearing a latent image;

a developer bearing member for bearing developer; and a developer charging unit according to claim 1, wherein a latent image borne by said image bearing member is developed using said developer borne by said developer bearing member and charged by said developer charging member provided in said developer charging unit.

16. A computer system comprising:

a computer unit;

a display device that can be connected to said computer unit; and an image-forming apparatus that can be connected to said computer unit and that includes: an image bearing member for bearing a latent image; a developer bearing member for bearing developer; and a developer charging unit according to claim 1, wherein a latent image borne by said image bearing member is developed using said developer borne here by said developer bearing member and charged by said developer charging member provided in said developer charging unit.

17. A developer charging unit comprising:

a developer charging member for charging developer borne by a developer bearing member;

a supporting member for supporting said developer charging member; and a plurality of fixing portions for fixing said developer charging member and said supporting member together, said fixing portions being lined up according to a predetermined arrangement, wherein a distance between a free end of said developer charging member and one of said fixing portions located at an end section in a longitudinal direction of said developer charging member is longer than a distance between said free end of said developer charging member and one of said fixing portions located in a central section in said longitudinal direction of said developer charging member.

18. A developer charging unit according to claim 17, wherein:

a spacing between two of said fixing portions located at the end section in said longitudinal direction of said developer charging member is wider than a spacing between two of said fixing portions located in the central section in said longitudinal direction of said developer charging member.

19. A developer charging unit according to claim 17, wherein said developer charging member and said supporting member are fixed together by welding.

20. A developer charging unit according to claim 19, wherein said welding is laser welding.

21. A developing device comprising:

a developer bearing member for bearing developer;

a developer charging unit including a developer charging member for charging said developer borne by said developer bearing member;

a supporting member for supporting said developer charging member; and a plurality of fixing portions for fixing said developer charging member and said supporting member together, said fixing portions being lined up according to a predetermined arrangement, wherein a latent image borne by an image bearing member is developed using said developer borne by said developer bearing member, and wherein a distance between a free end of said developer charging member and one of said fixing portions located at an end section in a longitudinal direction of said developer charging member is longer than a distance between said free end of said developer charging member and one of said fixing portions located in a central section in said longitudinal direction of said developer charging member.

22. A developing device according to claim 21, wherein:

a spacing between two of said fixing portions located at the end section in said longitudinal direction of said developer charging member is wider than a spacing between two of said fixing portions located in the central section in said longitudinal direction of said developer charging member.

23. A developing device according to claim 21, wherein said developer charging member and said supporting member are fixed together by welding.

24. A developing device according to claim 23, wherein said welding is laser welding.

25. A developing device according to claim 21, wherein a sealing member for preventing said developer from spilling is provided at said end section in said longitudinal direction of said developer charging member.

26. A developing device according to claim 25, wherein:

said developer charging member includes an elastic body that is capable of abutting against a surface of said developer bearing member, and an elastic-body-supporting member for supporting said elastic body; and said sealing member is fixed to said elastic-body-supporting member.

27. A developing device according to claim 26, wherein a thickness of said sealing member is thicker than a thickness of said elastic body.

28. A developing device according to claim 27, wherein:

said elastic body and said sealing member are fixed to said elastic-body-supporting member next to each other; and said elastic body and said sealing member abut against the surface of said developer bearing member.

29. A developing device comprising:

a developer bearing member for bearing developer;

a developer charging unit including a developer charging member for charging said developer borne by said developer bearing member;

a supporting member for supporting said developer charging member; and a plurality of fixing portions for fixing said developer charging member and said supporting member together, said fixing portions being lined up according to a predetermined arrangement, wherein:

a latent image borne by an image bearing member is developed using said developer borne by said developer bearing member;

a distance between a free end of said developer charging member and one of said fixing portions located at an end section in a longitudinal direction of said developer charging member is longer than a distance between said free end of said developer charging member and one of said fixing portions located in a central section in said longitudinal direction of said developer charging member;

a spacing between two of said fixing portions located at the end section in said longitudinal direction of said developer charging member is wider than a spacing between two of said fixing portions located in the central section in said longitudinal direction of said developer charging member;

said developer charging member and said supporting member are fixed together by laser welding;

a sealing member for preventing said developer from spilling is provided at said end section in said longitudinal direction of said developer charging member;

said developer charging member includes an elastic body that is capable of abutting against a surface of said developer bearing member, and an elastic-body-supporting member for supporting said elastic body;

a thickness of said sealing member is thicker than a thickness of said elastic body;

said elastic body and said sealing member are fixed to said elastic-body-supporting member next to each other; and said elastic body and said sealing member abut against the surface of said developer bearing member.

30. An image-forming apparatus comprising:

an image bearing member for bearing a latent image;

a developer bearing member for bearing developer; and a developer charging unit including a developer charging member for charging developer borne by said developer bearing member;

a supporting member for supporting said developer charging member; and a plurality of fixing portions for fixing said developer charging member and said supporting member together, said fixing portions being lined up according to a predetermined arrangement, wherein:

a latent image borne by said image bearing member is developed using said developer borne by said developer bearing member; and a distance between a free end of said developer charging member and one of said fixing portions located at an end section in a longitudinal direction of said developer charging member is longer than a distance between said free end of said developer charging member and one of said fixing portions located in a central section in said longitudinal direction of said developer charging member.

31. A computer system comprising:

a computer unit;

a display device that can be connected to said computer unit; and an image-forming apparatus that can be connected to said computer unit and that includes:

an image bearing member for bearing a latent image, a developer bearing member for bearing developer; and a developer charging unit including a developer charging member for charging developer borne by said developer bearing member;

a supporting member for supporting said developer charging member; and a plurality of fixing portions for fixing said developer charging member and said supporting member together, said fixing portions being lined up according to a predetermined arrangement, wherein:

a latent image borne by said image bearing member is developed using said developer borne by said developer bearing member; and a distance between a free end of said developer charging member and one of said fixing portions located at an end section in a longitudinal direction of said developer charging member is longer than a distance between said free end of said developer charging member and one of said fixing portions located in a central section in said longitudinal direction of said developer charging member.

32. A developing device comprising:

a housing that has an opening and that is capable of containing developer;

a developer bearing member for bearing said developer, said developer bearing member being arranged to front on said opening;

a developer charging member for charging said developer borne by said developer bearing member; and a sealing member for preventing said developer from spilling out from between said housing and a circumferential surface of said developer bearing member at an end section in an axial direction of said developer bearing member, said housing further including a pressing portion for pressing said developer charging member towards said developer bearing member, wherein a pressing force caused by said pressing portion and exerted on an end section, in said axial direction of said developer bearing member, of said developer charging member becomes smaller from an end in said axial direction towards a center of said developer bearing member.

33. A developing device according to claim 32, wherein a second sealing member is provided between said pressing portion and said developer charging member, said second sealing member being provided for preventing said developer from spilling out from between said pressing portion and said developer charging member.

34. A developing device according to claim 33, wherein a spacing between said pressing portion and said developer charging member becomes wider from the end towards the center in said axial direction of said developer bearing member.

35. A developing device according to claim 34, wherein said pressing portion has a protruding portion protruding towards said developer charging member at an end, in said axial direction of said developer bearing member, of said pressing portion.

36. A developing device according to claim 35, wherein said protruding portion presses said sealing member through said second sealing member.

37. A developing device according to claim 35, wherein said pressing portion has an inclined surface between said protruding portion and a non-protruding portion of said pressing portion.

38. A developing device according to claim 32, wherein:

said developer charging member includes an abutting member that is made to abut against said developer bearing member, and an impelling member for impelling said abutting member;

said abutting member and said sealing member are fixed to said impelling member next to each other; and said abutting member and said sealing member abut against a surface of said developer bearing member.

39. A developing device comprising:

a housing that has an opening and that is capable of containing developer;

a developer bearing member for bearing said developer, said developer bearing member being arranged to front on said opening;

a developer charging member for charging said developer borne by said developer bearing member; and a sealing member for preventing said developer from spilling out from between said housing and a circumferential surface of said developer bearing member at an end section in an axial direction of said developer bearing member, said housing further including a pressing portion for pressing said developer charging member towards said developer bearing member, wherein:

a pressing force caused by said pressing portion and exerted on an end section, in said axial direction of said developer bearing member, of said developer charging member becomes smaller from an end in said axial direction towards a center of said developer bearing member;

a second sealing member is provided between said pressing portion and said developer charging member, said second sealing member being provided or preventing said developer from spilling out from between said pressing portion and said developer charging member;

a spacing between said pressing portion and said developer charging member becomes wider from the end towards the center in said axial direction of said developer bearing member;

said pressing portion has a protruding portion protruding towards said developer charging member at an end, in said axial direction of said developer bearing member, of said pressing portion;

said protruding portion presses said sealing member through said second sealing member;

said pressing portion has an inclined surface between said protruding portion and a non-protruding portion of said pressing portion;

said developer charging member includes an abutting member that is made to abut against said developer bearing member; and an impelling member for impelling said abutting member;

said abutting member and said sealing member are fixed to said impelling member next to each other; and said abutting member and said sealing member abut against a surface of said developer bearing member.

40. An image-forming apparatus comprising:

a developing device including:

a housing that has an opening and that is capable of containing developer;

a developer bearing member for bearing said developer, said developer bearing member being arranged to front on said opening;

a developer charging member for charging said developer borne by said developer bearing member; and a sealing member for preventing said developer from spilling out from between said housing and a circumferential surface of said developer bearing member at an end section in an axial direction of said developer bearing member, said housing further including a pressing portion for pressing said developer charging member towards said developer bearing member;

wherein a pressing force caused by said pressing portion and exerted on an end section, in said axial direction of said developer bearing member, of said developer charging member becomes smaller from an end in said axial direction towards a center of said developer bearing member.

41. A computer system comprising:

a computer unit;

a display device that can be connected to said computer unit; and an image-forming apparatus that can be connected to said computer unit and that includes:

a developing device including:

a housing that has an opening and that is capable of containing developer;

a developer bearing member for bearing said developer, said developer bearing member being arranged to front on said opening;

a developer charging member for charging said developer borne by said developer bearing member; and a sealing member for preventing said developer from spilling out from between said housing and a circumferential surface of said developer bearing member at an end section in an axial direction of said developer bearing member, said housing further including a pressing portion for pressing said developer charging member towards said developer bearing member, wherein a pressing force caused by said pressing portion and exerted on an end section, in said axial direction of said developer bearing member, of said developer charging member becomes smaller from an end in said axial direction towards a center of said developer bearing member.

42. A developing device comprising:

a developer bearing member for bearing developer, said developer bearing member having a rotation shaft and being capable of rotating about said rotation shaft;

a shaft bearing member for receiving said rotation shaft of said developer bearing member; and a thickness restricting unit having a thickness restricting member for restricting a thickness of a layer of said developer borne by said developer bearing member, wherein the position of said thickness restricting unit is determined by said shaft bearing member.

43. A developing device according to claim 42, wherein said thickness restricting member abuts against said developer bearing member to restrict the thickness of the layer of said developer borne by said developer bearing member.

44. A developing device according to claim 42, wherein:

said thickness restricting unit has a hole;

said shaft bearing member has a protrusion;

and the position of said thickness restricting unit is determined by fitting said protrusion into said hole.

45. A developing device according to claim 44, wherein:

said thickness restricting unit has a plurality of holes;

said shaft bearing member has a plurality of protrusions;

each of said protrusions is fit into a corresponding one of said holes; and a first protrusion among said plurality of protrusions has a shaft bearing hole for receiving said rotation shaft.

46. A developing device according to claim 45, wherein, among said plurality of holes, a first hole into which said first protrusion is fit has a circular shape.

47. A developing device according to claim 46, wherein said first protrusion is fit together with said first hole.

48. A developing device according to claim 45, wherein:

a second protrusion that is different from said first protrusion is fit into a second hole that is different from said first hole; and a direction from a center of said first hole towards a center of said second hole intersects a direction of a counterforce that said thickness restricting member receives from said developer bearing member by abutting against said developer bearing member.

49. A developing device according to claim 45, wherein:

a second protrusion that is different from said first protrusion is fit into a second hole that is different from said first hole;

said second protrusion abuts against said second hole at two sections; and a direction of a line that passes through said two sections is parallel to a direction of a counterforce that said thickness restricting member receives from said developer bearing member by abutting against said developer bearing member.

50. A developing device according to claim 44, further comprising a housing capable of containing said developer, wherein said protrusion is fit into said hole across said housing.

51. A developing device comprising:

a developer bearing member for bearing developer, said developer bearing member having a rotation shaft and being capable of rotating about said rotation shaft;

a shaft bearing member for receiving said rotation shaft of said developer bearing member; and a thickness restricting unit having a thickness restricting member for restricting a thickness of a layer of said developer borne by said developer bearing member by abutting against said developer bearing member, wherein:

said thickness restricting unit has a plurality of holes;

said shaft bearing member has a plurality of protrusion;

the position of said thickness restricting unit is determined by said shaft bearing member by fitting each of said protrusions into a corresponding one of said holes;

a first protrusion among said plurality of protrusions has a shaft bearing hole for receiving said rotation shaft;

among said plurality of holes, a first hole into which said first protrusion is fit has a circular shape;

said first protrusion is fit together with said first hole;

a second protrusion that is different from said first protrusion is fit into a second hole that is different from said first hole;

a direction from a center of said first hole towards a center of said second hole intersects a direction of a counterforce that said thickness restricting member receives from said developer bearing member by abutting against said developer bearing member;

said second protrusion abuts against said second hole at two sections;

a direction of a line that passes through said two section is parallel to a direction of a counterforce that said thickness restricting member receives from said developer bearing member by abutting against said developer bearing member;

said developing device further comprises a housing capable of containing said developer; and said protrusions are fit into said holes across said housing.

52. An image-forming apparatus comprising:

a developing device including:

a developer bearing member for bearing developer, said developer bearing member having a rotation shaft and being capable of rotating about said rotation shaft;

a shaft bearing member for receiving said rotation shaft of said developer bearing member; and a thickness restricting unit having a thickness restricting member for restricting a thickness of a layer of said developer borne by said developer bearing member, wherein the position of said thickness restricting unit is determined by said shaft bearing member.

53. A computer system comprising:

a computer unit;

a display device that can be connected to said computer unit; and an image-forming apparatus that can be connected to said computer unit and that includes:

a developing device including:

a developer bearing member for bearing developer, said developer bearing member having a rotation shaft and being capable of rotating about said rotation shaft;

a shaft bearing member for receiving said rotation shaft of said developer bearing member; and a thickness restricting unit having a thickness restricting member for restricting a thickness of a layer of said developer borne by said developer bearing member, wherein the position of said thickness restricting unit is determined by said shaft bearing member.

* * * * *